US005083162A

United States Patent [19]

Hanamoto et al.

[11] Patent Number: 5,083,162

[45] Date of Patent: Jan. 21, 1992

[54] IMAGE DUPLICATING APPARATUS INCLUDING AN EDITING FUNCTION

[75] Inventors: Hiroyuki Hanamoto; Kimihiko Higashio; Masazumi Ito, all of Aichi, Japan

[73] Assignee: Minolta Camera Kabushiki Kaisha, Osaka, Japan

[21] Appl. No.: 418,719

[22] Filed: Oct. 3, 1989

Related U.S. Application Data

[63] Continuation of Ser. No. 139,311, Dec. 29, 1987, abandoned.

[30] Foreign Application Priority Data

| | | | |
|---|---|---|---|
| May 28, 1987 | [JP] | Japan | 62-133091 |
| Jun. 8, 1987 | [JP] | Japan | 62-143552 |
| Jun. 8, 1987 | [JP] | Japan | 62-143553 |
| Jun. 8, 1987 | [JP] | Japan | 62-143554 |
| Jun. 8, 1987 | [JP] | Japan | 62-143555 |
| Jun. 8, 1987 | [JP] | Japan | 62-143556 |
| Aug. 8, 1987 | [JP] | Japan | 62-143551 |

[51] Int. Cl.[5] ..... G03G 21/00

[52] U.S. Cl. ..... 355/218; 355/326

[58] Field of Search ..... 355/200, 204, 210, 218, 355/326, 327, 328

[56] References Cited

U.S. PATENT DOCUMENTS

| | | | |
|---|---|---|---|
| 3,914,043 | 10/1975 | McVeigh | 355/4 |
| 4,417,805 | 11/1983 | Kishi | 355/14 R |
| 4,627,707 | 12/1986 | Tani et al. | 355/218 |
| 4,657,380 | 4/1987 | Hamano et al. | 355/218 X |
| 4,666,288 | 5/1987 | Watanabe | 355/14 R |
| 4,701,044 | 10/1987 | Horiuchi et al. | 355/218 |
| 4,707,713 | 11/1987 | Avata et al. | 355/7 X |
| 4,719,492 | 1/1988 | Hyodo | 355/243 X |
| 4,740,810 | 4/1988 | Ito | 355/218 |
| 4,766,404 | 8/1988 | Ishida et al. | 264/525 |
| 4,769,675 | 9/1988 | Watanabe | 355/7 X |
| 4,791,450 | 12/1988 | Mosehauer et al. | 355/4 |
| 4,794,421 | 12/1988 | Stoudt et al. | 355/3 R |
| 4,837,599 | 6/1989 | Ohira et al. | 355/69 X |
| 4,845,526 | 7/1989 | Ito | 355/218 |
| 4,855,786 | 8/1989 | Ohira et al. | 355/218 |
| 4,870,447 | 9/1989 | Yoshida et al. | 355/204 |
| 4,885,609 | 12/1989 | Maruta et al. | 355/218 X |
| 4,914,475 | 4/1990 | Sugishima et al. | 355/202 |
| 4,924,264 | 5/1990 | Ito et al. | 355/218 X |

FOREIGN PATENT DOCUMENTS

| | | |
|---|---|---|
| 0179253 | 4/1986 | European Pat. Off. . |
| 60-237469 | 11/1981 | Japan . |
| 60-166969 | 8/1985 | Japan . |
| 60-166970 | 8/1985 | Japan . |
| 61-203474 | 9/1986 | Japan . |
| 62-85265 | 4/1987 | Japan . |
| 2173665A | 10/1986 | United Kingdom . |

*Primary Examiner*—Fred L. Braun

*Attorney, Agent, or Firm*—Burns, Doane, Swecker & Mathis

[57] ABSTRACT

An image duplicating apparatus including a device for designating a localized area of a document sheet bearing visible images, a first input for entering conditions relating to the formation of the images within the designated area, a second input for entering conditions relating to the formation of the images outside the designated area, and image reproducing sections capable of duplicating the images on the whole area of the document sheet onto a single face of a copying sheet, wherein the images within the designated area of the document are duplicated onto the single face of the copying sheet in accordance with the conditions entered by the first input and the images outside the designated area of the document are duplicated onto the single face of the copying sheet in accordance with the conditions entered by the second input.

33 Claims, 49 Drawing Sheets

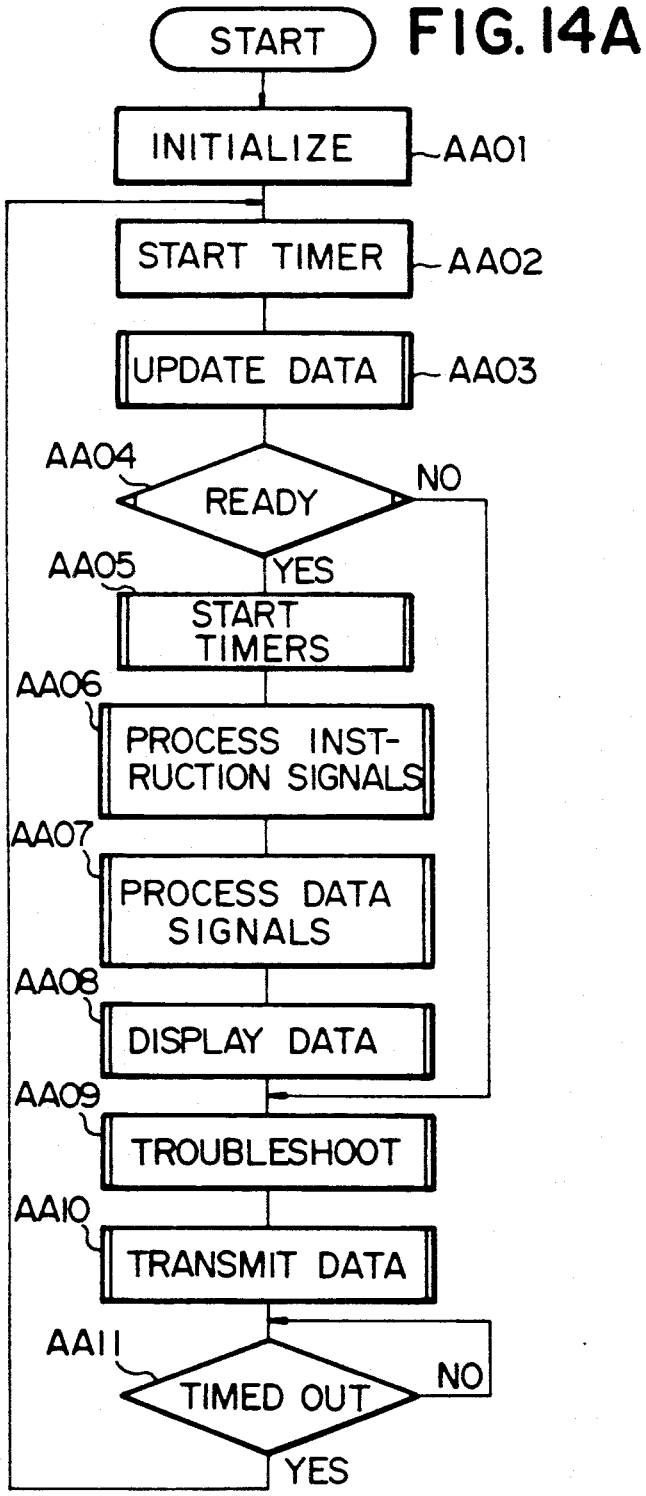
FIG. 14A
FIG. 14B
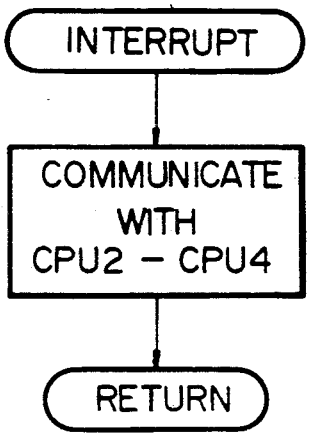

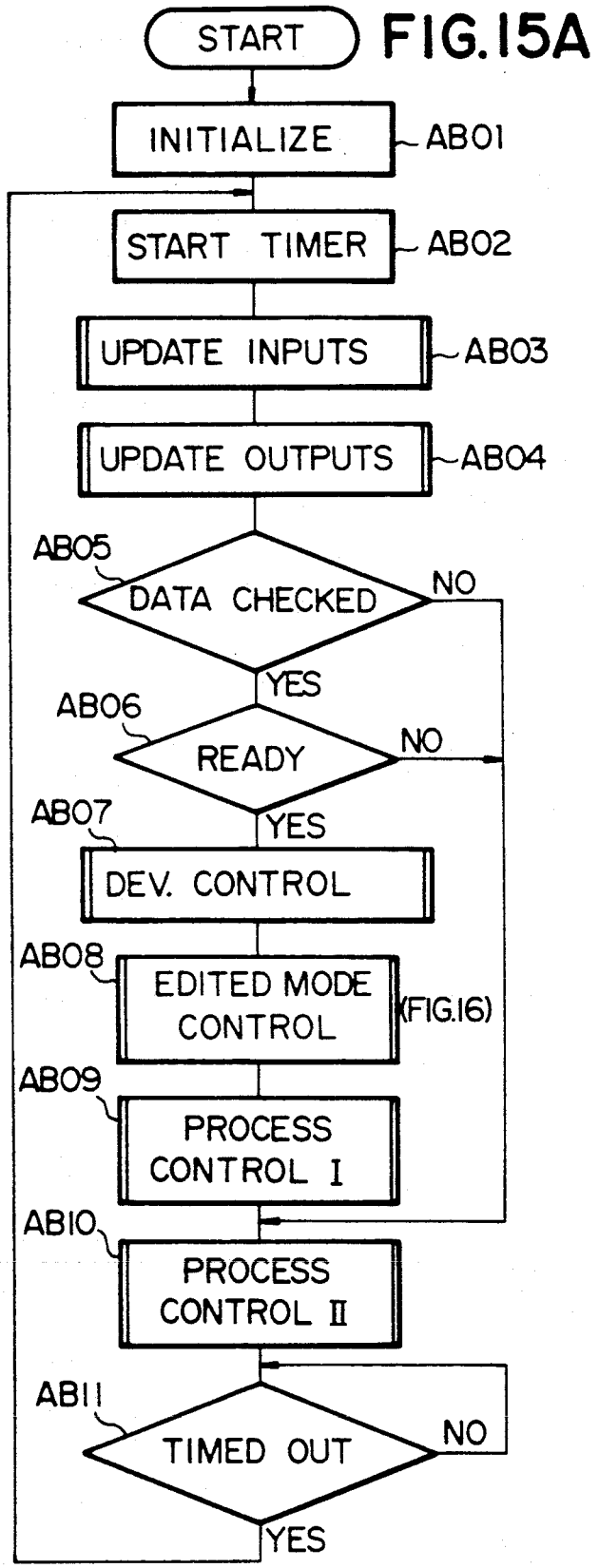
FIG.15A
FIG.15B
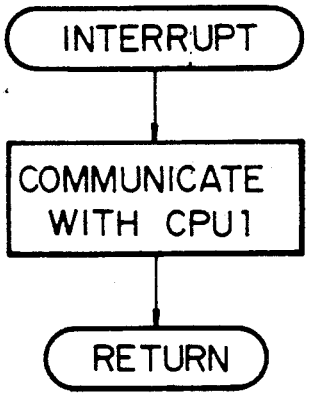

AB08

AC01
EDITED MODE REQ'D
NO
YES
AC02
AREA BEING SPECIFIED
NO
YES
AC06
SCEDIT ← 0
AC07
COORDINATE DATA INPUT
(FIG.19)
AC03
SCEDIT = 0
NO
YES
AC04
SCEDIT = 0
(FIG. 17A-17C)
AC05
SCEDIT = 1
(FIGS.18A/18B)
RETURN

AD1
AD10
FEDTA1 ← 1
AD2
AD12
AD11
Xb1 × Nx
Xa1 × Nx
AD3
AD13
AREA 2 CANCELLED
YES
NO
AD14
Xa2 = Xb2
YES
NO
AD15
Yc2 = Yd2
YES
NO
AD16
Xa2 = 0
NO
AD17
YES
FEDTWD ← 1
AD18
FEDTA2 ← 1
AD19
Yd2 × Nx
AD20
Yc2 × Nx
AD21
INITIALIZE LINE MEMORY
(FIG.21)
AD4

AD4
AD22
Y-AXIS DATA CALCULATION
AD23
FEDTWD = 1
NO
YES
AD24
FEDTWD ← 0
AD25
PRIORITY DETERMINATION
(FIG.23)
SIDE MARGIN ERASE
AD26
SCEDIT ← 1
AD27
RETURN

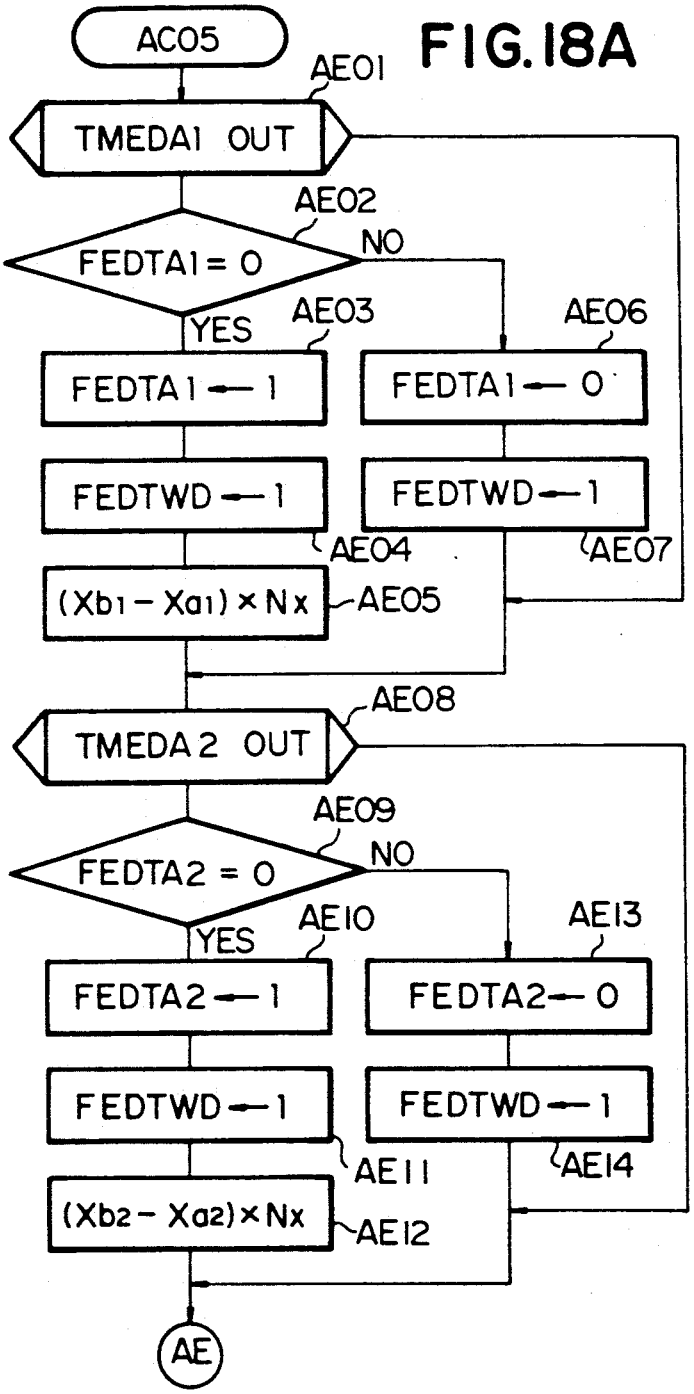
FIG.18A
FIG.18B
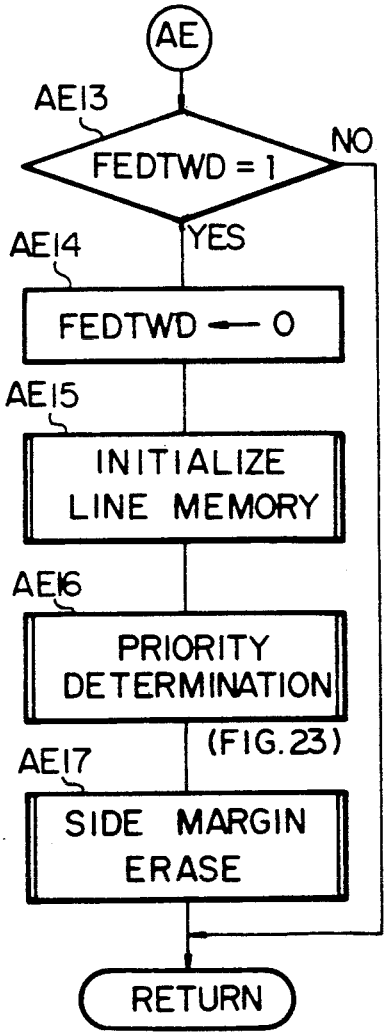

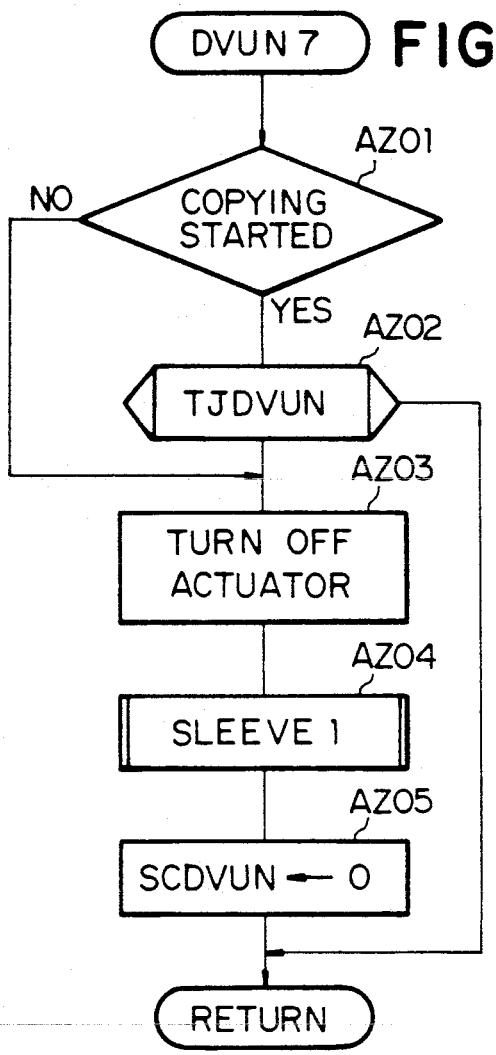
FIG. 38
FIG. 39
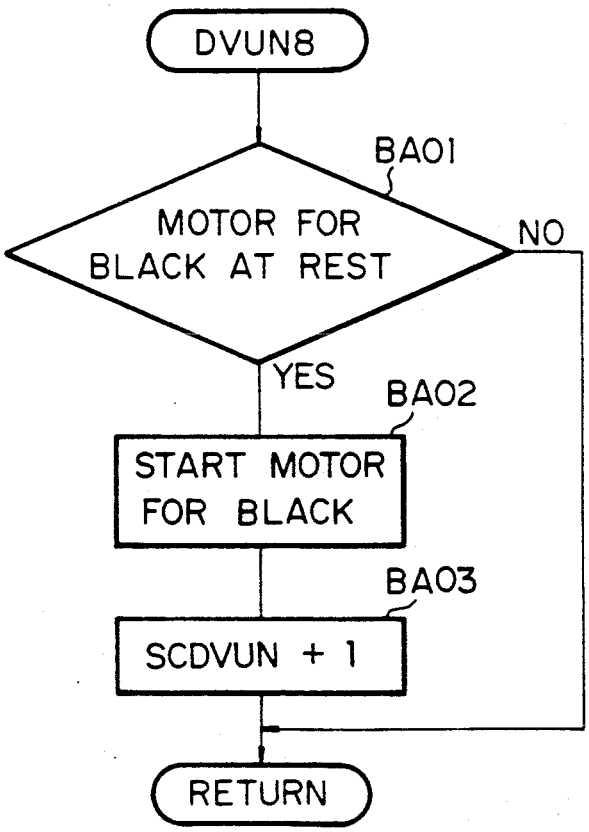

DVUN B
BC01
FDVR = 1
NO
YES
BC02
TJDVUN
(FIG.45)
BC03
TURN ON ACTUATOR
BC04
SET YDVUNB
BC05
TSDVUN
(FIG.46)
BC06
COPYING OVER
NO
YES
BC07
START MOTOR FOR RED
BC08
SET YDVUN3
BC09
TSDVUN
BC10
SCDVUN←4
BC11
SCDVUN←E
RETURN

COPYING
BQ01
402a OFF
NO
YES
BQ02
404a OFF
NO
YES
BQ03
202 ON
NO
YES
Fps ← 1
BQ04
BQ05
COMP MODE READY
NO
YES
BQ06
DUP'X MODE READY
NO
YES
BQ07
202 ON
NO
YES
Fps ← 1
BQ08
Fc1 ← 1
BQ09
RETURN
BQ10
Fc1 = 1
NO
YES
BQ11
PAPER RECIRCULATED
NO
YES
Fc2 ← 0
BQ12
Fps ← 1
BQ13
Q1

IMAGE DUPLICATING APPARATUS INCLUDING AN EDITING FUNCTION

This application is a continuation of application Ser. No. 139,311, filed Dec. 29, 1987, now abandoned.

FIELD OF THE INVENTION

The present invention relates to an image duplicating apparatus and particularly to an electrophotographic image duplicating apparatus such as a copying apparatus of the type having edited image forming and data input capabilities. More particularly, the present invention relates to an electrophotographic image duplicating apparatus having an edited mode of copying operation in which images within any one or more of a plurality of designated copy/erase areas may be copied and printed in any color or colors or may be blanked out or erased.

BACKGROUND OF THE INVENTION

An electrophotographic copying apparatus having edited image forming and data input capabilities is known which has an edited mode of copying operation in which images of a given document can be copied and printed in a plurality of colors. An advanced version of such a copying apparatus further allows designation of a localized area so that the images within the designated area may be copied and printed in any desired color or may be erased. Such a copying apparatus is disclosed in, for example, Japanese Provisional Patent Publication (Kokai) 60-237469.

A prior-art copying apparatus of this type however has an inconvenience in that only a single color can be used for the designated area and, thus it is not allowed to use one color for one designated area and another color for another designated area. If it is desired to have images within two different areas be printed respectively in different colors, the operator is compelled to use two consecutive cycles of copying operation. During the first cycle of operation, the images in one designated area are duplicated and printed in one color and the images in another designated area are duplicated and printed in another color during the second cycle of operation. Laborious and time-consuming efforts are thus required for the operator to produce a copy with two or more localized areas printed in different colors, respectively. If the two or more localized areas are at least partly overlapped by each other or one localized area in its entirety is contained within the coverage of another localized area, then the result will be that the images in the overlapped portions of the areas will be printed in two colors, which gives rise to deterioration in the contrast of the resultant duplicate images.

SUMMARY OF THE INVENTION

The present invention contemplates elimination of these and other problems which have thus far been inherent in an image duplicating apparatus of the described type.

In accordance with the present invention, there is provided an image duplicating apparatus comprising a) means for designating a localized area of a document sheet bearing visible images, b) first input means for entering conditions relating to the formation of the images within the designated area, c) second input means for entering conditions relating to the formation of the images outside the designated area, and d) copying means capable of duplicating the images on the whole area of the document sheet onto a single face of a copying sheet, e) wherein the images within the designated area of the document are duplicated onto the single face of the copying sheet in accordance with the conditions entered by the first input means and the images outside the designated area of the document are duplicated onto the single face of the copying sheet in accordance with the conditions entered by the second input means.

BRIEF DESCRIPTION OF THE DRAWINGS

The features and advantages of an image duplicating apparatus according to the present invention will be more clearly appreciated from the following description taken in conjunction with, the accompanying drawings in which:

FIG. 14A is a flowchart showing an example of the main routine program to be executed by a master microprocessor unit included in the control circuit illustrated in FIG. 8;

FIG. 14B is a flowchart showing an interrupt routine program to be executed by the master microprocessor unit to communicate with any of the slave microprocessor units also included in the control circuit illustrated in FIG. 8;

FIG. 15A is a flowchart showing an example of the main routine program to be executed by one of the slave microprocessor units included in the control circuit illustrated in FIG. 8;

FIG. 15B is a flowchart showing an interrupt routine program to be executed by the slave microprocessor unit to communicate with the master microprocessor unit or any of the other slave microprocessor units included in the control circuit illustrated in FIG. 8;

FIGS. 18A and 18B are flowcharts showing the details of a subroutine program to be executed when it is found that the status code used in the second microprocessor unit has a logic "1" bit state in the edited mode control subroutine program illustrated in FIG. 16;

FIGS. 36 to 38 are flowcharts showing the details of black select subroutine programs included in the subroutine program illustrated in FIG. 30;

FIGS. 39 to 44 are flowcharts showing the details of single-cycle two-colored mode control subroutine programs included in the subroutine program illustrated in FIG. 30;

DESCRIPTION OF THE PREFERRED EMBODIMENTS

Figure 1:
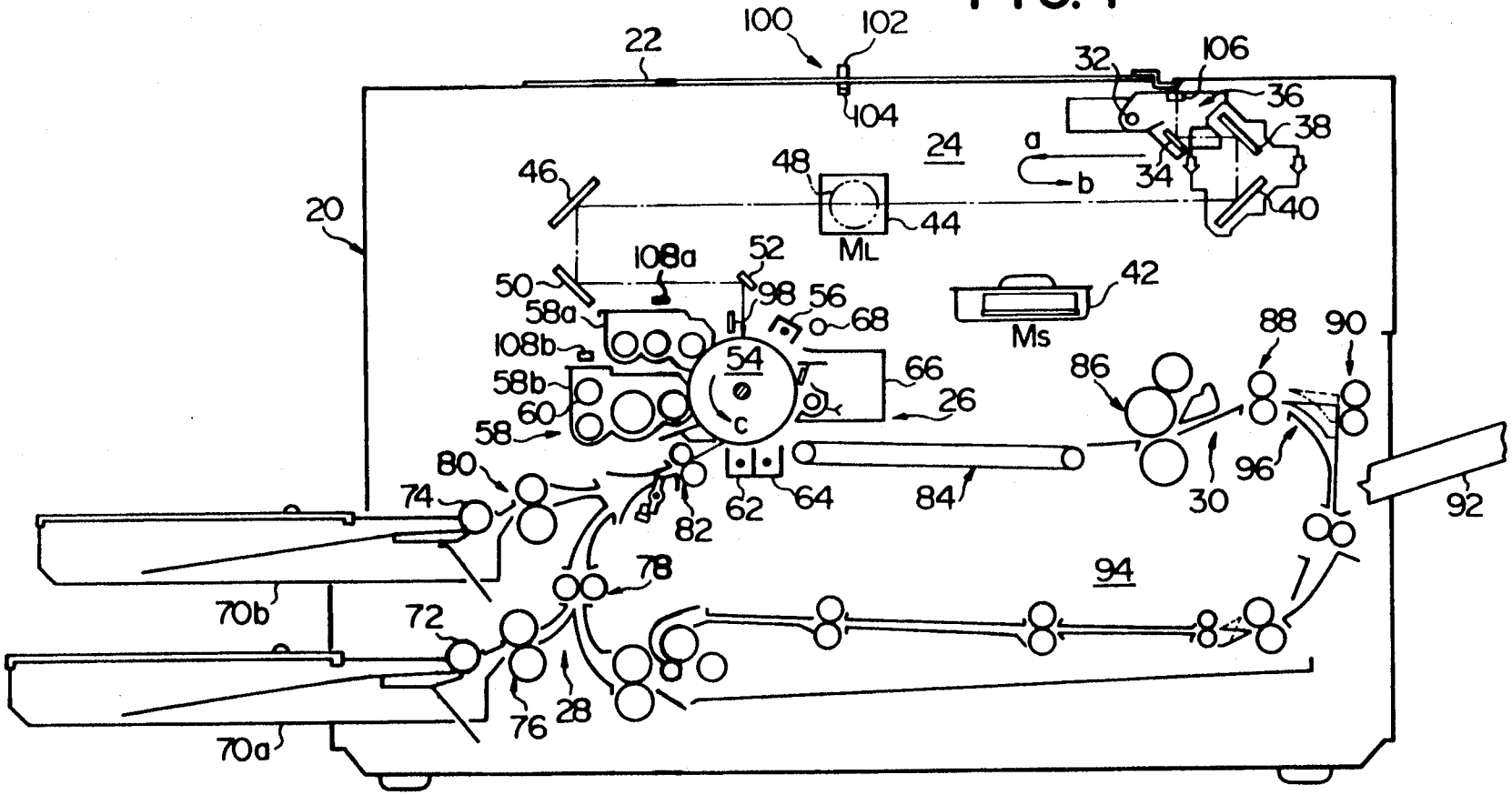
FIG. 1 is a side elevation view showing the general mechanical construction and arrangement of a preferred embodiment of an image duplicating apparatus according to the present invention.

As shown in FIG. 1, an image duplicating apparatus (hereinafter referred to as copying apparatus) embodying the present invention comprises a housing 20 having an upper panel portion formed in part by a transparent document table 22. A sheet of document (not shown) bearing images to be reproduced is to be placed on this document table 22.

During duplication operation of the apparatus, the document sheet placed on the document table 22 is optically scanned by illumination with light from an optical scanning system 24. A resultant beam of light carrying information representative of the images on the scanned document sheet is directed to an image reproduction system 26. The images carried by the light beam are thus provisionally recorded in the form of latent images, which are then developed into visible toner images through an electrophotographic process performed by the image reproduction system 26. The visible toner images are transferred to any record medium such as typically a copying sheet transported by a copy sheet feed mechanism 28 and the copy sheet now carrying the reproduced images is withdrawn out of the apparatus by means of an image-fixing and sheet discharge system 30.

The optical scanning system 24 is of the slit exposure type and comprises an exposure lamp 32 from which a beam of light is incident on and reflected from the lower face of the document sheet on the table 22. The light reflected from the document sheet is incident onto an object mirror 34 and is redirected rearwardly therefrom. The lamp 32 and object mirror 34 are carried on a common movable support member and, in combination, implement a document scanner 36 in the image duplicating apparatus embodying the present invention. The document scanner 36 is movable forwardly along the document table 22 as indicated by arrow a and backwardly as indicated by arrow b and has a predetermined home position with respect to the document table 22. The light reflected from the object mirror 34 is redirected toward a mirror 38, which further re-directs the light downwardly toward another mirror 40. The mirrors 38 and 40 are also carried on a common movable support member and are movable together along the document table 22 into and out of predetermined home positions with respect to the table. The document scanner 36 and such a mirror pair 38/40 are operatively coupled to common drive means comprising a scanner drive motor 42 ($M_S$) implemented by a d.c. reversible motor so that the former is driven to travel at a speed doubling the speed of movement of the latter.

From the mirror 40, the light travels forwardly along the document table 22 and passes through an image magnification/reduction lens unit 44 to a mirror 46. The lens unit 44 is movable along the document table 22 independently of the document scanner 36 and mirror pair 38/40 with respect to the table 22. The lens unit 44 is thus operatively coupled to drive means comprising a lens drive motor 48 ($M_L$) which may be implemented by a d.c. stepper motor. The mirror 46 then re-directs the light downwardly to a mirror 50 which further re-directs the beam to a projecting mirror 52 from which the light is reflected downwardly as shown. The mirrors 46, 50 and 52 are herein assumed to be fixedly held with respect to the housing 20 but, where desired, each or any one of them may be arranged to be movable and/or rockable with respect to the housing 20. Though not shown in the drawings, the lens unit 44 is assumed to include a cylindrical lens to permit an anamorphic edited mode of copying operation using independently different magnification ratios for two orthogonal axes.

On the other hand, the image reproducing system 26 of the apparatus comprises a cylindrical image transfer drum 54 having a photoconductive peripheral surface The light reflected downwardly from the projecting mirror 52 is projected onto the peripheral surface of this image transfer drum 54. The drum 54 is rotatable about its center axis in a direction indicated by arrow c and is driven for rotation at a fixed peripheral speed by means of a main drive motor (not shown) of the apparatus which may be provided independently of the scanner and lens drive motors. Movement of the lens unit 44 in either direction with respect to the mirror 46 results in a change in the position of the unit 44 with respect to the peripheral surface of the drum 54 and accordingly in a change in the magnification/reduction ratio (hereinafter referred to simply as magnification ratio) of the images to be reproduced. The image reproducing system 26 further comprises a main charger 56 to sensitize the photoconductive peripheral surface of the image transfer drum 54. Posterior to the path of light from the mirror 52 to the drum 54 is located an image developing stage 58 which is herein shown as including two, upper and lower developing units 58*a* and 58*b* detachably mounted in the apparatus and each having a stock of a developer powder composed of a mixture of electrostatically charged carrier particles and black or otherwise colored toner particles. In the description to follow, it will be assumed by way of example that red-colored toner particles is stored in the upper developing unit 58*a* and black-colored toner particles stored in the lower developing unit 58*b*.

In the image developing stage 58 is further provided a drive motor 60 ($M_D$) by means of which the rotatable members forming part of each of the developing units 58*a* and 58*b* are to be driven for rotation for applying toner particles to the peripheral surface of the image transfer drum 54 from a selected one of the developing units 58*a* and 58*b*, as will be described in more detail Posterior to the developing stage 58 in turn is provided an image transfer charger 62 which is operative to charge the copy sheet so that the toner images formed on the drum 54 are transferred to the copy sheet. The copy sheet thus having the toner images carried thereon is cleared of charges by a separation charger 64 which is located posterior to the transfer charger 62. There is further provided a drum cleaner unit 66 which removes any residual toner particles from the peripheral surface of the drum 54. Posterior to this cleaner unit 66 in turn is located a charge eraser lamp 68 which irradiates the cleaned peripheral surface of the drum 54 to eliminate the charges which may be left thereon.

The paper feed mechanism 28 of the copying apparatus is provided in conjunction with first and second paper supply cassettes 70*a* and 70*b* detachably fitted to the housing 20 and which respectively have encased therein stocks of copy sheets of different sizes. The paper feed mechanism 28 per se comprises first and second paper feed rollers 72 and 74 associated with the cassettes 70*a* and 70*b*, respectively. Each of these rollers 72 and 74 is driven for rotation for picking up copying sheets one after another from the stack of paper in the associated one of the cassettes 70*a* and 70*b*. A copying sheet picked up from the first paper supply cassette 70*a* by means of the first paper feed roller 72 is passed through a first pair of guide rollers 76 and further through a second pair of guide rollers 78 toward the image transfer drum 54 A copying sheet picked up from the second paper supply cassette 70*b* by means of the second paper feed roller 74 is passed through a third pair of guide rollers 80 toward the image transfer drum 54. Though not shown in the drawing, there may be further provided a manual paper feed slot in the housing 20 so that a copying sheet may be manually inserted into the housing 20 through this tray and transported toward the drum 54 through the third pair of guide rollers 80.

Immediately posterior to the developing stage 58 is provided a pair of timing rollers 82. A copying sheet which has been transported toward the image transfer drum 54 through the second guide rollers 78 or through the second guide rollers 80 is brought into contact with the peripheral surface of the drum 54 past these timing rollers 82. The timing rollers 82 are driven for rotation at a timing synchronized with the movement of the document scanner 36 so that the copying sheet is correctly transferred to the drum 54. The timing rollers 82 are further operative to rectify the direction of the copying sheet to be fed to the peripheral surface of the drum 54. Each of the paper feed rollers 66 and 68, each of the guide roller pairs 76, 78 and 80, and the pair of timing rollers 76 are driven from a main drive motor of the apparatus by means of respectively associated clutches (not shown).

A copy-sheet transport belt assembly 84 is positioned posterior to the area where the copy sheet is to be separated from the image transfer drum 54. The copy sheet separated from the drum 54 is thus conveyed rearwardly through the belt assembly 84 to an image fixing assembly 86 provided at the rear of the belt assembly 84 The toner particles carried on the copy sheet are thus thermally fused and the toner images fixed on the copy sheet by means of this image fixing assembly 86. The copy sheet released from the image fixing assembly 86 is withdrawn from the apparatus through first and second pairs of paper discharge rollers 88 and 90 and a paper discharge tray 92 attached to the housing 20 through a slot provided in the rear panel portion of the housing 20.

The copying apparatus embodying the present invention is assumed to further comprises a duplex/composite copy paper feed system 94 which is usually used for producing printed images on the reverse face of the copy sheet which has printed images already produced on its front face. Such a duplex/composite copy paper feed system 94 comprises a series of roller pairs arranged away from the first pair of paper discharge rollers 88 toward the second pair of paper guide rollers 78 so that the copy sheet which has been passed through the paper discharge rollers 88 is turned out and passed through the paper guide rollers 78 toward the timing rollers 82. Past the first pair of paper discharge rollers 88 is thus provided a two-way guide member 96 movable between a position to pass a copy sheet from the rollers 88 to the rollers 90 as indicated by broken lines and a position to pass a copy sheet from the rollers 88 to the rollers of the duplex/composite copy paper feed system 94 as indicated by full lines. In the copying apparatus embodying the present invention, the duplex/-composite copy paper feed system 94 is arranged to be also operable for a two-cycle two-colored edited mode of copying operation in which images within one specified area of a copying sheet are to be printed in one color and images within another specified area of the sheet are to be printed in another color on the same side of the sheet on which the images within the former area have been printed.

The copying apparatus embodying the present invention has capabilities to reproduce images within an edited mode within a specified area or areas of a copying sheet Such an edited mode of operation is performed with use of a selective charge eraser unit 98 located posterior to the main charger 56 and anterior to the developing stage 58. The terms "posterior" and "anterior" herein referred to indicate the location of the charge eraser unit 98 with respect to the direction of rotation indocated by arrow c of the image transfer drum 54. Details of this eraser unit 98 will be described later.

The copying apparatus embodying the present invention further has capabilities to print reproduced images in two different colors (which may include black}on one face of a single copying sheet during a single cycle of copying operation. Such a copying operation is herein referred to as single-cycle two-colored mode of copying operation and may be selected in addition to the above mentioned edited mode of copying operation. To carry out the single-cycle two-colored copying operation, the apparatus embodying the present invention comprises a color shift control device 100 by means of which a desired boundary between two differently colored zones can be manually defined during an edited mode of copying operation. Such a color shift control device 100 comprises a guide member (not shown) extending along a longitudinal edge of the document table 22, a slide member 102 slidable on the guide member, and a light interceptor element 104 slidable on the lower face of the document table 22 The light interceptor element 104 is movable with the slide member 102 and is thus capable of intercepting the beam of light from the exposure lamp 32 at any location to which the slide member 102 is manually moved in a direction parallel with the direction in which a document is to be scanned on the document table 22.

The apparatus embodying the present invention further comprises various sensors and detectors which include a boundary detector 106 implemented typically by a photoelectric transducer and carried on or otherwise movable with the document scanner 36. The boundary detector 106 is responsive to interception of light by the light interceptor element 104 and produces an output signal ($S_{BL}$) of a logic "1" bit indicative of the location to which the slide member 102 is manually moved. The signal $S_{BL}$ produced by the boundary detector 106 is thus representative of the location of the boundary line defined between desired zones of a copying sheet which are to be printed in different colors, respectively, one of which may be black and the other of which may be, for example, red.

The sensors and detectors provided in the apparatus further include first and second color sensors 108*a* and 108*b* arranged in conjunction with the upper and lower developing units 58*a* and 58*b*, respectively. Each of the developing units 58*a* and 58*b* has attached thereto a magnet element (not shown) located specifically to the particular unit to enable the associated color sensor 108*a* or 108*b* to discriminate one of the developing units 58*a* and 58*b* from the other depending on the locations of the magnet elements on the units 58*a* and 58*b*. It is herein assumed by way of example that there are available three detachable developing units for storing black, red (or magenta) and yellow toner particles and that the color sensors 108*a* and 108*b* which are responsive to these developing units to produce signals of logic "1" and "0" bits in accordance with the following schedules:

| Toner Color | Sensor 108a | Sensor 108b |
|---|---|---|
| Black | "1" | "1" |
| Red | "1" | "0" |
| Yellow | "0" | "1" |
| None | "0" | "0" |

In this table, the term "None" in the left column indicates that there is no developing unit detected to be installed in the developing stage 58 or none of the developing units storing the black, red and yellow colored toner particles is installed in the stage 58. As noted previously, it is further assumed that the upper and lower developing units 58*a* and 58*b* have stored therein red and black colored toner particles, respectively. In the presence of such developing units 58*a* and 58*b*, the first color sensor 108*a* associated with the upper developing unit 58*a* is operative to produce a signal of a logic "1" bit and the second color sensor 108*b* associated with the lower developing unit 58*b* is operative to produce a signal of a logic "0" bit.

Figure 2:
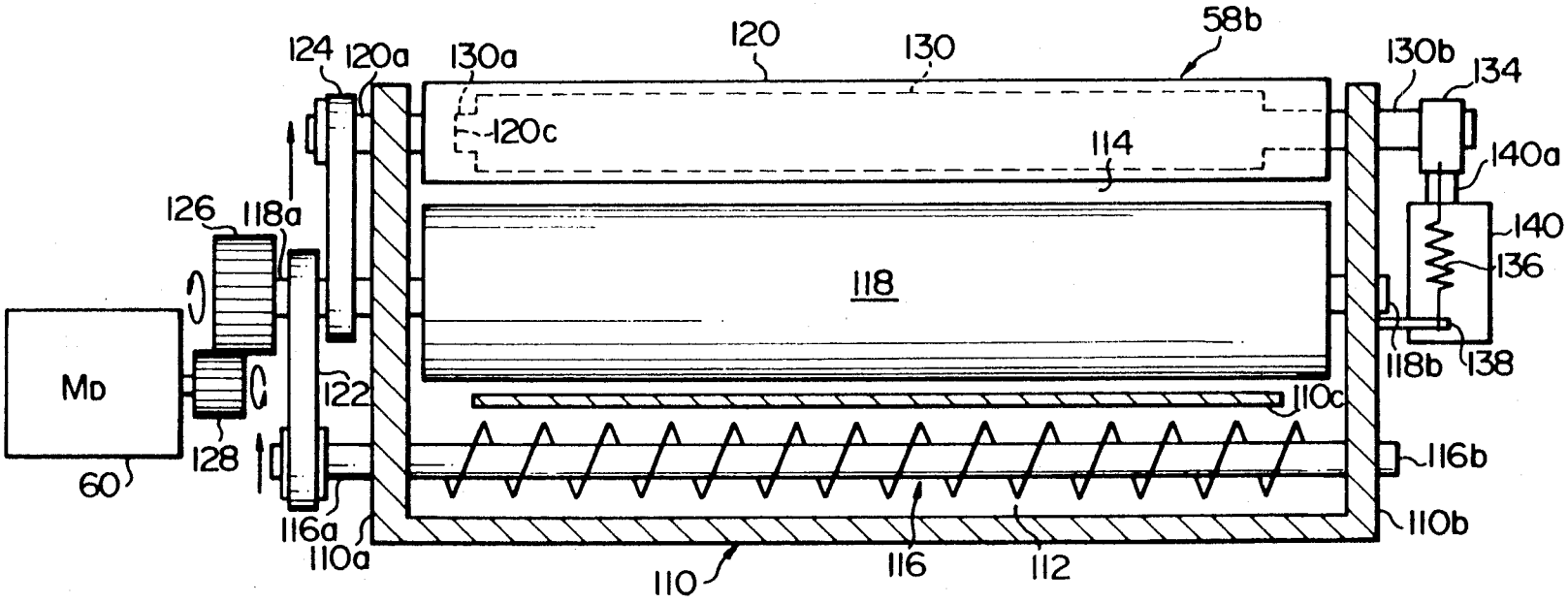
FIG. 2 is a plan view showing, partly in section, the construction and arrangement of one of the developing units provided in the image reproducing system of the image duplicating apparatus shown in FIG. 1.
Figure 3:
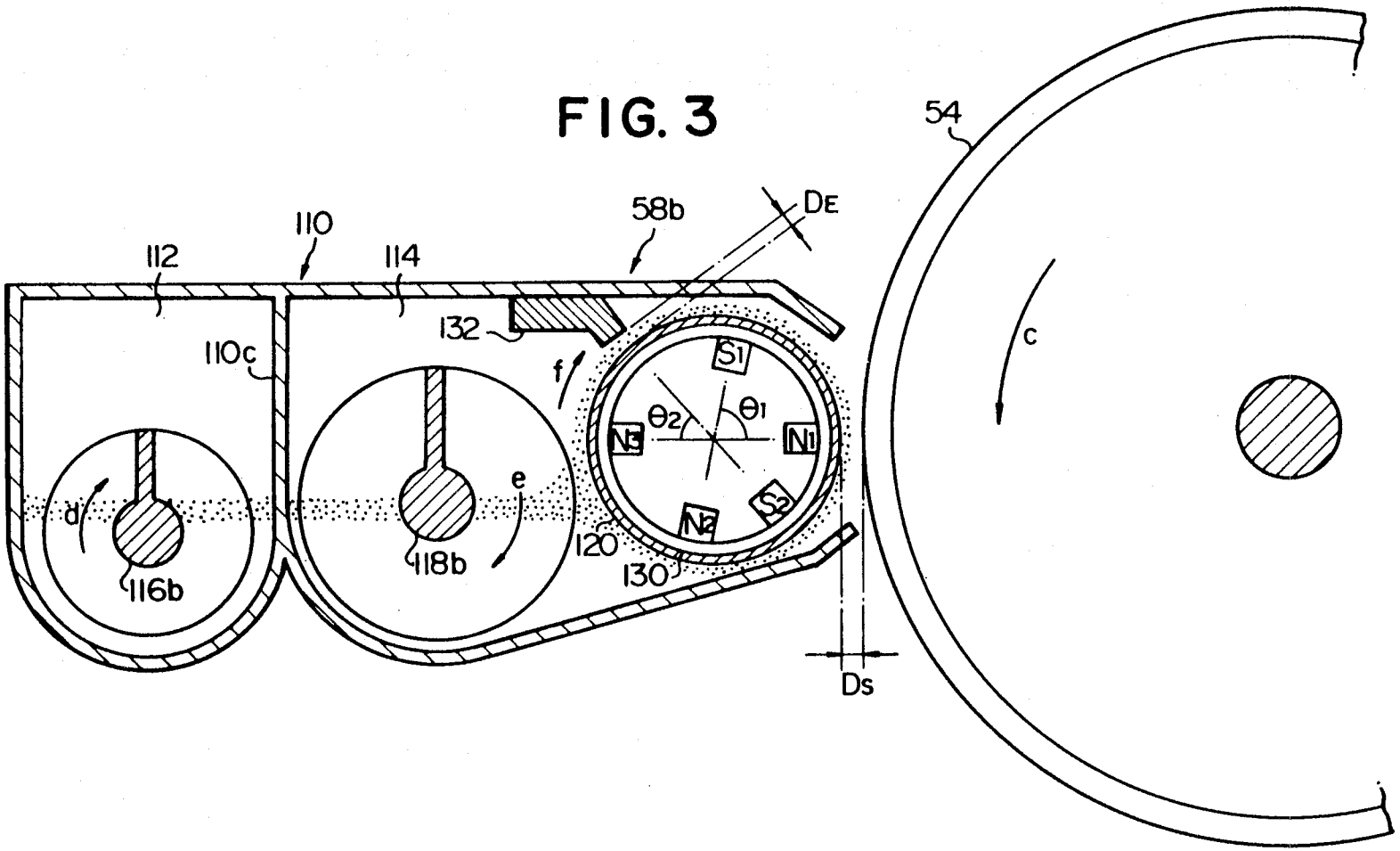
FIG. 3 is a cross sectional view taken along line III-III in FIG. 2.
Figure 4:
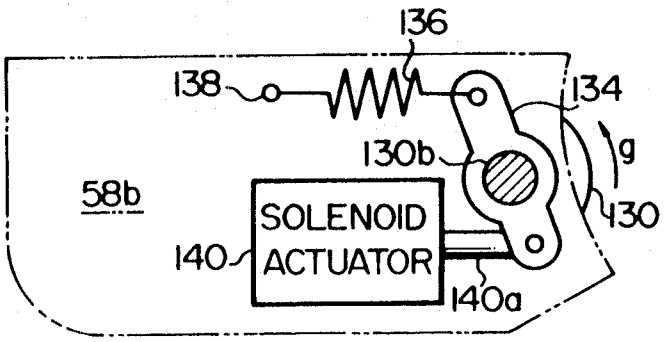
FIG. 4 is a schematic side elevation view showing an example of the arrangement for actuating the magnetic rotor included in the developing unit illustrated in FIGS. 2 and 3.

FIGS. 2, 3 and 4 show the detailed construction of the developing stage 58 which forms part of the image reproducing system 26 of the apparatus embodying the present invention. The two developing units 58*a* and 58*b* of the stage 58 being essentially similar in construction, the detailed construction of only the lower developing unit 58*b* is herein shown as being representative of the two.

As will be seen from FIGS. 2 and 3, the developing unit 58*b* comprises a housing 110 defining a storage chamber 112 and a transfer chamber 114. These chambers 112 and 114 are separate from each other by a partition wall 110*c* forming part of the housing 110 and communicate with each other at the opposite longitudinal ends of the partition wall 110*c* as will be seen from FIG. 3. Positioned within the storage chamber 112 is a feed screw 116 rotatable in the direction of arrow d about an axis parallel with the axis of rotation of the image transfer drum 54 and having opposite end portions 116*a* and 116*b* journaled in opposite end walls 110*a* and 110*b*, respectively, of the housing 110. The developer powder stored in the storage chamber 112 is thus distributed from the vicinity of one end of the partition wall 110*c* to the vicinity of the other along the screw 116 and is fed into the toner transfer chamber 114 as the screw 116 is driven for rotation in the storage chamber 112.

Within the transfer chamber 114 are provided a transfer roller 118 and a hollow, cylindrical toner applicator sleeve 120 each positioned in parallel with the feed screw 116. The transfer roller 118 is positioned between the feed screw 116 and applicator sleeve 20 and also has opposite end portions 118*a* and 118*b* journaled in the opposite end walls 110*a* and 110*b*, respectively, of the housing 110. The transfer roller 118 is rotatable in the direction of arrow *e* about an axis parallel with the axis of rotation of the image transfer drum 54 so that the developer powder fed from the feed screw 116 is passed by the roller 118 over to the applicator sleeve 120 as the screw 116 and roller 118 are driven for rotation respectively in the directions of arrows d and e as indicated. The applicator sleeve 120 is positioned close to the image transfer drum 54 to form a gap $D_S$ between the peripheral surface of the drum 54 and the outer peripheral surface of the applicator sleeve 120 The sleeve 120 has an end portion 120*a* journalled in one end wall 110*a* of the housing 110 and is also rotatable in the direction of arrow f about an axis parallel with the axis of rotation of the image transfer drum 54. The end portion 116*a* of the feed screw 116 and the end portion 118*a* of the transfer roller 118 have respectively carried thereon pulleys between which is passed an endless drive belt 122. Likewise, the end portion 118*a* of the transfer roller 118 and the end portion 120*a* of the applicator sleeve 120 have respectively carried thereon pulleys between which is passed an endless drive belt 124. The end portion 118*a* of the transfer roller 118 thus carrying the pulleys associated with both of the drive pulleys 122 and 124 has further carried thereon a gear 126 which is in mesh with a gear 128 carried on the output shaft of the previously mentioned drive motor 60 ($M_D$).

The applicator sleeve 120 is constructed of a nonmagnetic material having a finely roughened outer peripheral surface and has accommodated therein a cylindrical magnetic rotor 130. The magnetic rotor 130 is rotatable within the applicator sleeve 120 about the center axis of the sleeve 120 and has opposite end portions 130*a* and 130*b*, one journalled in a socket 120*a* formed in an end wall portion of the sleeve 120 and the other journalled in the end wall 110*b* of the housing 110 as indicated by broken lines in FIG. 2. As will be seen from FIG. 3, the magnetic rotor 122 has embedded therein a total of five permanent magnet members each extending axially of the rotor 130 and consisting of four magnet members $S_1$, $N_1$, $S_2$ and $N_2$ having alternately opposite polarities and a magnet member $N_3$ having a negative polarity The magnet members $S_1$, $N_1$, $S_2$, $N_2$ and $N_3$ are angularly spaced apart from each other about the center axis of the rotor 130 with, particularly, the magnet members $N_1$ and $S_1$ angularly spaced apart an angle $\theta_1$ of, for example, 80 degrees. These magnet members may be selected such that the magnet member $N_1$ has a flux density of 1000 Gauss, each of the magnet members $S_1$ and $S_2$ has a flux density of 800 Gauss and each of the magnet members $N_2$ and $N_3$ has a flux density of 500 Gauss. The magnetic rotor 130 is rockable about the center axis thereof between an operative angular position having the magnet member $N_1$ located in proximity to the gap $D_S$ between the sleeve 120 and drum 54 as shown and an inoperative angular position turned through 40 degrees counterclockwise in FIG. 3 from the operative angular position and having the magnet members $S_1$ and $N_1$ equally spaced apart from the gap $D_S$.

In conjunction with such a magnetic rotor 130 is provided an ear-height limit member 132 attached to the housing 110 and located to form an ear-height limiting gap $D_E$ over the outer peripheral surface of the applicator sleeve 120. The ear-height limit member 132 is adapted to limit the heights of the "ears" of carrier particles produced on the outer peripheral surface of the sleeve 120. When the magnetic rotor 130 is turned to the operative angular position about the center axis thereof as above noted, the magnet member $N_3$ is located at an angle $\theta_2$ of, for example, 40 degrees to a radius aligned with the ear-height limiting gap $D_E$ as shown.

As will be seen in FIGS. 3 and 4, the developing unit **58*b* further comprises a control lever 134 fixedly carried on the end portion 120*b* of the magnetic rotor 130 and having diametrically opposite arm portions extending from the end portion 130*b*. A helical tension spring 136 is anchored at one end to one arm portion of the control lever 134 and at the other to an anchor pin 138 projecting from the wall portion 110*b* of the housing 110. The control lever 134 and accordingly the magnetic rotor 130 are thus biased to turn in the direction of arrow g (FIG. 4) about the center axis of the rotor 130. The direction of rotation of the rotor 130 as indicated by arrow g is such that the rotor 130 turns toward the inoperative angular position thereof with respect to the image transfer drum 54. A solenoid-operated actuator 140 has a plunger 140*a* pivotally connected to the other arm portion of the control lever 134, which is thus forced to turn from the operative angular position to the inoperative angular position thereof against the force of the spring 136 when the actuator 140 is energized. When the magnetic rotor 130 is held in the operative angular position with the actuator 140 energized, the magnet member $N_1$ in the rotor 130 is located close to the gap $D_S$ between the applicator sleeve 120 and image transfer drum 54. Under these conditions, the toner particles on the ears of carriers attached to the outer peripheral surface of the applicator sleeve 120 by means of the magnet member $N_1$ may be transferred to the peripheral surface of the drum 54. When the solenoid-operated actuator 140 is then de-energized and accordingly the magnetic rotor 130 is caused to turn to the inoperative angular position thereof by the force of the spring 136, the magnet members $S_1$ and $N_1$ are equally spaced apart from the gap $D_S$ so that there will be no ears of toner-carrying carriers formed on peripheral surface of the applicator sleeve 120** in proximity to the gap $D_S$.

Figure 5:
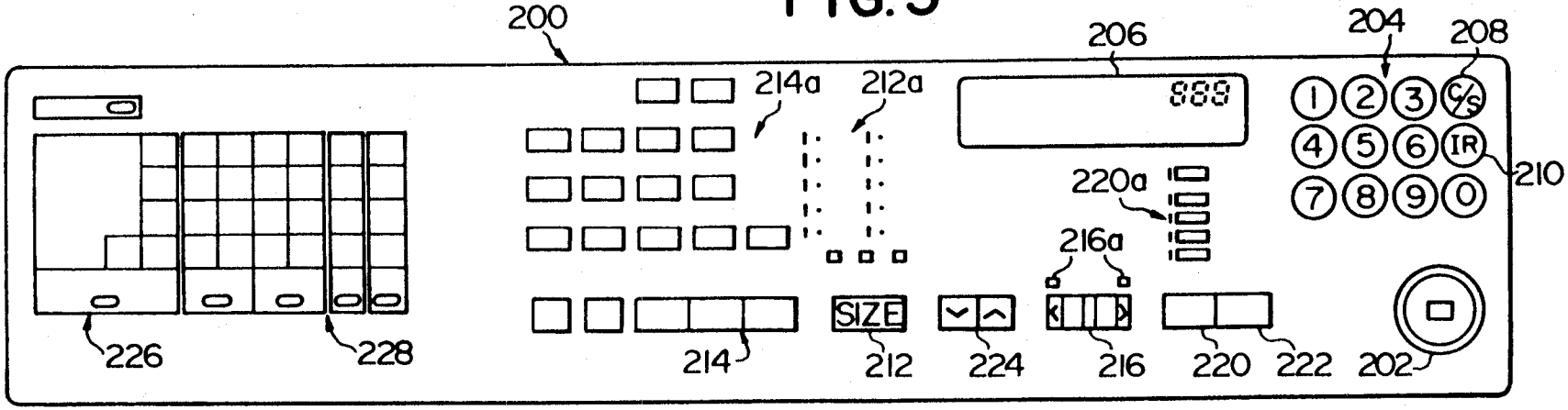
FIG. 5 is a plan view schematically showing the general configuration of the control panel forming part of the image duplicating apparatus illustrated in FIG. 1.

FIG. 5 shows the general configuration of a control panel 200 which forms part of the apparatus embodying the present invention. The control panel 200 comprises a print start switch 202 to enable the apparatus to start duplicating operation and a set of numerical switches 204 allocated to numerals 1, 2, . . . and 0, respectively, and used to enter a selected quantity of copy sheets to be printed. The quantity of copy sheets thus entered from the numerical switches 204 is displayed on a numerical data display window 206 and can be cleared from a clear/stop switch 208 (C/S) which may be used also for cancelling the instruction once entered from the print start switch 202. During printing of a preset quantity of copy sheets for a given document sheet, another document sheet may be duplicated in an interrupt mode entered at an interrupt request switch 210 (IR). The numerical switches 204 are to be used not only for entering a selected quantity of copy sheets to be printed but for entering numerical data representative of the coordinates to define a desired edited copy/erase area to be specified during an edited copying mode of operation. The numerical data thus entered from the switches 202 are also displayed on the numerical data display window 206.

The size of copy sheets to be used can be selected at a manual paper-size select switch 212 (SIZE) from among a predetermined number of sizes available. The selected size of copy sheets is displayed by any of paper-size indicators which are collectively indicated at **212*a*. The paper-size select switch 212 is, in effect, operative to select one of the paper supply cassettes 70*a* and 70*b* currently installed on the apparatus shown in FIG. 1. In the control panel 200 are further provided a set of magnification ratio select switches 214 for selecting any of predetermined magnification ratios for copying, the switches 214 having respectively associated indicators 216*a*. Further provided on the control panel 200 are print density increment and decrement switches 216 with respectively associated indicators 216*a* to permit manual selection of a desired print density for the copy sheets to be printed. The print density is stepwise incremented with one of the switches 216 depressed or decremented with the other of the switches 216 depressed. Furthermore, the color of the imaged to be printed can be selected from among different available colors at a color select switch 220 having associated color indicators 220*a* allocated to different print colors such as black, red (or magenta) and yellow as previously noted. The color select switch 220 is in effect operative to select one or two of the developing units 58*a* and 58*b* of the image developing stage 58 of the apparatus shown in FIG. 1**.

On the control panel 200 are further provided switches and indicators for selecting the edited mode of copying operation and entering data necessary for executing the edited copying operation. These switches and indicators include a single-cycle two-colored mode select switch 222 for requesting execution of the previously defined single-cycle two-colored mode of copying operation, and zoom switches 224 for continuously varying the coordinate values and/or the magnification ratio once entered for edited mode of copying operation. The zoom switches 224 may be used to enter coordinate data for each of the desired edited copy/erase areas 1 and 2. The numerical data continuously selected by the switches 224 are displayed on the numerical data display window 206 for visual assistance to the operator. The switches and indicators for the edited copying mode of operation further include those arranged in an edited copy mode control section 226 and those arranged in an anamorphic magnification control section 228. The switches in the anamophoscopic magnification control section 228 are used for the control of an anamophoscopic edited mode of copying operation using independently different magnification ratios for two orthogonal axes.

Figure 6:
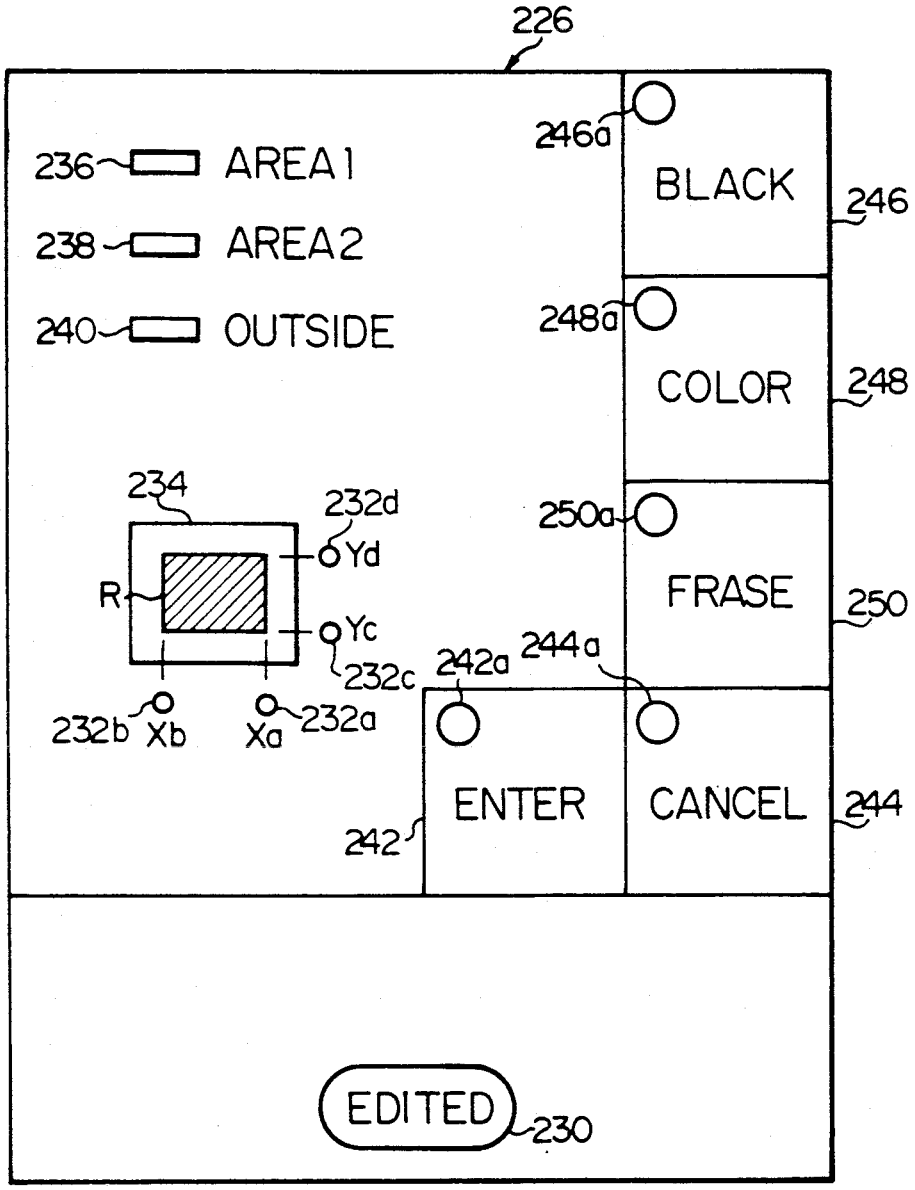
FIG. 6 is a plan view showing, to an enlarged scale, the edited copy mode control section provided in the control panel illustrated in FIG. 5.

FIG. 6 shows to an enlarged scale the arrangement of the edited copy mode control section 226 of the described control panel 200. The edited copy mode control section 226 comprises an edited copy mode select switch 230 to enable entry of various instructions and data for an edited mode of copying operation. When this edited copy mode select switch 230 is depressed to select the edited copying mode of operation, two of the indicators 220*a* associated with the color select switch 220, viz., the indicators respectively allocated to the two different print colors (which are herein assumed to be red and black print colors, respectively) available by the upper and lower developing units 58*a* and 58*b* currently installed in the apparatus are turned on to illuminate or flicker.

In association with the edited copy mode select switch 230 are arranged first to fourth indicators which consist of two x-coordinate indicators 232*a* and 232*b* and two y-coordinate indicators 232*c* and 232*d*. To provide a visible assistance to the designation of the coordinates of such a copy/erase area through the switch 232, there is further provided in the control section 226 an area display screen 234 on which a desired edited copy/erase area R to be printed or erased is to be visually indicated. An xy-coordinate system is thus taken into account on this area display screen 234 as having an axis of abscissa corresponding to the direction of circumferential direction of the drum 50 and an axis of ordinate corresponding to the axial direction of the drum 54, with an origin at the right lower corner of the screen 234. The desired edited copy/erase area R can thus be defined by the combination of x-coordinates $X_a$ and $X_b$ and y-coordinates $Y_c$ and $Y_c$ which may be designated from any of the numerical switches 204. The coordinates $X_a$, $X_b$, $Y_c$ and $Y_c$ may be designated one after another as the coordinate indicators 232*a* and 232*b* for the x-coordinates $X_a$ and $X_b$ and the coordinate indicators 232*c* and 232*d* for the y-coordinates $Y_c$ and $Y_d$, respectively, are turned on to illuminate or flicker successively. Each of the indicators 232*a* to 232*d* thus provided in the control section 226 is of the type using a light emitting diode (LED).

In the copying apparatus according to the present invention, it is assumed that there may be specified and displayed on the area display screen 234 two different edited copy/erase areas of a copying sheet. The two edited copy areas will be herein referred to respectively as "edited copy/erase area 1" or simply as "area 1" and "edited copy/erase area 2" or simply as "area 2". The remaining area of the copying sheet surrounding these areas 1 and 2 is referred to as "outside area". The area R shown displayed on the area display screen 234 is thus assumed to be representative of one of such two edited copy/ erase areas 1 and 2. The images within each of the edited copy/erase areas 1 and 2 or the outside area of a copying sheet may be printed in any of the two colors available or may be blanked out or "erased". Entry of data for the edited copy/ erase areas 1 and 2 is requested by successive illumination of indicators 236 and 238, and entry of data for the outside area surrounding the edited copy/erase areas 1 and 2 is indicated by illumination of an indicator 240.

The coordinate data for each of the desired edited copy/ erase areas 1 and 2 are specified with use the numerical keys 204 and/or the zoom switches 224 and numerical data display window 206 and entered with an area data enter switch 242 depressed. If there are no data desired to be entered for one or both of the edited copy/erase areas 1 and 2 or for the outside area, an area cancel switch 244 may be depressed. The selection between the two colors for each of the three areas can be entered through a black select switch 246 and an area color switch 248. The area black switch 246 is used for selecting black as the print color in which the images within the desired edited copy/erase area 1 or 2 or in the outside area area to be printed. The area color switch 248 is used for selecting another print color such as red (or yellow) as the color in which the images within the desired edited copy/erase area 1 or 2 or in the outside area are to be printed. The selection of the erasure of one or more of the three areas can be entered through an area erase switch 250 which may be used where it is desired to erase the images within one or both of the desired edited copy/erase area 1 or 2 or the outside area. The switches 242 to 250 have associated indicators 242*a* to 250*a*, respectively, each of which is to be turned on to flicker when the associated switch is depressed.

Figure 7:
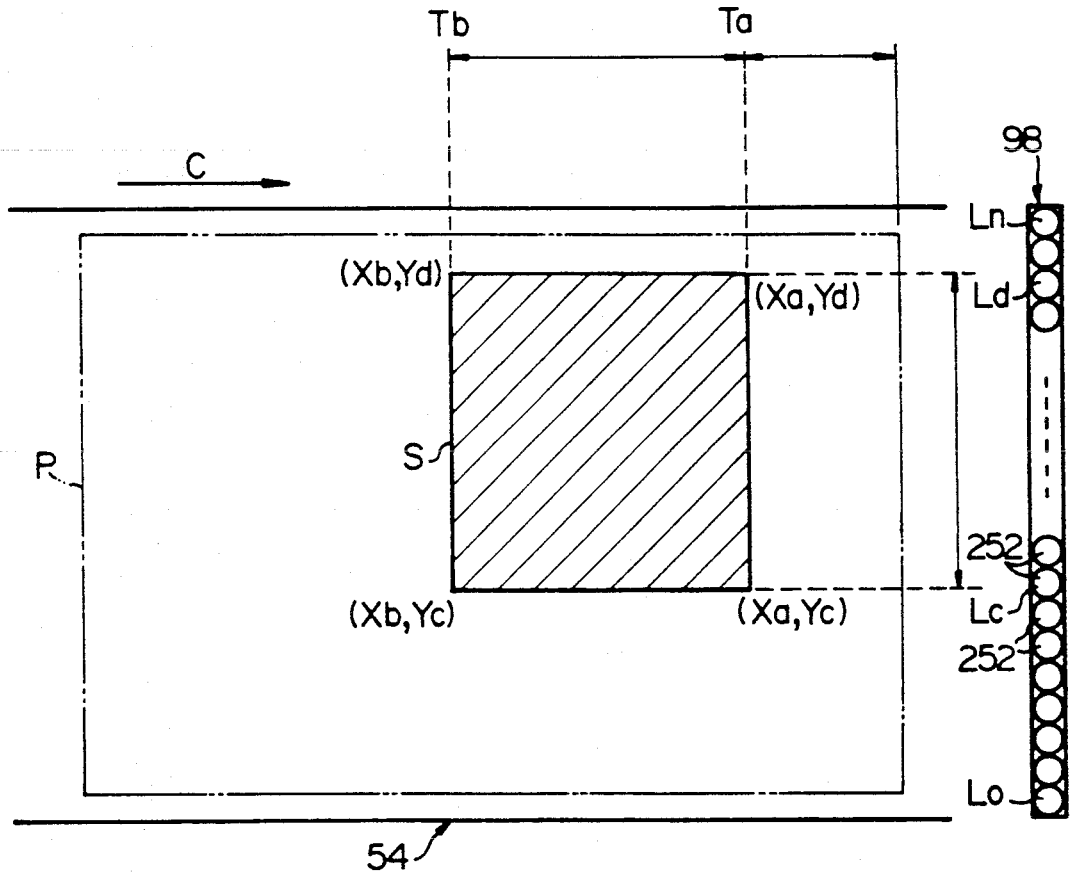
FIG. 7 is a view showing, in conjunction with the eraser unit incorporated in the apparatus illustrated in FIG. 1, an example of the edited copy/erase area which may be displayed on the display screen in the edited copy mode control section depicted in FIG. 6.

FIG. 7 shows, in conjunction with the selective charge eraser unit 98 incorporated in the copying apparatus illustrated in FIG. 1, an example of the edited copy/erase area which may be displayed on the display screen 234 in the edited copy mode control section 226 shown in FIG. 6. As has been shown in FIG. 1, the charge eraser unit 98 is located anterior, in the direction c of rotation of the image transfer drum 54, to the path of light from the projecting mirror 52 to the peripheral surface of the drum 54. If desired, however, the charge eraser unit 98 may be located posterior, in the direction c of rotation of the drum 54, to the path of light from the projecting mirror 52 to the drum 54. As further depicted in FIG. 7, the charge eraser unit 98 is composed of a number of, typically sixty light emitter elements 252 (Lo to Ln, upwardly) arranged in a single linear array. The liner array of the light emitter elements 252 is positioned close to the peripheral surface of the image transfer drum 54 and extends in parallel to the axis of rotation of the drum 54. When the light emitter elements 252 of such an charge eraser unit are activated to illuminate selectively with the drum 54 being driven for rotation, the charges on those small areas of the drum surface which are illuminated by the selected light emitter elements 252 are caused to disappear. Accordingly, no latent images can be produced on the particular areas of the drum surface when the drum surface is irradiated with an information carrying beam. It will be apparent that, where the charge eraser unit 98 is located posterior to the path of light to the peripheral surface of the drum 54, the latent images which have once been produced on the drum surface are to be destroyed by irradiation from the selected ones of the light emitter elements 252. Each of the light emitter elements 252 of the charge eraser unit 98 is implemented typically by a light emitting diode (LED).

For purposes of description, it is herein assumed that, out of the light emitter elements Lo to Ln forming the charge eraser unit 98, the adjacent light emitter elements Lc to Ld are activated to illuminate from time Ta to time Tb. Furthermore, the xy-coordinate system taken into account on the peripheral surface of the image transfer drum 54 is assumed to have its origin at the right lower corner of a copying paper P indicated by phantom lines. The direction indicated by arrow C along the axis of abscissa corresponds to the direction of rotation c of the image transfer drum 54 as shown in FIG. 1. When the light emitter elements Lc to Ld are activated from time Ta to time Tb, the charges are caused to dissipate on the area S of the drum surface as defined by the four coordinate points (Xa, Yc), (Xa, Yd), (Xb, Yc) and (Xb, Yd) given by the x-coordinates Xa and Xb respectively corresponding to the times Ta and Tb and the y-coordinates Yc and Yd respectively corresponding to the light emitter elements Lc and Ld. There can thus be produced no latter images within this area S when the drum 54 is illuminated with an information carrying beam incident on the drum surface. If it is assumed that the total area of the copying paper P as herein shown corresponds to a total or limited area of the document sheet to be duplicated in the edited copy mode, no visible images can be produced within the area of the copying paper which corresponds to the area S which is herein shown hatched. The area S is displayed as the edited copy/erase area R on the display screen 234 shown in FIG. 6 and, thus, the coordinates Xa, Xb, Yc and Yd which give the above mentioned four coordinate points respectively correspond to the coordinates defining the edited copy/erase area R irradiated by the light emitter elements Lc to Ld.

Figure 8:
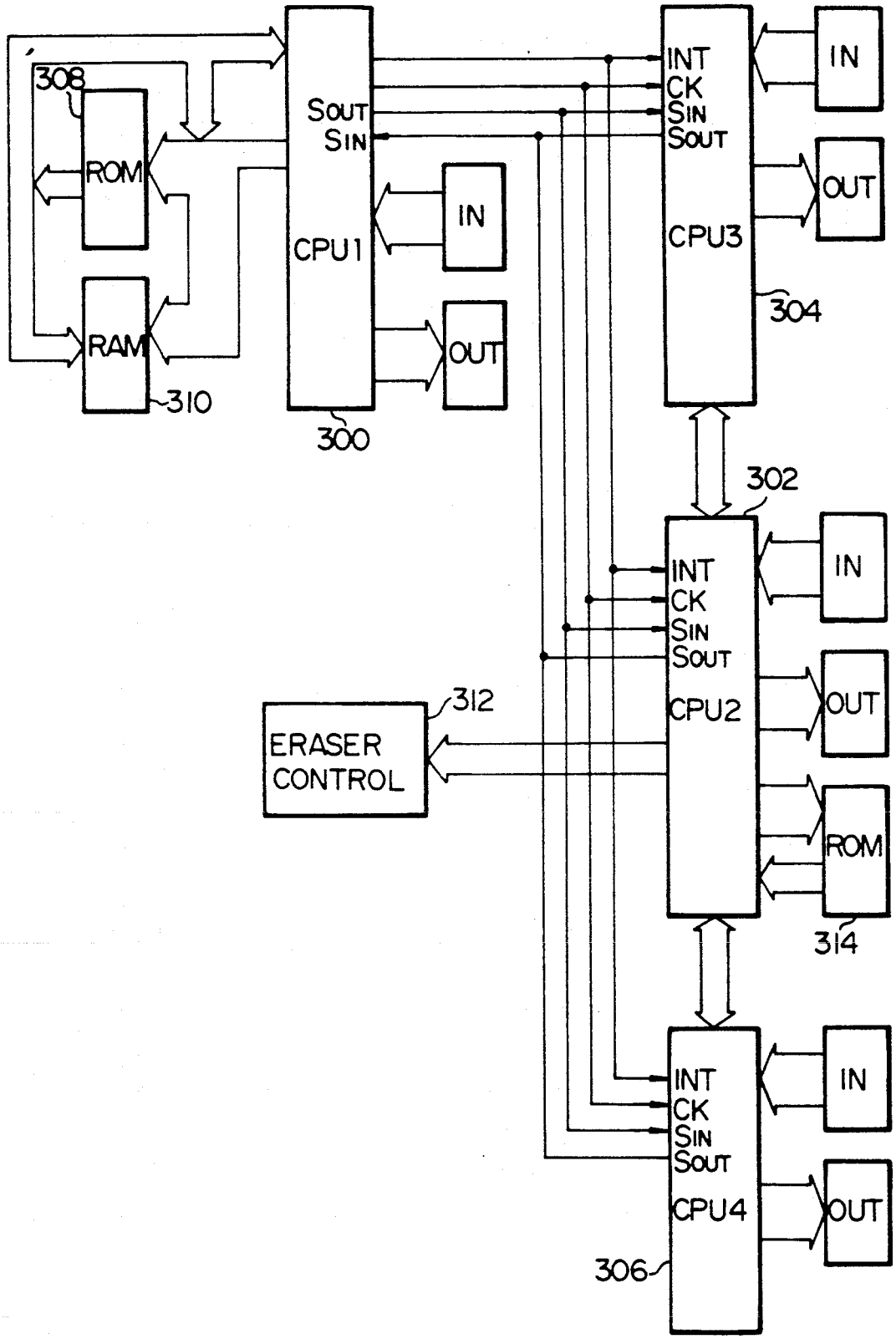
FIG. 8 is a diagram schematically showing the arrangement of a control circuit which may be incorporated in the image duplicating apparatus embodying the present invention.

FIG. 8 shows the general arrangement of a control circuit which may be used to achieve the functions hereinbefore described with reference to FIGS. 2 to 7. The control circuit comprises first, second, third and fourth microprocessors 300, 302, 304 and 306 (hereinafter referred to as CPU1, CPU2, CPU3 and CPU4, respectively). Each of the second to fourth CPU2 302 to CPU4 306 has a clock input port (CK) and is supplied with clock pulses from the first CPU1 300 therethrough. Each of the CPU2 302 to CPU4 306 further has an interrupt port (INT) and may be interrupted by the first CPU1 therethrough as required by the CPU1. The first to fourth CPU1 300 to CPU4 306 communicate with one another through data input and output ports ($S_{IN}$ and $S_{OUT}$) and through bidirectional buses connecting the CPU2 302 to CPU4 306 together. In association with the first CPU1 300 are provided a read-only memory 308 (ROM) and a random-access memory 310 (RAM). In the read-only memory 308 are stored the data and program to dictate the control procedures to be performed by the first CPU1 300.

The first CPU1 300 is mainly predominant over the input and output of various signals from and to the control panel 200 and is operative as a master CPU to control the other CPU2 300 to CPU4 306 as required. The control and data signals supplied to the master CPU1 300 from the control panel 200 may thus be stored in the associated random-access memory 310 and may be processed in accordance with the data and program stored in the read-only memory 308. On the other hand, the second CPU2 302 is in control of the charge eraser unit 98 as well as the image reproducing system 26, paper feed mechanism 28 and image-fixing and sheet discharge system 30. The second CPU2 302 is thus responsive to the control and data signals supplied from the edited copy mode control section 226 of the control panel 200 to control the selective activation of the light emitter elements 252 of the charge eraser unit 98. For this purpose, the second CPU2 302 is further connected to an eraser control circuit 312 to control the charge eraser unit 98 and a random-access memory 314 storing the data and program to dictate the selective activation of the light emitter elements 252 of the charge eraser unit 98. Furthermore, the third CPU3 304 is predominant over the operation of the optical scanning system 24, while the fourth CPU4 306 may be used to control the duplex and synthetic copying modes of operation of the apparatus having such capabilities.

Figure 9:
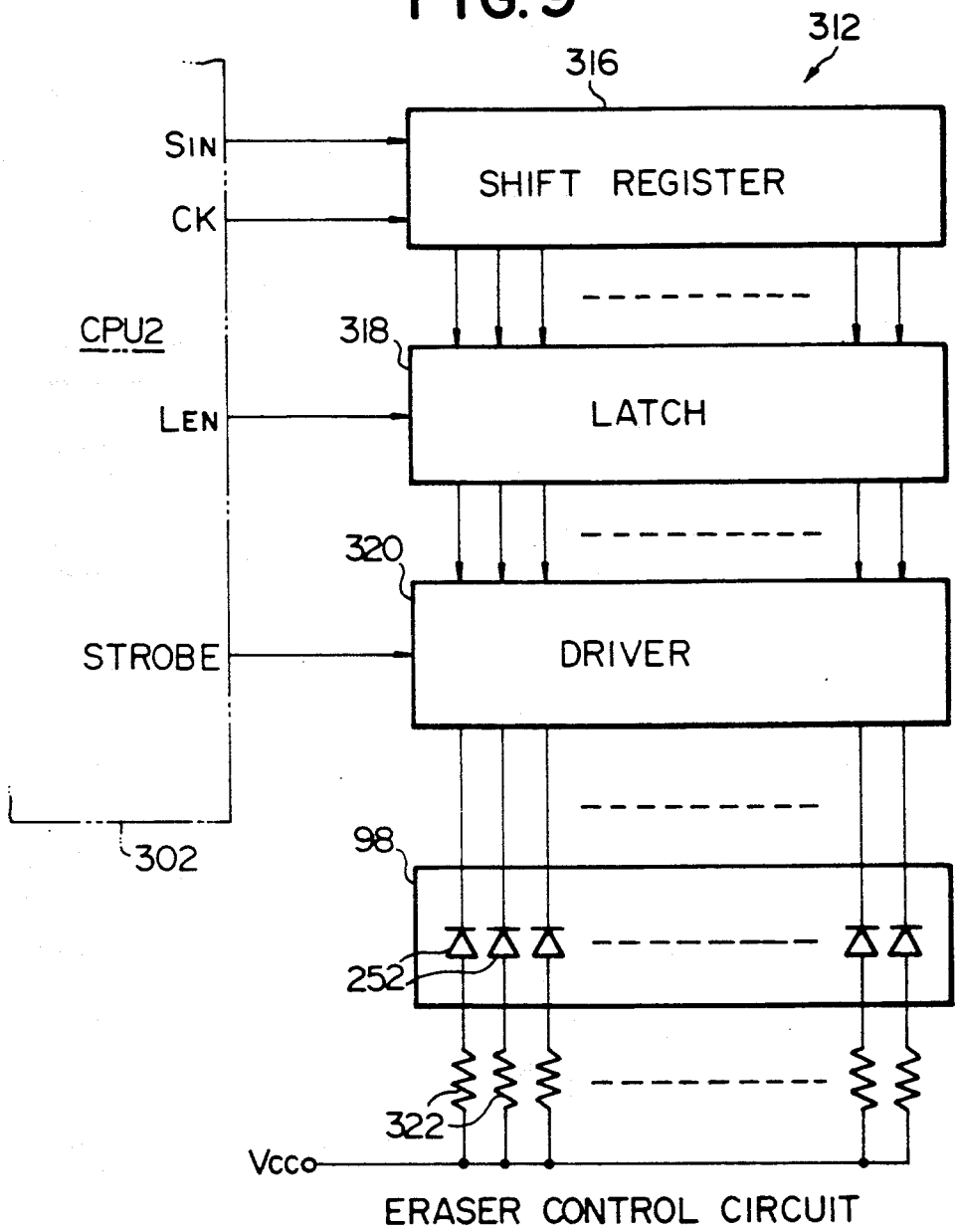
FIG. 9 is a diagram schematically showing an example of the configuration of an eraser control circuit for the eraser unit incorporated in the image duplicating apparatus embodying the present invention.

FIG. 9 shows an example of the general configuration of the control circuit 312 for the charge eraser unit 98 incorporated in the apparatus embodying the present invention. The control circuit 312 comprises a shift register 316 responsive to the data signals $S_{IN}$ and clock pulses CK supplied from the second CPU2. The data signals $S_{IN}$ are supplied from the CPU2 in the form of a serial bit sequence, which is converted into parallel bit information by means of the shift register 316. The data thus expressed in the form of parallel bit information is stored into a latch circuit 318 enabled by a latch enable signal ($L_{EN}$) received from the second CPU2. A driver circuit 320 composed of a number of parallel switch elements (not shown) is responsive to the logic "1" and "0" bits of information thus output from the latch circuit 318. The individual switch elements of the driver circuit 320 are connected to the light emitting diodes respectively implementing the light emitter elements 252 of the charge eraser unit 98. The driver circuit 320 is enabled by strobe signals from the CPU2 for selectively activating the light emitter elements 252 in accordance with the logic "1" and "0" bits of information output from the latch circuit 318. The light emitting diodes implementing the light emitter elements 252 are connected to a supply voltage source $V_{CC}$ respectively through current limiting resistors 322 as shown. The data to be fed from the CPU2 to the shift register 316 are formulated on the basis of the size the document to be duplicated, the specified coordinates defining the desired edited copy/erase area R, the selected mode of copying mode, and the selected color or colors in which the copy images are to be printed. Such data are output from the CPU2 at timings controlled by various internal timers of the CPU2 and flags indicative of various states or events which may occur in the apparatus as will be described in more detail.

Before entering into detailed description regarding the various phases and aspects of operation of the copying apparatus embodying the present invention, some principles of control over the edited copying modes of operation to be performed in the apparatus will be described briefly.

Figure 10A:
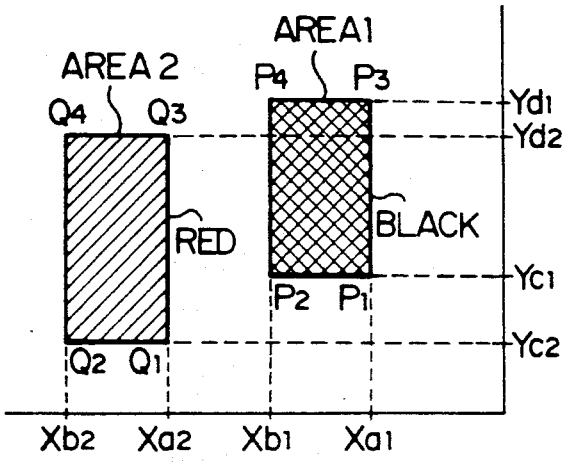
FIG. 10A is a diagram showing an example of the arrangement in which two separate copy/erase areas are specified for edited mode of copying operation on the xy-coordinate system of the display screen in the edited copy mode control section illustrated in FIG. 6.

FIG. 10A shows an example of the arrangement in which two separate edited copy/erase areas consisting of areas 1 and 2 are specified of edited mode of copying operation on the xy-coordinate system of the display screen 234 in the edited copy mode control section 226 illustrated in FIG. 6. One edited copy/erase area 1 is defined by four coordinate points $P_1$(Xal, Ycl), $P_2$(Xal, Ydl), $P_3$(Xbl, Ycl) and $P_4$ (Xbl, Ydl) and the other edited copy/erase area 2 is defined by four coordinate points $Q_1$(Xa2, Yc2), $Q_2$(Xa2, Yd2), $Q_3$(Xb2, Yc2) and $Q_4$(Xb2, Yd2). To enter the numerical data defining these copy/erase areas 1 and 2, the edited copy mode switch 230 is first depressed and then the copy/erase area 1 is defined with the x- and y-coordinates Xal, Xbl, Ycl and Ydl specified with use of the zoom switches 224 and display window 206 and entered with the edited copy mode select switch 230 depressed. Thereupon, the area black switch 246 or the area color switch 248 is depressed to request that the area 1 be printed in black or red or the area erase switch 250 is depressed to request that the area 1 be blanked out. After the data for the edited mode of copying operation for the copy/erase area 1 have thus been entered, a similar manipulative procedure is followed for the copy/erase area 2 to enter the x- and y-coordinates Xa2, Xb2, Yc2 and Yd2 and request that the area 2 be printed in black or red or otherwise blanked out. For the outside area surrounding the areas 1 and 2, only the area black switch 246 or the area color switch 248 may be depressed to request that the outside area be printed in black or red or the area erase switch 250 is depressed to request that the area be blanked out. Where it is desired that a single edited copy/erase area be specified on a copying sheet, the area cancel switch 244 may be depressed to inform that there is no data to be entered for the unnecessary copy/erase area which may be the area 1 or the area 2.

Figure 10B:
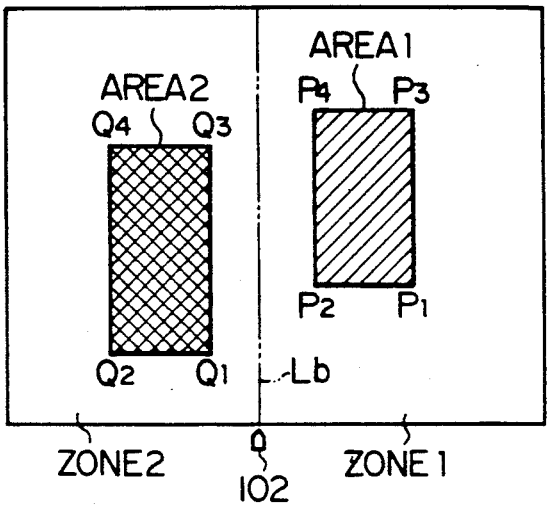
FIG. 10B is a diagram showing the images reproduced on a copying sheet in the single-cycle two-colored mode mode of copying operation from the edited copy/erase areas specified as shown in FIG. 10A.

After all the data for the desired edited copy/erase areas 1 and 2 specified as shown in FIG. 10A are entered, the print start switch ma be depressed. The images within one edited copy/erase area 1 are now printed in black on one face of a copying sheet supplied from one of the paper supply cassettes 70*a* and 70*b* and the copy sheet thus bearing the images in the area 1 thereof is passed through the duplex/composite copy paper feed system 94 for another cycle of edited mode of copying operation. The images within the other edited copy/ erase area 2 are thus printed in, for example, red on the same face of the copying sheet whereupon the copy sheet bearing the images in the areas 1 and 2 thereof is withdrawn to the discharge tray 92. FIG. 10B shows the images thus reproduced on a copy sheet by the two-cycle two-colored edited mode of copying operation performed in this manner.

A similar duplicate copy can be produced in a single-cycle two-colored mode of copying operation selected from the single-cycle two-colored mode select switch 222. In this instance, the slide member 102 of the color shift device 100 (FIG. 1) is moved to a position such that the desired edited copy/erase areas 1 and 2 are located within the differently colored zones 1 and 2, respectively, sectioned by the boundary (indicated by a dots-and-dash line) defined by the slide member 102 as shown. Thus, a single-cycle two-colored mode of copying operation can be selected in addition to an edited mode of copying operation. If the colors designated for the edited mode of copying operation are different from those designated for the single-cycle two-colored mode of operation, designation of the former colors is disregarded and the latter colors are in effect selected preferentially over the former. The images within the areas 1 and 2 are to be respectively printed in the colors selected for the single-cycle two-colored mode of operation.

Figure 11A:
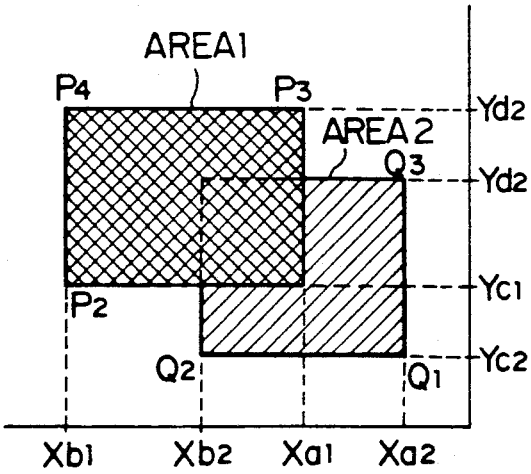
FIG. 11A is a diagram showing an example of the arrangement in which two partly overlapped copy/erase areas are specified for edited mode of copying operation on the xy-coordinate system of the display screen in the edited copy mode control section illustrated in FIG. 6.
Figure 11B:
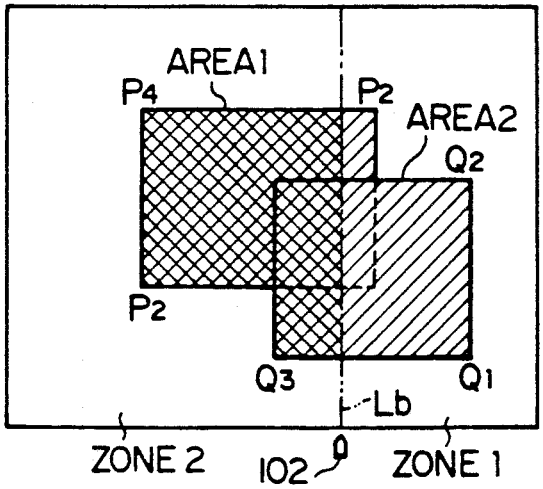
FIG. 11B/is a diagram showing the images reproduced on a copying sheet in the single-cycle two-colored mode of copying operation from the edited copy/erase areas specified as shown in FIG. 11A.

FIG. 11A shows an example of the arrangement in which two partly overlapped edited copy/erase areas consisting of areas 1 and 2 are specified for edited mode of copying operation. The x- and y-coordinates Xal, Xbl, Ycl and Ydl defining the area 1 and the x- and y-coordinates Xa2, Xb2, Yc2 and Yd2 defining the area 2 are entered and the colors for the areas 1 and 2 designated in manners similarly to those described with reference to FIG. 10A. FIG. 11B shows the images thus reproduced on a copy sheet by a single-cycle two-colored mode of copying operation selected in addition to an edited mode of copying operation. In this instance, the slide member 102 of the color shift device 100 is moved to a position such that the boundary between the differently colored zones 1 and 2 defined by the slide member 102 is located to intersect the overlapped portions of the edited copy/erase areas 1 and 2. Thus, those portions of the copy/erase areas 1 and 2 which are located in the colored zone 1 are printed in one color such as black and those portions of the areas 1 and 2 which are located in the colored zone 2 are printed in another color such as red. If the edited copy/erase areas 1 and 2 specified as shown in FIG. 11A are to be reproduced in an edited mode of copying operation without selecting a single-cycle two-colored mode of copying operation, then the images within the copy/erase area 1 are printed in one color such as black throughout the extent of the area 1 and the images within the portion of the copy/erase area 2 outside the area I are printed in another color such as red.

Figure 12:
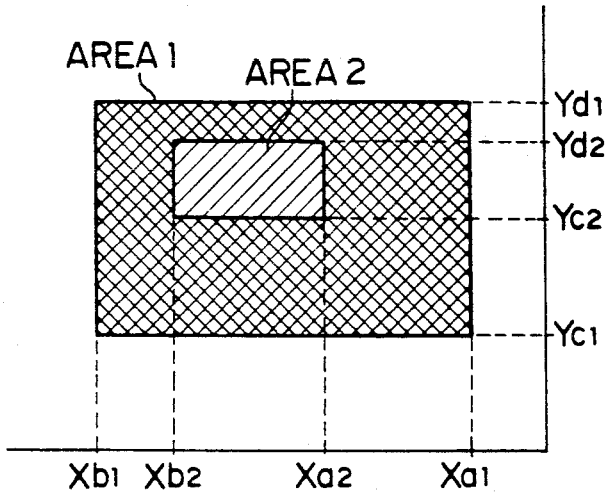
FIG. 12 is a diagram showing an example of the arrangement in which two edited copy/erase areas consisting of one area totally overlapped with the other are specified for edited mode of copying operation on the xy-coordinate system of the display screen in the edited copy mode control section illustrated in FIG. 6.

FIG. 12 shows an example of the arrangement in which two edited copy/erase areas 1 and 2 consisting of one area 2 totally contained within the other area 1 are specified for edited mode of copying operation. In this instance, that portion of the copy/erase area 1 which surrounds the copy/erase area 2 is to be printed in one color such as black and the copy/erase area 2 to be printed in another color such as red.

Figure 13:
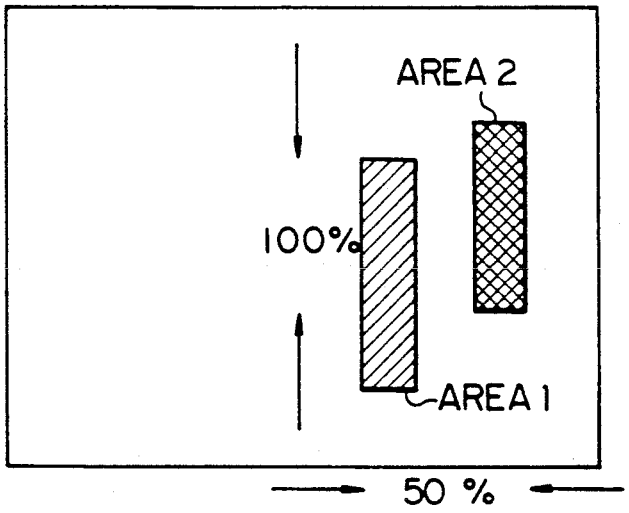
FIG. 13 is a diagram showing the images reproduced on a copying sheet in an edited mode of copying operation using anamorphic magnification from the edited copy/erase areas specified as shown in FIG. 11A.

FIG. 13 is a diagram showing the images reproduced on a copying sheet in an anamorphic edited mode of copying operation from the edited copy/erase areas specified as shown in FIG. 11A. In this example, magnification ratios of 50% and 100% are assumed to be selected for x-axis and y-axis, respectively, from the anamophoscopic magnification control section 228 of the control panel 200.

FIGS. 14A and 14B show the main routine program to be executed by the first or master CPUl 300. The routine program starts with the copying apparatus switched in and initializes the master CPUl 300 at a step AA01 so that all the copying conditions and modes of operation to be controlled by means of the CPUl 300 are selected in accordance with prescribed "default" rules. An internal timer of the system is then initiated at a step AA02 to count the time interval predetermined for a single complete iteration through the routine program.

The master CPUl 300 may then execute a communication data updating subroutine program AA03 by which the data received by the CPUl 300 is transferred to an internal memory unit incorporated within the CPUl and the data thus processed in the internal memory unit is transferred to the random access memory 310 for transmission to the other or slave CPU2 302, CPU3 304 and CPU4 306. The subroutine program AA03 may be followed by a decision subroutine program AA04 to monitor various operational conditions of the copying apparatus to determine whether or not a succession of process steps are to be followed subsequently by the CPUl 300. The master CPUl 300 may thereafter all the timers predominant over the timings at which various mechanical units and components of the apparatus are to operate during a single main routine period are started by a subroutine program AA05. The master CPUl 300 then executes various steps to process the instruction signals supplied from any of the switches on the control panel 200 as by a subroutine program AA06 and the data signals also supplied from the control panel 200 as by a subroutine program AA07 while generating instructions to update the numerical data to be displayed on the display window 206 of the control panel 200 as by a subroutine program AA08. In case any failure or trouble is detected by any of the slave CPU2 302, CPU3 304 and CPU4 306, the master CPUl 300 executes appropriate steps by a subroutine program AA09 to locate, remedy and/or display the failure or trouble involved. The master CPUl 300 may further execute an inter-CPU communication subroutine program AA10 for communicating with the slave CPU2 302, CPU3 304 and CPU4 306. Upon lapse of the predetermined time interval as detected at a step AA11 after the internal timer of the system has been initiated at the step AA02, the system reverts to the step AA02 and recycles the subroutine programs AA03 to AA10.

When there is a request for interrupt from the master CPU1 300 to any of the slave CPU2 302, CPU3 304 and CPU4 306, the former communicates with the latter as schematically shown in FIG. 14B.

Description will be hereinafter made with reference to FIGS. 15A and 15B to 47 in regard to the various subroutine programs thus included in the main routine program to be executed by the master COU1 300.

FIGS. 15A and 15B show the main routine program to be executed by the second CPU2 302 responsive to the control and data signals from the edited copy mode control section 226 of the control panel 200 to control the selective activation of the light emitter elements 252 of the charge eraser unit 98. The routine program starts with a step AB01 to initialize the CPU2 302 so that all the copying conditions and modes of operation to be controlled by means of the CPU2 302 are also selected in accordance with prescribed "default" rules. An internal timer of the system is then initiated at a step AB02 to count the time interval predetermined for a single complete iteration through the routine program.

The second CPU2 302 may then execute a communication input updating subroutine program AB03 by which the data received by the CPU2 302 is transferred to an internal memory unit incorporated within the CPU2 302 and a communication output updating subroutine program AB04 by which the data thus processed in the internal memory unit is transferred via the master CPUl 300 to the random access memory 310 for transmission to the other slave CPU3 304 and CPU4 306. The subroutine program AB04 may be followed by a decision subroutine program AB05 to check into the data thus exchanged between the second CPU2 302 and any of the other CPUl 300, CPU3 304 and CPU4 306. The second CPU2 302 may thereafter execute another decision subroutine program AB06 to monitor some operational conditions of the copying apparatus to determine whether or not a succession of process steps are to be followed subsequently by the CPU2 302. Subsequently, instructions may be issued from the CPU2 302 by a subroutine program AB07 to control the image developing stage 58 of the apparatus in accordance with the instruction and data signals received from the control panel 200 directly or through the master CPUl 300. The details of this subroutine program AB07 will be described with reference to FIG. 30. The second CPU2 302 then proceeds to an edited mode control subroutine program AB08 to execute various steps for the control of an edited mode of copying operation in accordance with the instruction and data signals supplied from the edited copy mode control section 226 of the control panel 200. The details of this subroutine program AB08 will be described with reference to FIG. 16.

The CPU2 302 further executes a process control subroutine program AB09 to control the optical scanning system 24, image reproducing system 26 and paper feed mechanism 28 and other strategic units of the copying apparatus and a process control subroutine program AB10 to process the signals supplied from, for example, various sensors and detectors including the sensors 108*a* and 108*b* associated with the developing units 58*a* and 58*b* and sensors associated with the paper supply cassettes 70*a* and 70*b* installed on the apparatus. Upon lapse of the predetermined time interval as detected at a step AB11 after the internal timer of the system has been initiated at the step AB02, the system reverts to the step AB02 and recycles the subroutine programs AB03 to AB10. When there is a request for interrupt from the second CPU2 302 to the master CPUl 300, the former communicates with the latter as schematically shown in FIG. 15B.

Description will now be made in regard to the details of the subroutine programs AB08 thus included in the main routine program of the second CPU2 302.

Figure 16:
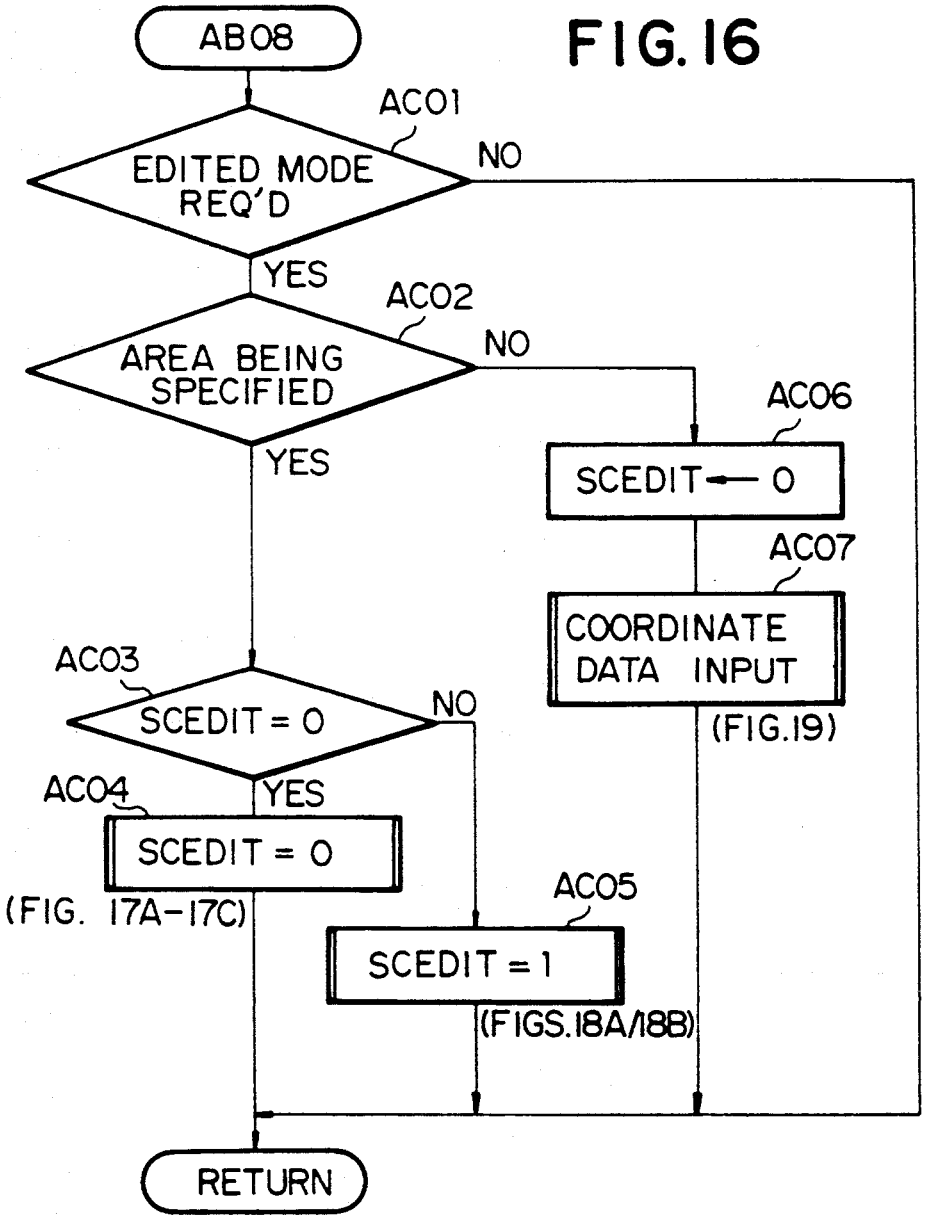
FIG. 16 is a flowchart showing an edited mode control subroutine program included in the main routine program illustrated in FIGS. 15A and 15B.

Referring to FIG. 16, the edited mode control subroutine program AC03 starts with a decision step AC01 to determine on the basis of the data received from the master CPU 300 whether or not an edited copy mode of operation is currently requested from the control panel 200. If it is determined that there currently is a request for an edited copy mode of operation, the system proceeds to another decision step AC02 to confirm whether or not an edited copy/erase area is being created on the control panel 200. If the answer for this step AC02 is given in the affirmative, it is further queried at a step AC03 whether or not a status code SCEDIT currently has a logic "1" bit or logic "0" bit. If it is found that that the current status code SCEDIT is of a logic "0" bit, the step AC03 is followed by a subroutine program AC04 and if, conversely, it is found at the step AC03 that the status code SCEDIT currently present is of a logic "0" bit, the step AC03 is followed by a subroutine program AC05. The details of the subroutine program AC04 will be hereinafter described with reference to FIGS. 17A to 17C and the details of the subroutine program AC05 described with reference to FIGS. 18A and 18B. If it is found that at the step AC02 that there currently is a request for an edited copy mode of operation, then the status code SCEDIT is shifted to a logic "0" bit as by a step AC06. The step AC06 is followed by a coordinate data input subroutine program AC07, the details of which will be later described with reference to FIG. 19.

Figure 17A:
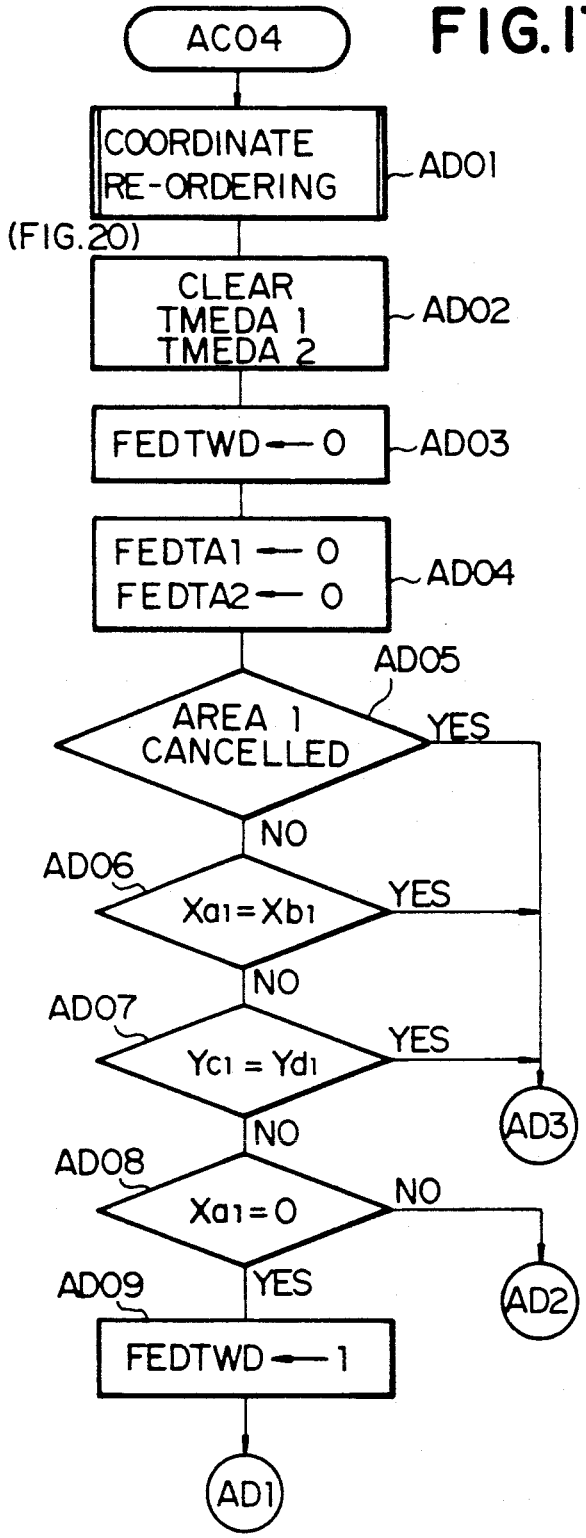
FIGS. 17A, 17B and 17C are flowcharts showing the details of a subroutine program to be executed when it is found that the status code used in the second microprocessor unit has a logic "0" bit state in the edited mode control subroutine program illustrated in FIG. 16.
Figure 17B:
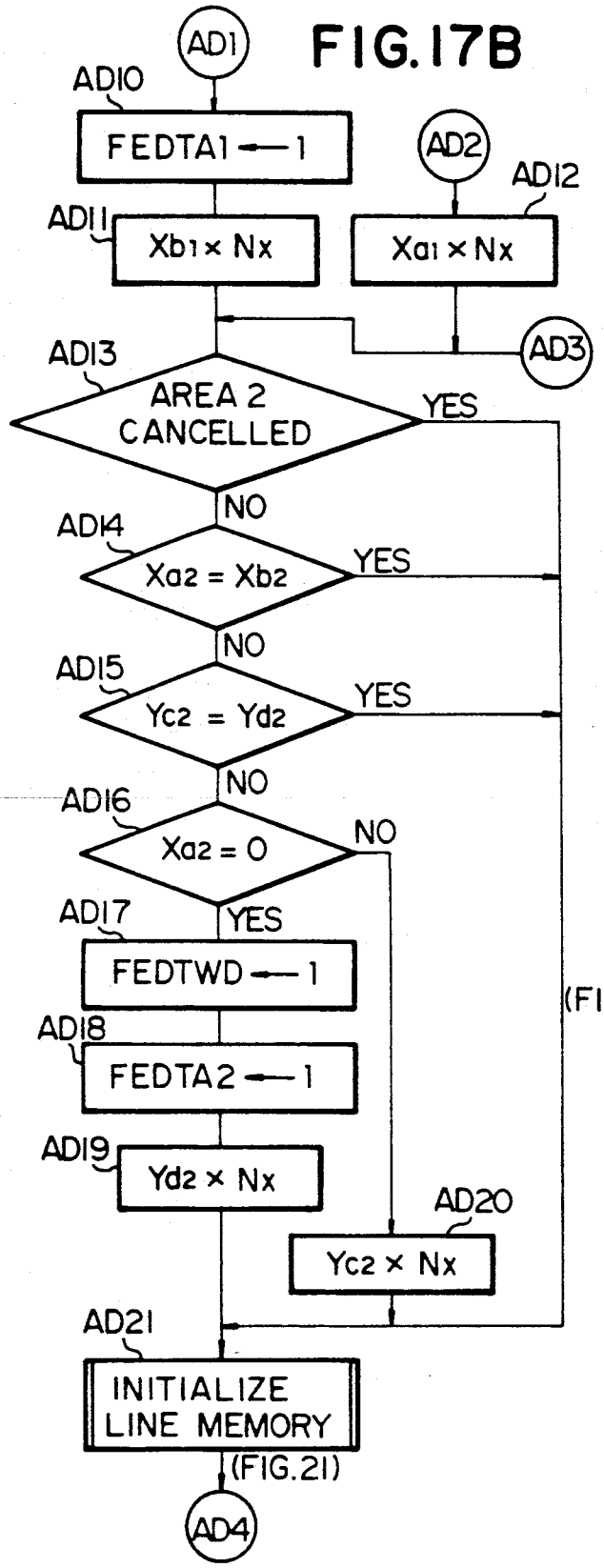
Figure 17C:
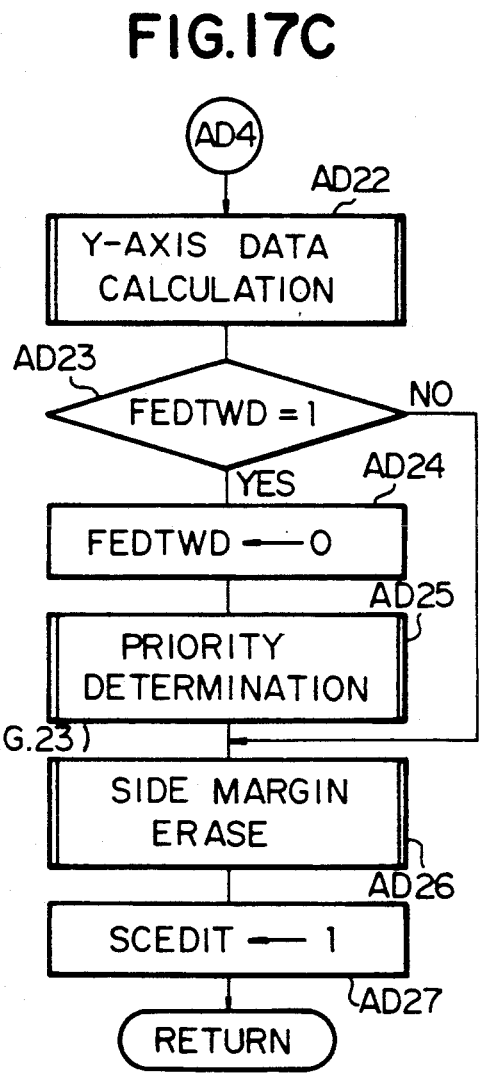

FIGS. 17A, 17B and 17C show the details of the subroutine program AC04 included in the edited mode control subroutine program AB08 hereinbefore described with reference to FIG. 16.

As shown in FIGS. 17A, the subroutine program AC04 starts in the presence of the status code SCEDIT of a logic "0" bit with a coordinate re-ordering subroutine program AD01 by which the two numerical values given by each of the x- and y-coordinate pairs defining each of the desired edited copy/erase areas 1 and 2 are re-ordered in accordance with a prescribed rule so that, for example, the coordinates of each pair are arranged in an increasing order. The details of such a coordinate reordering subroutine program AD01 will be later described with reference to FIG. 20.

Subsequently to the coordinate re-ordering subroutine program AD01, timers TMEDA1 and TMEDA2 predominant over the periods of time for the control of the edited mode of copying operation for the edited copy/erase areas 1 and 2, respectively, are cleared at a step AD02 and, thereafter, an instruction flag FEDTWD used for the activation of the charge eraser unit 98 is shifted to a logic "0" bit state at a step AD03. The instruction flag FEDTWD is, when shifted to a logic "1" bit state, effective to update the data for the selective activation of the light emitter elements 252 of the eraser unit 98. The step AD03 is followed by a step AD04 at which flags FEDTA1 and FEDTA2 respectively relating to the desired edited copy/ erase areas 1 and 2 are shifted each to a logic "0" bit state. These flags FEDTA1 and FEDTA2 are shifted each to a logic "1"

bit state when a sequence of control steps is in progress for an edited mode of copying operation for each of the copy/erase areas 1 and 2.

It is then queried at a step AD05 whether or not a request for the entry of data for the edited copy/erase area 1 has been cancelled through the area cancel switch 244 in the edited copy mode control section 226 of the control panel 200. If it is found that at this step AD05 that such a request has not been cancelled, it is questioned at a step AD06 whether or not the two x-coordinates $X_{a1}$ and $X_{b1}$ entered for the edited copy/erase area 1 are equal to each other. If the answer for this step AD06 is given in the negative, it is further questioned at a step AD07 whether or not the two y-coordinates $Y_{c1}$ and $Y_{d1}$ entered for the edited copy/erase area 1 are equal to each other. If the answer for this step AD07 is given also in the negative, it is tested at a step AD08 whether or not the x-coordinate $X_{a1}$ of the copy/erase area 1 is zero. If the answer for this step AD08 is given in the affirmative, the step AD08 is followed by a step AD09 by which the instruction flag FEDTWD is shifted to a logic "1" bit state. With the instruction flag FEDTWD thus shifted to a logic "1" bit state, the data for the selective activation of the light emitter elements 252 of the eraser unit 98 is updated.

The step AD09 is followed through a connector AD1 by a step AD10 in the flowchart shown in FIG. 17B and, if it is found at the step AD08 that the x-coordinate $X_{a1}$ of the copy/ erase area 1 is not zero, the step AD08 is followed through a connector AD2 by a step AD11 in the flowchart of FIG. 17B. If it is found that at the step AD05 that a request for the entry of data for the edited copy/erase area 1 has been cancelled or if it is found at the step AD06 that the two x-coordinates $X_{a1}$ and $X_{b1}$ are equal to each other or at the step AD07 that the two y-coordinates $Y_{c1}$ and $Y_{d1}$ are equal to each other, the subroutine program AC04 proceeds through a connector AD3 to a step AD13 in the flowchart of FIG. 17B.

At the step AD10 subsequent to the step AD09, the flag FEDTA1 relating to the copy/erase area 1 is shifted to a logic "1" bit state to indicate that a sequence of control steps is in progress for the copy/erase area 1. The step AD10 is followed by a step AD11 by which a time data representative of the x-coordinate $X_{b1}$ multiplied by the magnification ratio $N_X$ selected for the direction of x-axis is set on the timer TMEDA1 for the edited copy/erase area 1. On the other hand, when it is found at the step AD08 that the x-coordinate $X_{a1}$ of the copy/erase area 1 is not zero, the step AD08 is followed by a step AD12 by which a time data representative of the x-coordinate $X_{a1}$ multiplied by the magnification ratio $N_X$ selected for the direction of x-axis is set on the timer TMEDA1 for the edited copy/erase area 1. Subsequently to the step AD11 or AD12 or to any of the steps AD05, AD06 and AD07 through the connector AD3, it is questioned at a step AD13 whether or not a request for the entry of data for the edited copy/erase area 2 has been cancelled through the area cancel switch 244 in the edited copy mode control section 226. If it is found that at this step AD13 that such a request has not been cancelled, it is questioned at a step AD14 whether or not the two x-coordinates $X_{a2}$ and $X_{b2}$ entered for the edited copy/erase area 2 are equal to each other. If the answer for this step AD14 is given in the negative, it is further questioned at a step AD15 whether or not the two y-coordinates $Y_{c2}$ and $Y_{d2}$ entered for the edited copy/erase area 2 are equal to each other. If the answer for this step AD15 is given also in the negative, it is tested at a step AD16 whether or not the x-coordinate $X_{a2}$ of the copy/erase area 2 is zero. If the answer for this step AD16 is given in the affirmative, the step AD16 is followed by a step AD17 by which the instruction flag FEDTWD is shifted to a logic "1" bit state to update the data for the selective activation of the light emitter elements 252 of the eraser unit 98. The step AD17 is followed by a step AD18 by which the flag FEDTA2 relating to the copy/erase area 2 is shifted to a logic "1" bit state to indicate that a sequence of control steps is in progress for the copy/erase area 2. The step AD18 is followed by a step AD19 by which a time data representative of the x-coordinate $X_{b2}$ multiplied by the magnification ratio $N_X$ selected for the direction of x-axis is set on the timer TMEDA2 for the edited copy/erase area 2. On the other hand, when it is found at the step AD16 that the x-coordinate $X_{a2}$ of the copy/erase area 2 is not zero, the step AD16 is followed by a step AD20 by which a time data representative of the x-coordinate $X_{a2}$ multiplied by the magnification ratio $N_X$ selected for the direction of x-axis is set on the timer TMEDA2 for the edited copy/erase area 2. Subsequently to the step AD19 or AD20 or if it is found at the step AD13 that a request for the entry of data for the edited copy/erase area 2 has been cancelled or at the step AD14 or AD15 that the x-coordinates $X_{a2}$ and $X_{b2}$ or the y-coordinates $Y_{c2}$ and $Y_{d2}$ are equal to each other, the subroutine program AC12 proceeds to an eraser control buffer line memory initialize subroutine program AD21 and through a connector AD4 to a y-axis data calculation subroutine program AD22 in the flowchart of FIG. 17C. The buffer line memory is provided to control the activation of the charge eraser unit 98, though not shown in the drawings. The details of the buffer line memory initialize subroutine program AD21 will be hereinafter described with reference to FIG. 21 and the details of the y-axis data calculation subroutine program AD22 described with reference to FIGS. 22A and 22B. It will be apparent that the steps AD11, AD12, AD19 and AD20 are followed to carry out an edited mode of copying operation using anamorphic magnification.

The y-axis data calculation subroutine program AD22 is followed by a decision step AD23 at which it is confirmed whether or not the instruction flag FEDTWD has a logic "1" bit state effective to update the data for the selective activation of the light emitter elements 252 of the eraser unit 98. If the answer for this step AD23 is given in the affirmative, the flag FEDTWD is shifted to a logic "0" bit state at a step AD24 to inhibit repetition of unnecessary procedures. The step AD24 is followed by a priority determination subroutine program AD25 to set up the data for the selective activation of the light emitter elements 252 of the charge eraser unit 98 upon judgement of the order of priority between the edited copy/erase areas 1 and 2. The details of the priority determination subroutine program AD25 will be hereinafter described with reference to FIG. 24. The step AD24 and subroutine program AD25 are skipped over if it is found at the step AD23 that the flag FEDTWD has a logic "0" bit state. Subsequently to the priority determination subroutine program AD25, a side margin erase procedure is taken as by a subroutine program AD26 on the basis of the selected magnification ratio or ratios and selected size of copying sheet. Upon completion of the execution of the subroutine program AD26, the status code SCEDIT is shifted to a logic "1" bit at a step AD27 and, thereupon, the subroutine program AC04 is recycled from the step AD01.

FIGS. 18A and 18B are flowcharts showing the details of the status code shift subroutine program AC05 included in the edited mode control subroutine program AB08 described with reference to FIG. 16.

As shown in FIG. 18A, the subroutine program AC05 starts in the presence of the status code SCEDIT of a logic "1" bit with a decision step AE01 at which it is questioned whether or not the time which may have been counted by the timer TMEDA1 predominant over the period of time for the control of the edited mode of copying operation for the edited copy/erase area 1 has lapsed. When the answer for this step AE01 is given in the affirmative, it is tested at a step AE02 whether or not the flag FEDTA1 relating to the edited copy/erase area 1 currently has a logic "0" bit state. If the flag FEDTA1 is found to have a logic "0" bit state, the flag FEDTA1 is shifted to a logic "1" state at a step AE03 and thereafter at a step AE04 the instruction flag FEDTWD is shifted to a logic "1" bit state to update the data for the selective activation of the light emitter elements 252 of the eraser unit 98. The step AE04 is followed by a step AE05 at which a time data representative of the difference between the x-coordinates $X_{a1}$ and $X_{b1}$ multiplied by the magnification ratio $N_X$ selected for the direction of x-axis is set on the timer TMEDA1 for the edited copy/erase area 1. On the other hand, when it is found at the step AE02 that the flag FEDTA1 relating to the copy/erase area 1 currently has a logic "1" bit state, the flag FEDTA1 is shifted to a logic "0" state at a step AE06 and thereafter at a step AE07 the instruction flag FEDTWD is shifted to a logic "1" bit state.

Subsequently to the step AE05 or AE07 or when it is found at the step AE01 that the timer TMEDA1 is in operation, it is questioned at a step AE08 whether or not the time which may have been counted by the timer TMEDA2 predominant over the period of time for the control of the edited mode of copying operation for the edited copy/erase area 2 has lapsed. When the answer for this step AE08 is given in the affirmative, it is tested at a step AE09 whether or not the flag FEDTA2 relating to the edited copy/erase area 2 currently has a logic "0" bit state. If the flag FEDTA2 is found to have a logic "0" bit state, the flag FEDTA2 is shifted to a logic "1" state at a step AE10 and thereafter at a step AE11 the instruction flag FEDTWD is shifted to a logic "1" bit state to update the data for the selective activation of the light emitter elements 252 of the eraser unit 98. The step AE11 is followed by a step AE12 at which a time data representative of the difference between the x-coordinates $X_{a2}$ and $X_{b2}$ multiplied by the magnification ratio $N_X$ selected for the direction of x-axis is set on the timer TMEDA2 for the edited copy/erase area 2. On the other hand, when it is found at the step AE09 that the flag FEDTA2 relating to the copy/erase area 2 currently has a logic "1" bit state, the flag FEDTA2 is shifted to a logic "0" state at a step AE13 and thereafter at a step AE14 the instruction flag FEDTWD is shifted to a logic "1" bit state.

Subsequently to the step AE12 or AE14 or when it is found at the step AE08 that the timer TMEDA2 is in operation, the subroutine program AC05 jumps through a connector AE to a series of steps AE15 to AE19 in the flowchart of FIG. 18B. At a decision step AE15, it is confirmed whether or not the instruction flag FEDTWD has a logic "1" bit state effective to update the data for the selective activation of the light emitter elements 252 of the eraser unit 98. If the answer for this step AE15 is given in the affirmative, the flag FEDTWD is shifted to a logic "0" bit state at a step AE16 to inhibit repetition of unncessary procedures. The step AE16 is followed by an eraser control buffer line memory initialize subroutine program AE17 and further by a priority determination subroutine program AE18 to set up the data for the selective activation of the light emitter elements 252 of the charge eraser unit 98 upon judgement of the order of priority between the edited copy/erase areas 1 and 2. The details of the buffer line memory initialize subroutine program AE17 will be hereinafter described with reference to FIG. 21 and the details of the priority determination subroutine program AE18 described with reference to FIG. 24. Subsequently to the priority determination subroutine program AE18, a side margin erase procedure is taken as by a subroutine program AE19 on the basis of the selected magnification ratio or ratios and selected size of copying sheet. Upon completion of the execution of the subroutine program AE19, the subroutine program AC05 is recycled from the step AE01. The step AE16 and subroutine programs AE16, AE17, AE18 and AE19 are skipped over if it is found at the step AE15 that the flag FEDTWD has a logic "0" bit state.

Figure 19:
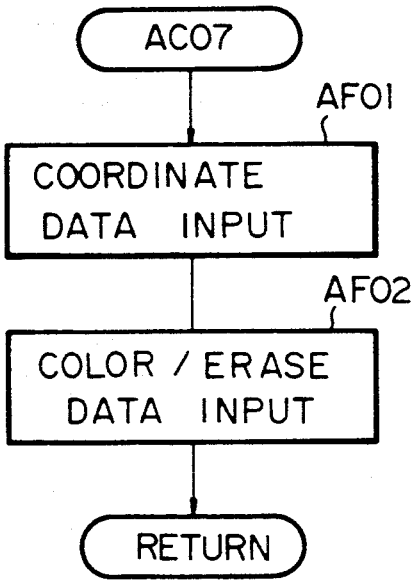
FIG. 19 is a flowchart showing the details of a coordinate data input subroutine program also included in the edited mode control subroutine program illustrated in FIG. 16.

FIG. 19 is a flowchart showing the details of the coordinate data input subroutine program AC07 also included in the edited mode control subroutine program AB08 described with reference to FIG. 16. The coordinate data input subroutine program AC07 starts with a step AF01 to input the numerical data representative of the x-coordinates $X_{a1}$ and $X_{b1}$ and y-coordinates $Y_{c1}$ and $Y_{d1}$ to defining the desired edited copy/erase area 1 and the x-coordinates $X_{a2}$ and $X_{b2}$ and y-coordinates $Y_{c2}$ and $Y_{d2}$ to defining the desired edited copy/erase area 2. Furthermore, the data indicative of the colors selected for the desired edited copy/erase areas 1 and 2 and the outside area and/or the data selecting the erasure of the images in any one or more of these areas are input at a subsequent step AF02.

Figure 20:
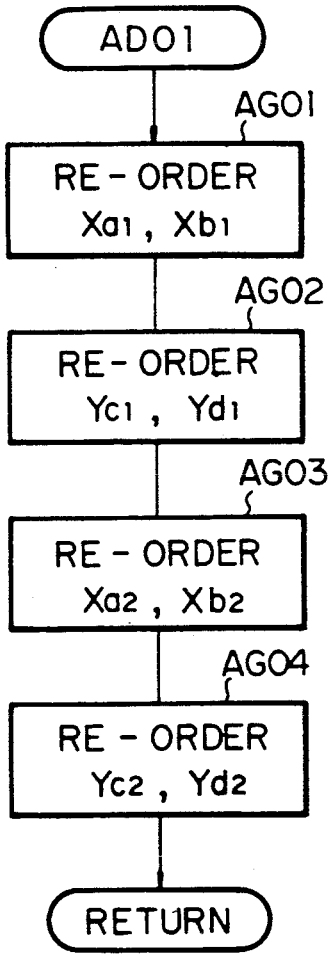
FIG. 20 is a flowchart showing the details of a coordinate re-ordering subroutine program included in the subroutine program illustrated in FIGS. 17A, 17B and 17C.

FIG. 20 is a flowchart showing the details of a coordinate re-ordering subroutine program AD01 included in the subroutine program AC04 described with reference to FIGS. 17A, 17B and 17C. By this coordinate re-ordering subroutine program AD01, comparison is first made between the two x-coordinates $X_{a1}$ and $X_{b1}$ for the desired edited copy/erase area 1 whereby the coordinates $X_{a1}$ and $X_{b1}$ are arranged in an increasing order at a step AG01. The step AG01 is followed by a step AG02 at which comparison is made between the two y-coordinates $Y_{c1}$ and $Y_{d1}$ for the copy/erase area 1 and the coordinates $Y_{c1}$ and $Y_{d1}$ are arranged in an increasing order at a step AG02. Subsequently to the step AG02, comparison is made between the two x-coordinates $X_{a2}$ and $X_{b2}$ for the desired edited copy/erase area 2 whereby the coordinates $X_{a2}$ and $X_{b2}$ are arranged in an increasing order at a step AG03. Comparison is thereafter made between the two y-coordinates $Y_{c2}$ and $Y_{d2}$ for the copy/erase area 2 and the coordinates $Y_{c2}$ and $Y_{d2}$ are arranged in an increasing order at a step AG04.

Figure 21:
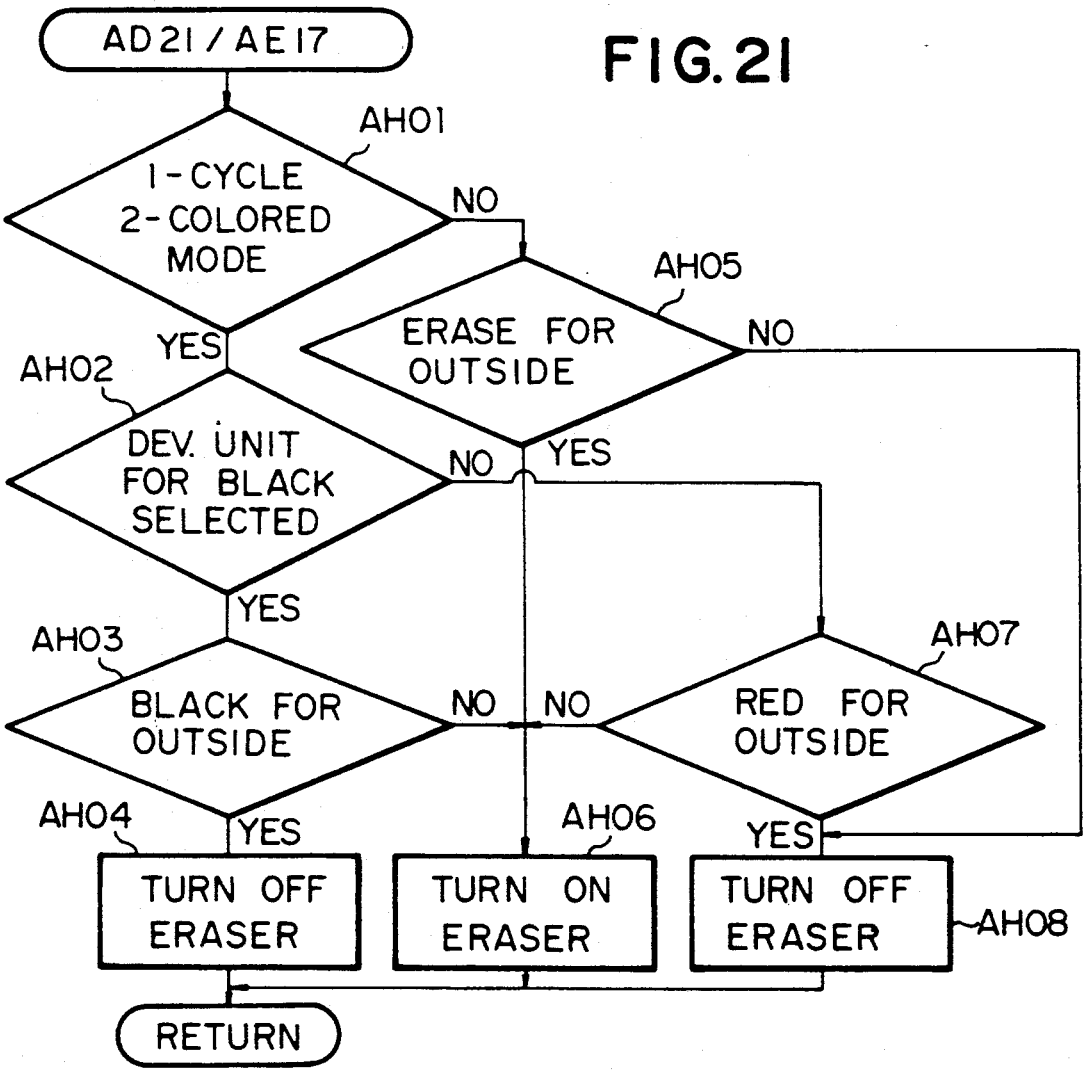
FIG. 21 is a flowchart showing the details of an eraser control line memory initialize subroutine program included in the subroutine program illustrated in FIGS. 17A, 17B and 17C or the subroutine program illustrated in FIGS. 18A and 18B.

FIG. 21 is a flowchart showing the details of an eraser control buffer line memory initialize subroutine program AD21 included in the subroutine program AC04 described with reference to FIGS. 17A, 17B and 17C or the subroutine program AC05 described with reference to FIGS. 18A and 18B. The eraser control buffer line memory initialize subroutine program AD21 starts with a decision step AH01 at which is questioned whether or not a single-cycle two-colored mode of copying operation is currently requested. If the answer for this step AH01 is given in the negative, it is further queried at a step AH02 whether or not the developing unit 58*b* assumed to be storing black-colored toner particles is selected for use in the current cycle of copying operation. If the answer for this step AH02 is given in the affirmative, then it is confirmed at a step AH03 whether or not the black print color is currently selected for the outside area surrounding the areas 1 and 2. If the answer for the step AH03 is also given in the affirmative, a control data is generated at a step AH04 to produce an instruction to turn off all the light emitter elements 252 of the charge eraser unit 98.

If it is found at the step AH01 that a single-cycle two-colored mode of copying operation is currently selected, it is further queried at a step AH05 whether or not it is requested to erase the images within the outside area. If the answer for this step AH05 is given in the affirmative, a control data is generated at a step AH06 to produce an instruction to turn on all the light emitter elements 252 of the charge eraser unit 98. On the other hand, if it is found at the step AH02 that the developing unit 58*b* is not selected for use in the current cycle of copying operation, then it is confirmed at a step AH07 whether or not the red print color is currently selected for the outside area surrounding the areas 1 and 2. If the answer for the step AH07 is given in the affirmative or if the answer for the step AH05 is given in the negative, a control data is generated at a step AH08 to produce an instruction to turn off all the light emitter elements 252 of the charge eraser unit 98. If the answer for the step AH03 or the step AH07 is given in the negative, the step AH06 is also followed to produce an instruction to turn on all the light emitter elements 252 of the charge eraser unit 98.

Figure 22A:
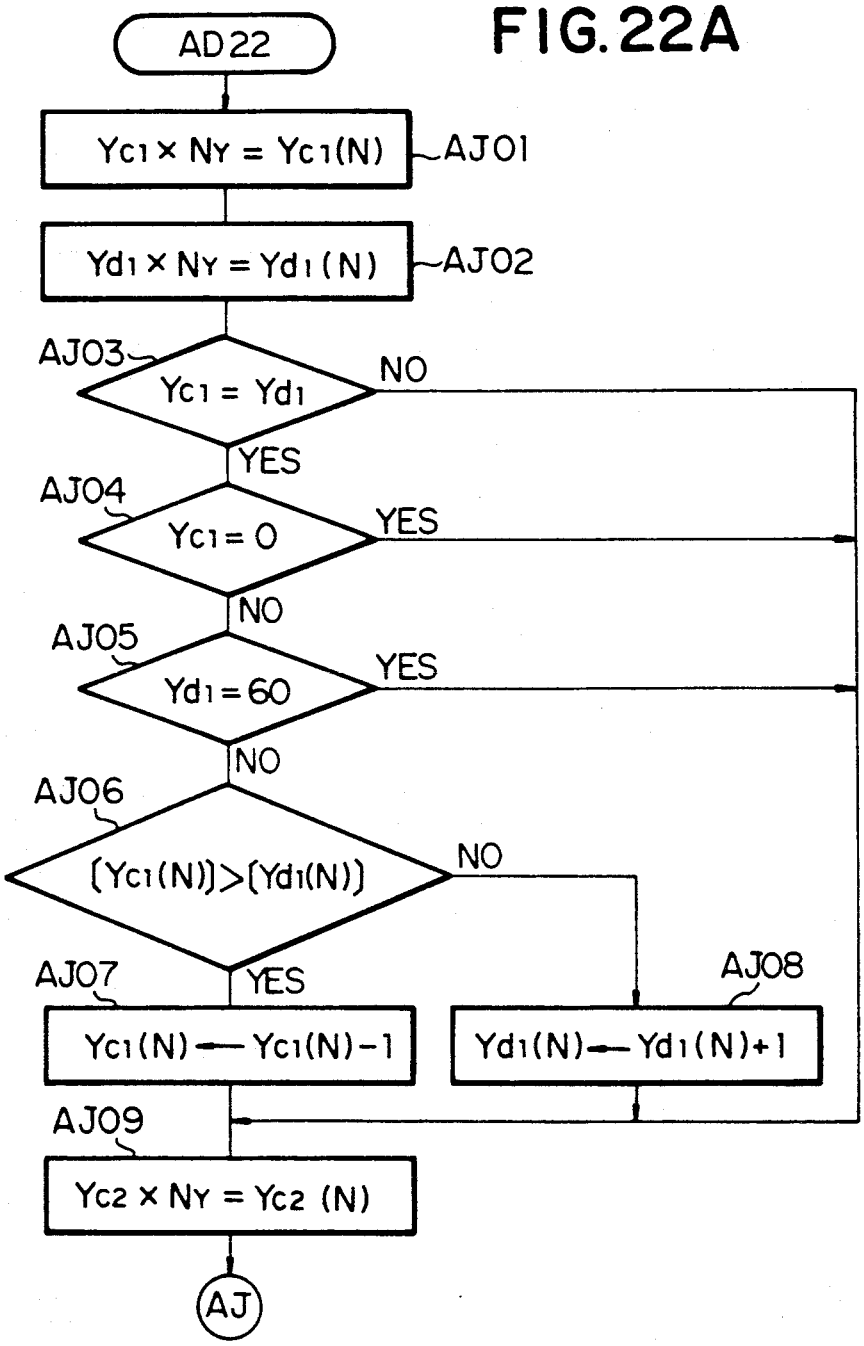
FIGS. 22A and 22B are flowcharts showing the details of a y-axis data calculation subroutine program further included in the subroutine program illustrated in FIGS. 17A, 17B and 17C.
Figure 22B:
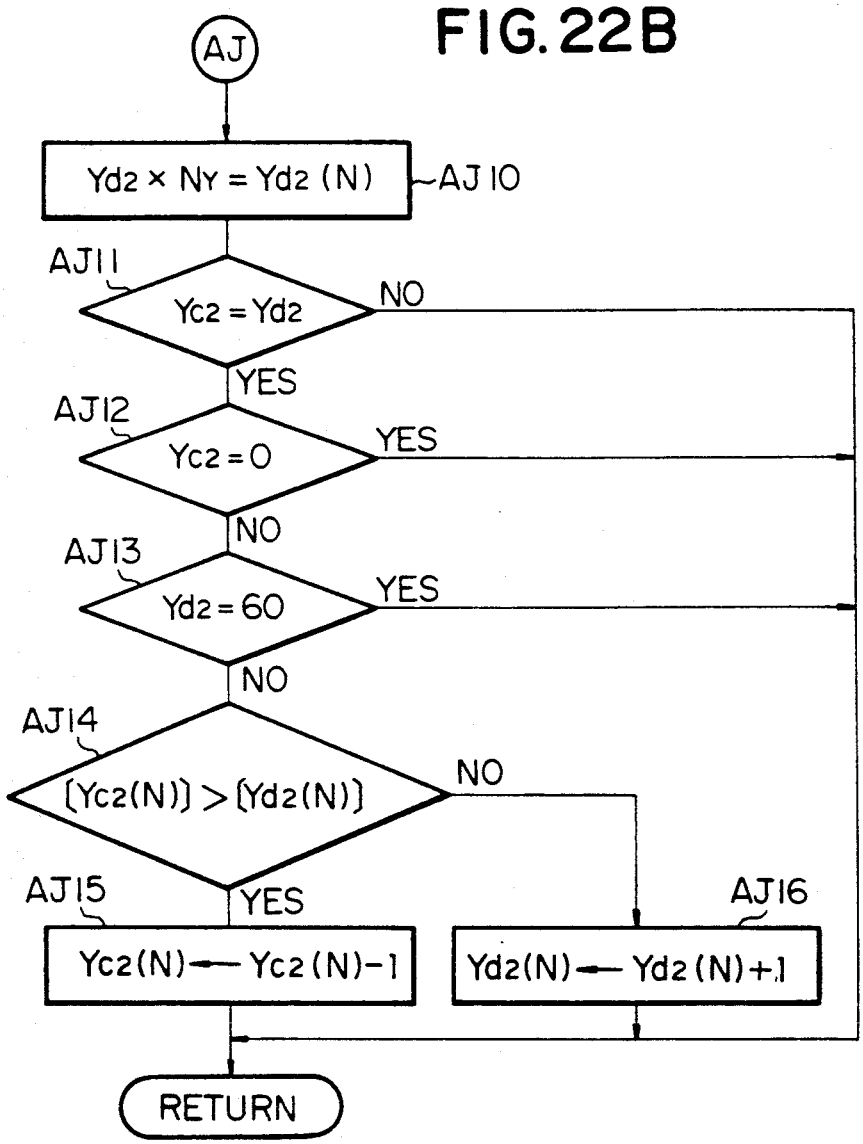

FIGS. 22A and 22B are flowcharts showing the details of the y-axis data calculation subroutine program AD22 included in the subroutine program AC04 described with reference to FIGS. 17A, 17B and 17C.

As noted previously, the charge eraser unit 98 used in the copying apparatus embodying the present invention is typically composed of sixty light emitter elements 252 each of an LED. The resolution to be achieved by the eraser unit 98 is dictated by the width of each of such light emitter elements 252 or, in other words, by the pitch distances at which the light emitter elements 252 are arranged in an array. If the width of the specified edited copy/erase area 1 or 2 in the direction of y-axis or the width of the area to be reproduced with a magnification ratio less than 1:1 is less than the width of the unit element 252 of the the eraser unit 98, it is necessary to secure at least a single light emitter element 252 for the reproduction of the area with such a width because the particular area might otherwise be extincted with all the light emitted elements 252 of the unit 98 activated. Consideration to avoid such an inconvenience is also paid in the y-axis data calculation subroutine program subroutine program AD22.

In the y-axis data calculation subroutine program AD22, a value $Y_{cl} \times N_y = Y_{dl}(N)$ representative of the y-coordinate $Y_{cl}$ multiplied by the magnification ratio $N_Y$ selected for the direction of y-axis is calculated at a step AJ01 and, likewise, a value $Y_{dl} \times N_Y = Y_{dl}(N)$ representative of the y-coordinate $Y_{dl}$ multiplied by the magnification ratio $N_Y$ is calculated at a step AJ02 as shown in FIG. 22A. It is then confirmed at a decision step AJ03 whether or not y-coordinate $Y_{cl}$ is equal to the y-coordinate $Y_{dl}$. If it is found that that the y-coordinates $Y_{cl}$ and $Y_{dl}$ are not equal to each other, it is tested at a step AJ04 whether or not the value of the smaller y-coordinate $Y_{cl}$ is zero. If it is found that this is not the case, it is further tested at a step AJ05 whether or not the value of the larger y-coordinate $Y_{dl}$ is 60 (which corresponds to the number of the light emitter elements 252 of the eraser unit 98). If it is also found that this is not the case, comparison is made at a step AJ06 between the value $Y_{cl}(N)$ with the fraction rounded up and the value $Y_{dl}(N)$ with the fraction rounded down. If it is found at this step AJ06 that the former is larger than the latter, the value $Y_{cl}(N)$ with the fraction rounded up is decremented by one at a step AJ07. If it is found at the step AJ06 that the value $Y_{cl}(N)$ with the fraction rounded up is equal to or less that the $Y_{dl}(N)$ with the fraction rounded down, the value $Y_{dl}(N)$ with the fraction rounded down is incremented by one at a step AJ08.

Subsequently to the step AJ07 or the step AJ08 or if the answer for any of the preceding steps AJ03, AJ04 and AJ05 is given in the affirmative, a value $Y_{c2} \times N_Y = Y_{c2}(N)$ representative of the y-coordinate $Y_{c2}$ multiplied by the magnification ratio $N_Y$ selected for the direction of y-axis is calculated at a step AJ09 and, likewise, a value $Y_{d2} \times N_Y = Y_{d2}(N)$ representative of the y-coordinate $Y_{d2}$ multiplied by the magnification ratio $N_Y$ is calculated at a step AJ10 shown in FIG. 22B. It is then confirmed at a decision step AJ11 whether or not y-coordinate $Y_{c2}$ is equal to the y-coordinate $Y_{d2}$. If it is found that that the y-coordinates $Y_{c2}$ and $Y_{d2}$ are not equal to each other, it is tested at a step AJ12 whether or not the value of the smaller y-coordinate $Y_{c2}$ is zero. If it is found that this is not the case, it is further tested at a step AJ13 whether or not the value of the larger y-coordinate $Y_{d2}$ is 60. If it is also found that this is not the case, comparison is made at a step AJ14 between the value $Y_{c2}(N)$ with the fraction rounded up and the value $Y_{d2}(N)$ with the fraction rounded down. If it is found at this step AJ14 that the former is larger than the latter, the value $Y_{c2}(N)$ with the fraction rounded up is decremented by one at a step AJ15. If it is found at the step AJ06 that the value $Y_{c2}(N)$ with the fraction rounded up is equal to or less that the value $Y_{d2}(N)$ with the fraction rounded down, the value $Y_{d2}(N)$ with the fraction rounded down is incremented by one at a step AJ16.

It will be apparent that the step AJ07 or AJ08 and the step AJ15 or AJ16 are intended to make a correction for the larger one of the number resulting from the y-coordinate $Y_{cl}$ or $Y_{c2}$ with the fraction rounded up and the number resulting from the y-coordinate $Y_{dl}$ or $Y_{d2}$ with the fraction rounded down. Such a correction results in elimination or reduction in any deviation between the specified edited copy/erase area 1 or 2 and the corresponding coverage of the light emitter elements 252 of the eraser unit 98.

Figure 23A:
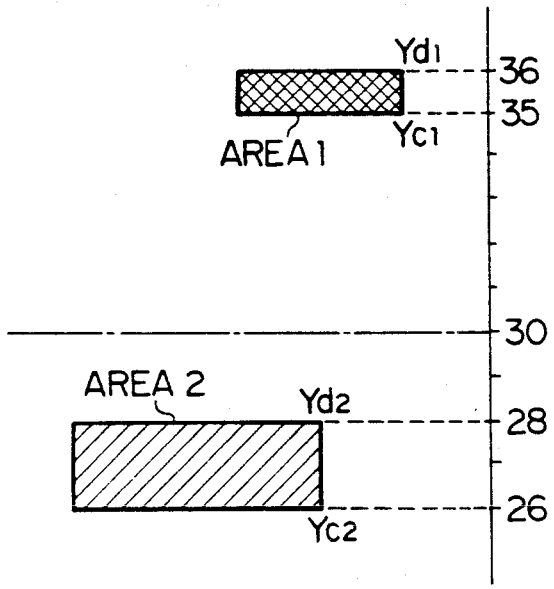
FIGS. 23A, 23B and 23C are diagrams showing some patterns of copy/erase areas which may be reproduced in an anamorphic mode of copying operation.
Figure 23B:
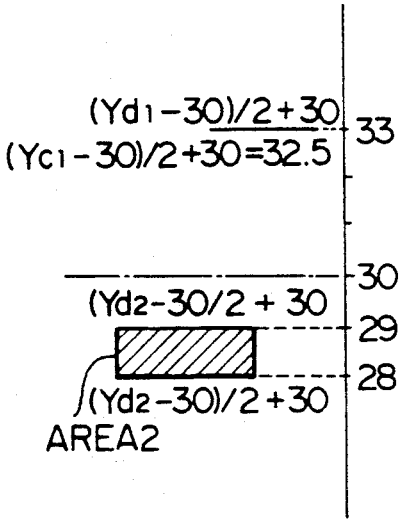
Figure 23C:
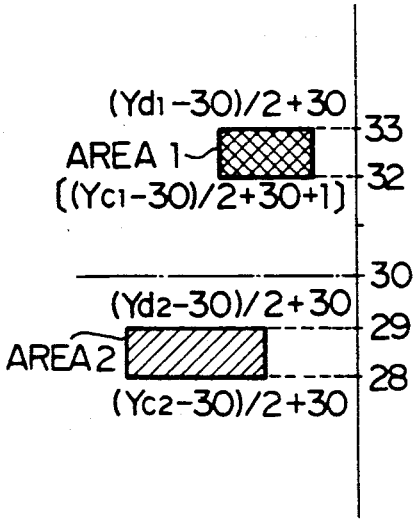

In each of FIGS. 23A, 23B and 23C are shown edited copy/ erase areas 1 and 2 to be reproduced in an anamorphic mode of copying operation with certain magnification ratios in the directions of x-axis and y-axis, wherein the vertical axis indicates the direction of y-axis of a copying sheet and thus corresponds to the direction in which the light emitter elements 252 of the charge eraser unit 98 are arranged in an array. The numerals shown along the vertical axis are graduations respectively representative of some of the light emitter elements 252 of the eraser unit 98 as counted from one end of the linear array of the elements 252. The light emitter element 252 indicated by the graduation 30 thus corresponds to the element located at the center point of the array. The copy/erase areas 1 and 2 shown in FIG. 23A are assumed to be reproduced with a magnification ratio of 1:1 selected for each of the directions of x-axis and y-axis. Thus, the copy/erase area 1 in FIG. 23A is assumed to be reproduced by turning off the light emitter elements 252 represented by those indicated by the graduations 35 and 35 and the copy/erase area 2 assumed to be reproduced by turning off the light emitter elements 252 represented by those indicated by graduations 26 to 28. If it is desired that such copy/erase areas 1 and 2 are to be reproduced with the magnification ratio selected at 50% for each of the directions of x-axis and y-axis, the value calculated for the y-coordinate $Y_{cl}$ by the step AJ01 of the subroutine program shown in FIG. 22A will be given as being representative of graduation 32.5 (=30+(35−30)/2) and the value calculated for the y-coordinate $Y_{dl}$ by the step AJ02 given as being representative of graduation 33 (=30+(36−30)/2). Similarly, the value calculated for the y-coordinate $Y_{c2}$ by the step AJ09 of the subroutine program shown in FIG. 22B will be given as being representative of graduation 28 (=30+(26−30)/2) and the value calculated for the y-coordinate $Y_{d2}$ by the step AJ10 given as being representative of graduation 29 (=30+(28−30)/2). Both of the graduations at the lower and upper limits of the range 32.5–33 for the copy/erase area 1 in the direction of y-axis as calculated for the desired 50% reduced copying are rounded as 33 as shown in FIG. 23B. This means that there is no light emitter element 252 to be turned off to reproduce the copy/erase area 1 to a 50% reduced scale and accordingly that the area 1 will be extincted on the resultant 50%-reduced duplicate. Such an inconvenience can however be avoided and thus an acceptable 50%-reduced duplicate can be obtained as shown in FIG. 23C as a result of the correction made at the step AJ07 or AJ08 and the step AJ15 or AJ16 of the subroutine program AD22 described with reference to FIGS. 22A and 22B.

Figure 24:
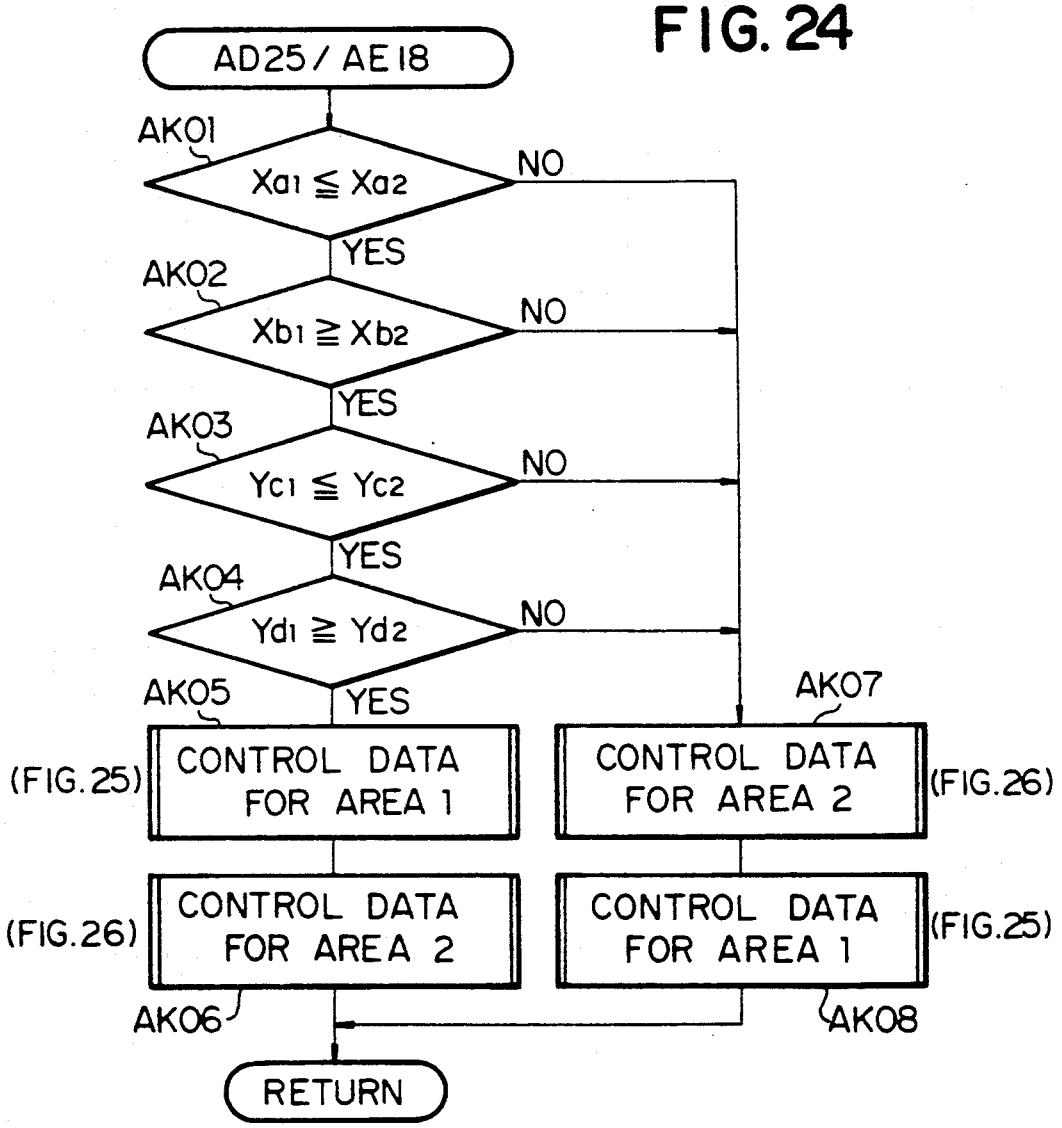
FIG. 24 is a flowchart showing the details of a priority determination subroutine program further included in the subroutine program illustrated in FIGS. 17A, 17B and 17C or the subroutine program illustrated in FIGS. 18A and 18B.

FIG. 24 is a flowchart showing the details of the priority determination subroutine program further included as the subroutine AD25 in the subroutine program described with reference to FIGS. 17A, 17B and 17C or as the subroutine AE18 the subroutine program described with reference to FIGS. 18A and 18B. This eraser activation data setting subroutine program AD25/AE18 is used to set up the data for the selective activation of the light emitter elements 252 of the charge eraser unit 98 upon judgement of the order of priority between the edited copy/erase areas 1 and 2. Such a subroutine program AD25/AE18 starts with a decision step AK01 to determine whether or not the x-coordinate $X_{al}$ for one copy/erase area 1 is equal to or less than the x-coordinate $X_{a2}$ for the other copy/erase area 2. If it is found that that the x-coordinate $X_{al}$ is equal to or less than the x-coordinate Xa2, it is further tested at a step AK02 to determine whether or not the x-coordinate $X_{b1}$ for one copy/erase area 1 is equal to or larger than the x-coordinate $X_{b2}$ for the other copy/erase area 2. If it is found that that the x-coordinate $X_{b1}$ is equal to or less than the x-coordinate $X_{b2}$, then it is tested at a step AK03 whether or not the y-coordinate $Y_{cl}$ for one copy/erase area 1 is equal to or less than the y-coordinate $Y_{c2}$ for the other copy/erase area 2. If it is found that that the x-coordinate $Y_{cl}$ is equal to or less than the x-coordinate $Y_{c2}$, it is further tested at a step AK04 to determine whether or not the y-coordinate $Y_{dl}$ for one copy/erase area 1 is equal to or larger than the y-coordinate $Y_{d2}$ for the other copy/erase area 2. If it is found that that the y-coordinate $Y_{dl}$ is equal to or less than the y-coordinate $Y_{d2}$, it is determined that the copy/erase area 2 is contained in its entirety within the copy/erase area 1. If the answer for any of the steps AK01 to AK04 is given in the negative, it is determined that the copy/erase area 2 has at least a portion located outside the copy/erase area 1.

When it is found at the step AK04 that the copy/erase area 2 is totally contained within the copy/erase area 1, control data are generated by one control data generating subroutine program AK05 for the selective activation of the light emitter elements 252 of the charge eraser unit 98 to reproduce the images within the copy/erase area 1 and, thereafter, control data are generated by another control data generating subroutine program AK06 for the selective activation of the light emitter elements 252 to reproduce the images within the copy/ erase area 2. If it is found at any of the steps AK01 to AK04 that the copy/erase area 2 has at least a portion located outside the copy/erase area 1, then control data are generated by a subroutine program AK07 for the selective activation of the light emitter elements 252 of the eraser unit 98 to reproduce the images within the copy/erase area 2 and, thereafter, control data are generated by a subroutine program AK08 for the selective activation of the light emitter elements 252 to reproduce the images within the copy/erase area 1.

Thus, copying conditions specified for the copy/erase area 1 are in principle accepted preferentially over those specified for the copy/erase area 2 except when the copy/erase area 2 is totally contained within the copy/erase area 1 the copy/erase area 2. For example, the copy/erase areas 1 and 2 may be specified to be partly overlapped by each other as shown in FIG. 11A, wherein the area 1 is assumed to be requested to be printed in black and the area 2 assumed to be requested ed to be printed in red with the images in the outside area requested to be totally erased. In this instance, the images within the area 1 including the portion overlapped by the area 2 will be all printed in black and the images within the portion of the area 2 outside the area 1 will be printed in red. If, however, the area 2 is specified to be totally contained within the area 1 as shown in FIG. 12, only that portion of the copy/erase area 1 which surrounds the copy/erase area 2 will be printed in black and the copy/erase area 2 will be printed in red.

The details of each of the control data generating subroutine programs AK05 and AK07 will be hereinafter described with reference to FIG. 25 and the details of each of the control data generating subroutine programs AK06 and AK08 described with reference to FIG. 26.

Figure 25:
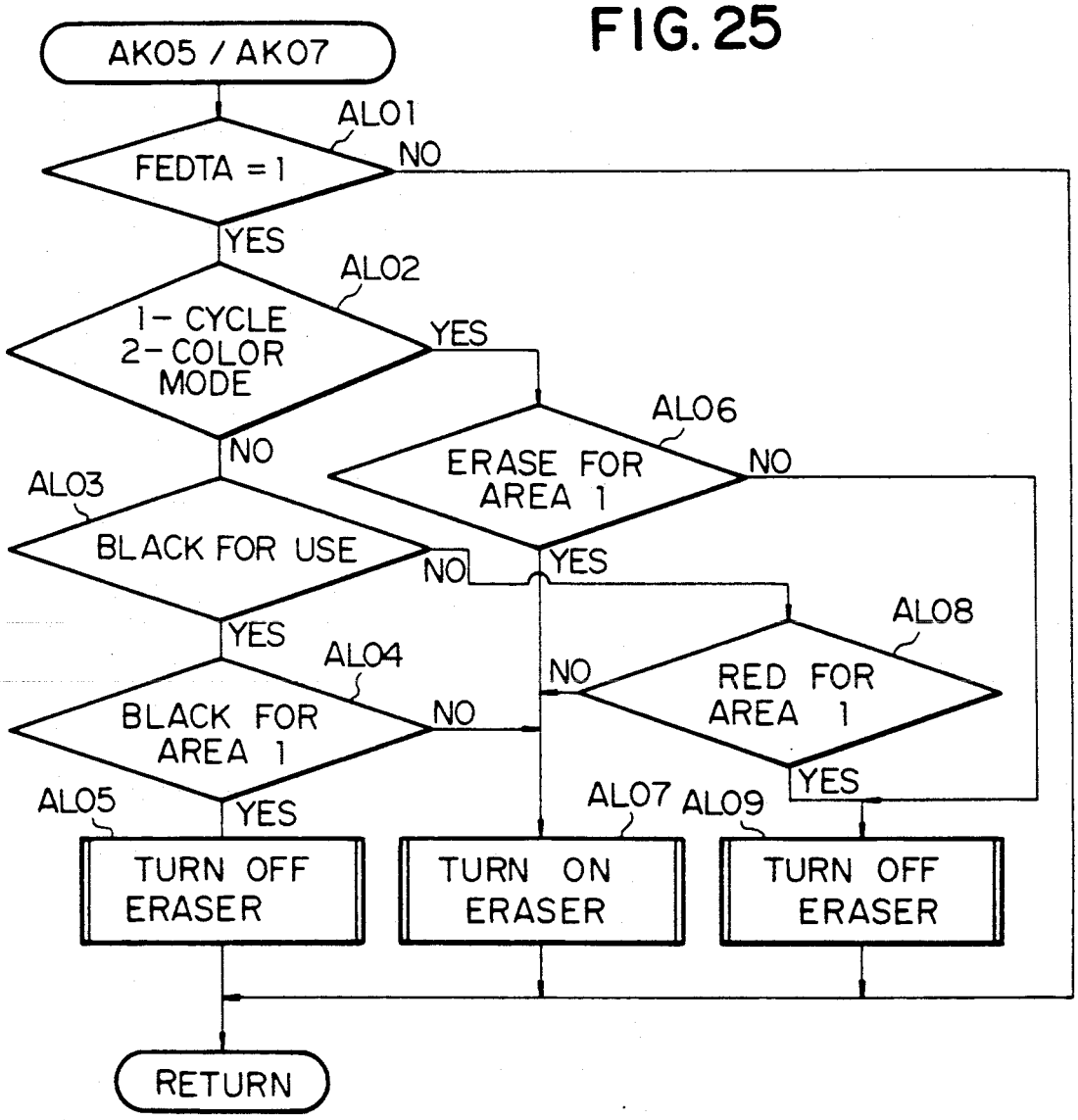
FIG. 25 is a flowchart showing the details of a control data generating subroutine program further included in the subroutine program illustrated in FIG. 24.

Referring to FIG. 25, each of the control data generating subroutine programs AK05 and AK07 included in the priority determination subroutine program AD25 starts with a decision step AL01 to confirm whether or not the instruction flag FEDTWD has a logic "1" bit state effective to update the data for the selective activation of the light emitter elements 252 of the eraser unit 98. If it is found that that the flag has a logic "1" bit state, it is tested at a subsequent step AL02 whether or not a single-cycle two-colored mode of copying operation is currently requested. If the answer for this step AL02 is given in the negative, it is further queried at a step AL03 whether or not the lower developing unit 58b assumed to be storing black-colored toner particles is selected for use in the current cycle of copying operation. If the answer for this step AL03 is given in the affirmative, then it is confirmed at a step AL04 whether or not the black print color is currently selected for the area 1. If the answer for the step AL04 is also given in the affirmative, a control data is generated by a subroutine program AL05 to produce an instruction to turn off all the light emitter elements 252 of the charge eraser unit 98.

If it is found at the step AL02 that a single-cycle two-colored mode of copying operation is currently selected, it is further queried at a step AL06 whether or not it is requested to erase the images within the area 1. If the answer for this step AL06 is given in the affirmative, a control data is generated by a subroutine program AL07 to produce an instruction to turn on all the light emitter elements 252 of the charge eraser unit 98. On the other hand, if it is found at the step AL03 the developing unit 58b is not selected for use in the current cycle of copying operation, then it is confirmed at a step AL08 whether or not the red print color is currently selected for the area 1. If the answer for the step AL08 is given in the affirmative or if the answer for the step AL06 is given in the negative, a data is prepared by a subroutine program AL09 to generate an instruction to turn off all the light emitter elements 252 of the charge eraser unit 98. If the answer for the step AL04 or the step AL08 is given in the negative, the subroutine program AL07 is also followed to produce an instruction to turn on all the light emitter elements 252 of the charge eraser unit 98.

Figure 26:
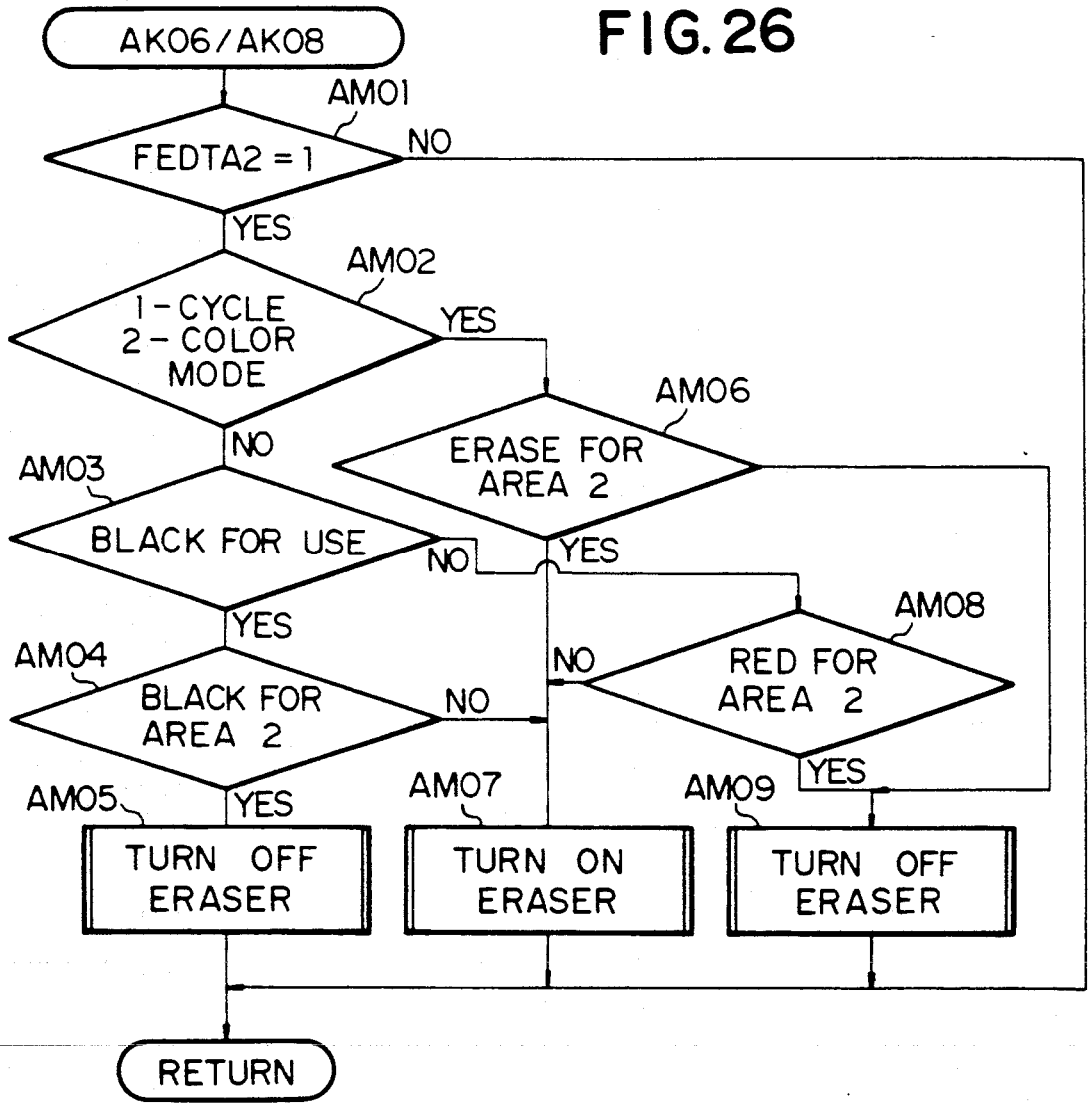
FIG. 26 is a flowchart showing the details of another control data generating subroutine program further included in the subroutine program illustrated in FIG. 24.

Turning to FIG. 26, each of the control data generating subroutine programs AK06 and AK08 included in the priority determination subroutine program AD25 comprises steps and subroutine programs AM01 to AM09. These steps and subroutine programs AM01 to AM09 are similar to those of the subroutine program AK05/AK07 described with reference to FIG. 25 and are used for controlling the activation of the charge eraser unit 98 in respect of the area 2.

Figure 27:
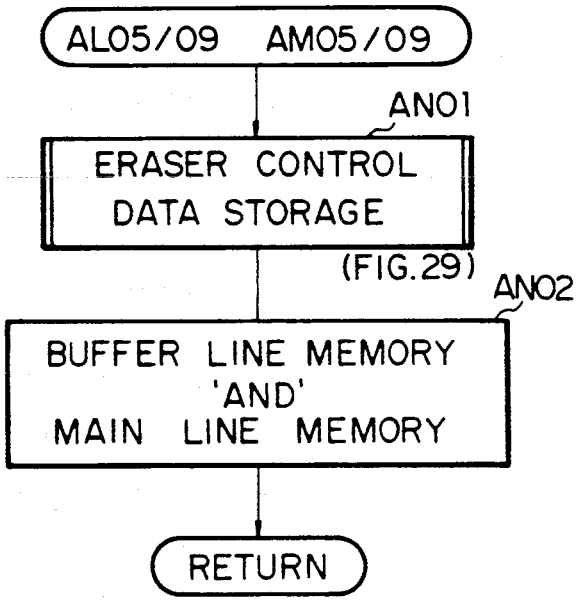
FIG. 27 is a flowchart showing the details of an eraser control subroutine program which corresponds to an eraser control subroutine program included in the control data generating subroutine program illustrated in each of FIGS. 25 and 26.

FIG. 27 is a flowchart showing the details of an eraser control subroutine program which corresponds to the eraser control subroutine program AL05 or AL09 included in the subroutine program AK05/AK07 described with reference to FIG. 25 and the eraser control subroutine program AM05 or AM09 included in the subroutine program AK06/AK08 described with reference to FIG. 26. The eraser control subroutine program AL05/AL09/AM05/ AM09 includes an eraser control data storage subroutine program AN01 for storing eraser control data into the buffer line memory provided to control the activation of the charge eraser unit 98. The eraser control data storage subroutine program AN01 is followed by a step AN02 at which a logic "AND" operation is performed to combine the data stored in the buffer line memory and the data stored in a main line memory (not shown). The details of the eraser control data storage subroutine program AN01 will be described with reference to FIG. 29.

Figure 28:
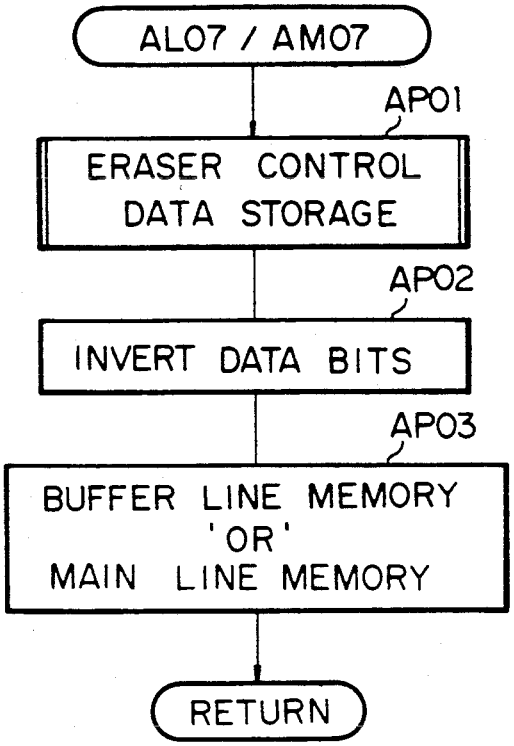
FIG. 28 is a flowchart showing the details of an eraser control subroutine program which corresponds to another eraser control subroutine program included in the control data generating subroutine program illustrated in each of FIGS. 25 and 26.

FIG. 28 is a flowchart showing the details of an eraser control subroutine program which corresponds to the eraser control subroutine program AL07 included in the subroutine program AK05/AK07 described with reference to FIG. 25 and the subroutine program AM07 included in the eraser control subroutine program AK06/AK08 described with reference to FIG. 26. The eraser control subroutine program AL07/AM07 includes an eraser control data storage subroutine program AP01 for storing eraser control data into the buffer line memory as in the subroutine program AN01 of the eraser control subroutine program AL05/AL09/AM05/AM09 described with reference to FIG. 27. The eraser control data storage subroutine program AP01 is followed by a step AP02 at which the bits of the data stored into the buffer line memory are logically inverted. Subsequently to the step AP02, a logic "OR" operation is performed to combine the data thus inverted and the data stored in the main line memory. The details of the eraser control data storage subroutine program AP01 will also be described with reference to FIG. 29.

Figure 29:
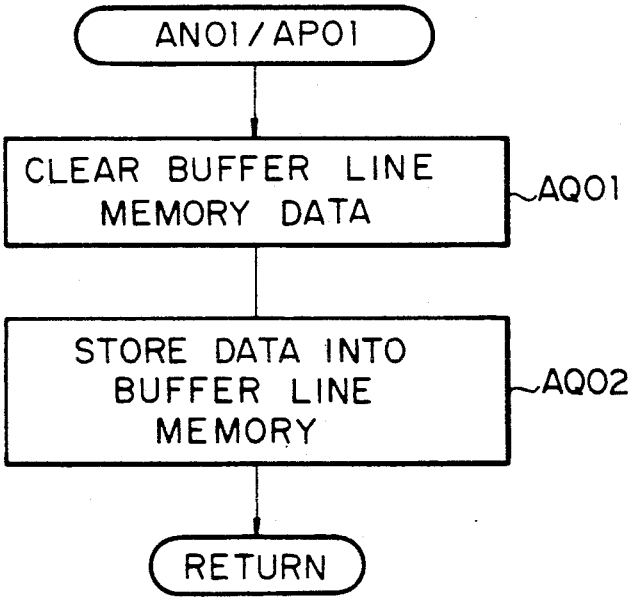
FIG. 29 is a flowchart showing the details of the eraser control data storage subroutine program included in the eraser control subroutine program illustrated in FIG. 27 or the eraser control subroutine program illustrated in FIG. 28.

Turning to FIG. 29, the eraser control data storage subroutine program AN01/AP01 includes a step AQ01 to clear the data stored in the eraser control buffer line memory. The step AQ01 is followed by a step AQ02 at which data formulated in accordance with which the eraser unit 98 is to be controlled for operation are stored into the buffer line memory.

Figure 30:
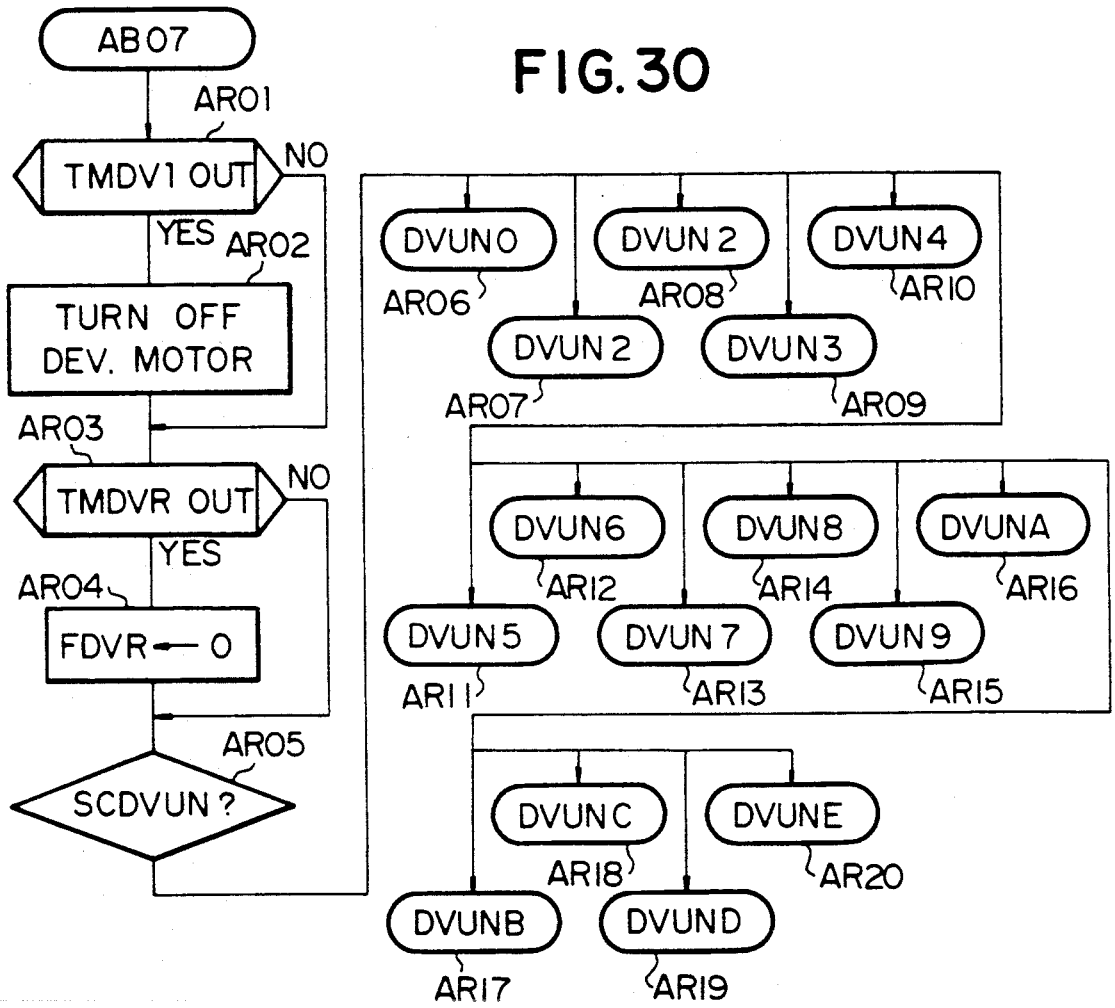
FIG. 30 is a flowchart showing the details of the developing stage control subroutine program included in the main routine program illustrated in FIG. 15A.

FIG. 30 is a flowchart showing the developing stage control subroutine program AB07 included in the main routine program to be executed by the second CPU2 302. As described with reference to FIG. 15A, the subroutine program AB07 is executed to control the image developing stage 58 in accordance with the instruction and data signals received from the control panel 200 directly or through the master CPU1 300. More specifically, the subroutine program AB07 is executed to control the drive motor 60 ($M_D$) provided for the image developing stage 58 and the solenoid-operated actuator 140 provided for each of the developing units 58a and 58b of the stage 58. As described previously with reference to FIGS. 2 to 4, the motor 60 is provided to drive the rotatable members 116, 118 and 120 forming part of each of the developing units 58a and 58b for applying toner particles to the peripheral surface of the image transfer drum 54 from a selected one of the developing units 58a and 58b. The solenoid-operated actuator 140 provided in association with the magnetic rotor 130 of each of the developing units 58a and 58b of the stage 58. The magnetic rotor 130 is biased to be held in the inoperative angular position having the magnet members $S_1$ and $N_1$ equally spaced apart from the gap $D_S$ and is, when actuated, forced to turn to the operative angular position having the magnet member $N_1$ located close to the gap $D_S$ as shown in FIG. 3.

Referring to FIG. 30, the developing stage control subroutine program AB07 starts with a decision step AR01 at which it is questioned whether or not the time which may have been counted by a timer TMDEV1 has lapsed. The timer TMDEV1 is predominant over the time at which the motor 60 for driving the rotatable members 116, 118 and 120 of the lower develiping unit 58b is to be brought to a stop. When the answer for this step AR01 is given in the affirmative, an instruction signal is issued at a step AR02 to bring the motor 60 to a stop. The step AR02 is followed by a step AR03 at which it is tested whether or not the time which may have been counted by a timer TMDEVR has lapsed. The timer TMDEVR is predominant over the period of time for controlling the area over which images are to be developed on the image transfer drum 54. When the answer for this step AR03 is given in the affirmative, a flag FDVR is shifted to a logic "0" bit state at a step AR04. The flag FDVR is used to dictate the timing at which the program predominant over a single-cycle two-colored mode of copying operation is to be executed and shifts to a logic "1" bit state when the leading end of the document sheet which is on the point of being scanned by the document scanner 36 is detected by a timing sensor (not shown) provided in conjunction with the scanner 36. The flag FDVR is shifted to a logic "0" bit state when the trailing end of the area of the latent images on the peripheral surface of the image transfer drum 54 is passed through the gap $D_S$ between the drum 54 and the applicator sleeve 120 of the lower developing unit 58*b*. The step AR04 is followed by a step AR05 at which a status code SCDVUN is checked for the numerical value currently represented by the code. The status code SCDVUN is expressed in the hexadecimal notation and may thus indicate any of the numerical values 0 to E (which equals 14 in the decimal notation). Thus, the step AR05 is followed by any one of subroutine programs AR06, AR07, AR08, . . . AR19 and AR20 which are respectively labeled as DVUN0, DVUN1, DVUN3, . . . DVUND and DVUNE, depending on the numerical value indicated by the status code SCDVUN checked at the step AR05. Of these subroutine programs AR06 to AR20, the subroutine program AR06 (labeled as DVUN0) is to be executed at an initial stage of the control process, the subroutine programs AR07 to AR10 (respectively labeled as DVUN1 to DVUN4) are to be executed to select red as the color to be used for printing, the subroutine programs AR11 to AR13 (respectively labeled as DVUN5 to DVUN7) are to be executed to select black as the color to be used for printing, and the subroutine programs AR14 to AR20 (respectively labeled as DVUN8 to DVUNE) are to be executed to control a single-cycle two-colored mode of copying operation. The details of the initial control subroutine program AR06 (DVUN0) will be described with reference to FIG. 31. The details the red select subroutine programs AR07 to AnR10 (DVUN1 to DVUN4) will be described with reference to FIGS. 32 to 35. The details of the black select subroutine programs AR11 to AR13 (DVUN5 to DVUN7) will be described with reference to FIGS. 36 to 38. The details of the single-cycle two-colored mode subroutine programs AR14 to AR20 (DVUN8 to DVUNE) will be described with reference to FIGS. 39 to 44.

Figure 31:
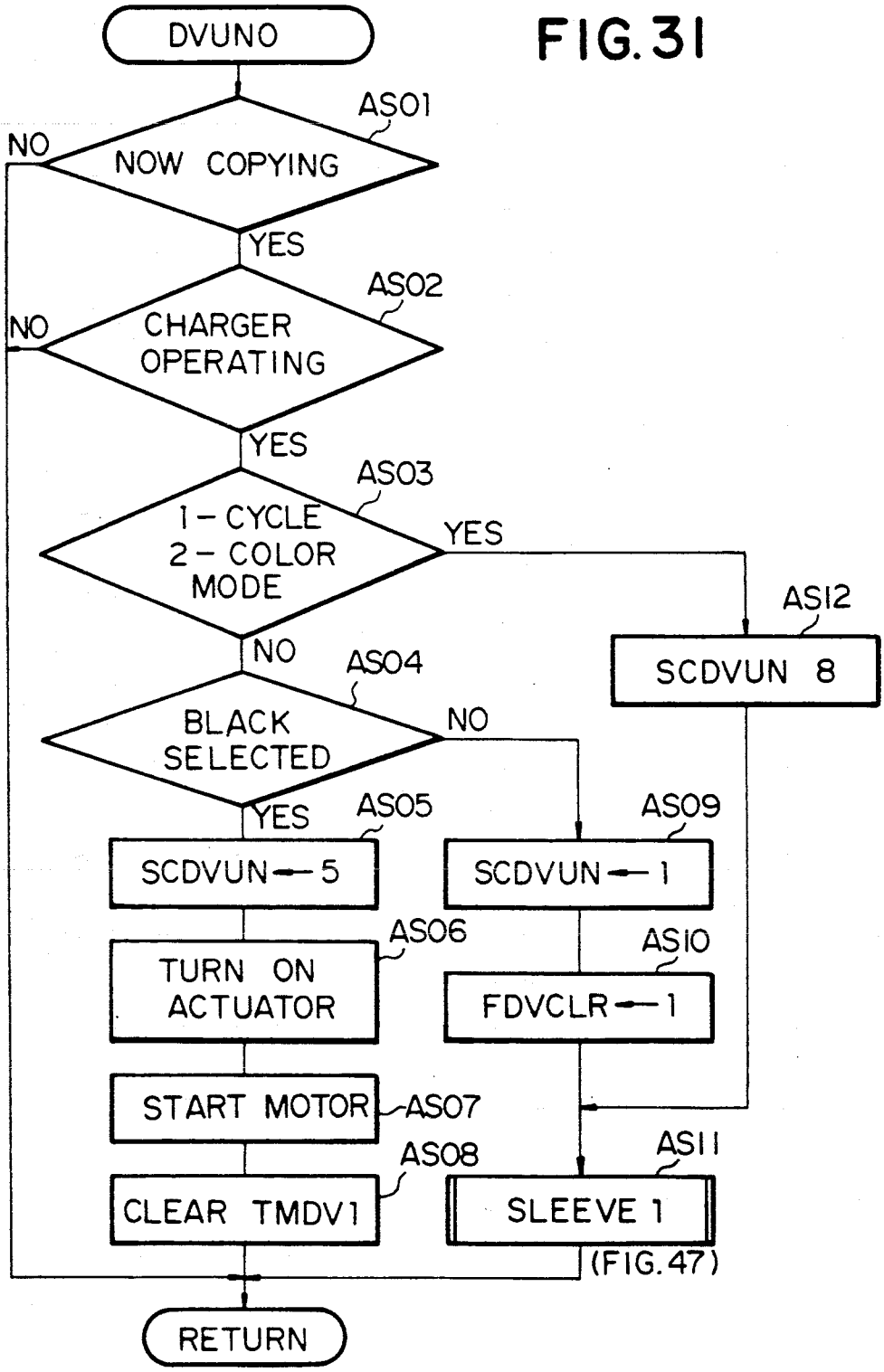
FIG. 31 is a flowchart showing the details of an initial control subroutine program included in the subroutine program illustrated in FIG. 30.

FIG. 31 is a flowchart showing the details of the initial control subroutine program AR06 (DVUN0) included in the subroutine program AB07 illustrated in FIG. 30. The initial control subroutine program AR06 starts with a decision step AS01 to check whether or not a copying operation is currently in progess. If the answer for this step AS01 is given in the affirmative, it is further queried at a subsequent step AS02 whether or not the main charger 56 is in operation. If the answer for this step AS02 is also given in the affirmative, it is tested at a step AS03 whether or not a single-cycle two-colored mode of copying operation is currently requested. If it is found that that there currently is not such a request, it is queried at a step AS04 whether or not the lower developing unit 58*b* assumed to be storing black-colored toner particles is selected for use in the current cycle of copying operation. If it is found that that the developing unit 58*b* is selected for use, then at a step AS05 the status code SCDVUN is changed to have a numerical value 5 calling for the execution of the subroutine program AR11 (DVUN5) and an instruction signal is issued at a step AS06 to energize the solenoid-operated actuator 140 for the developing unit 58*b*. An instruction signal is then issued at a step AS07 to energize the motor 60 for the developing unit 58*b* so that the developing operation is performed with use of the developing unit 58*b* storing black-colored toner particles. Thereupon, the timer TMDV1 predominant of the timing at which the motor 60 for the developing unit 58*b* is to be de-energized is reset at a step AS08. If it is found that at the step AS04 that the developing unit 58*b* is not currently selected for use, then at a step AS10 the status code SCDVUN is changed to have a numerical value 1 calling for the execution of the subroutine program AR08 (DVUN2) and a color flag FDVCLR is shifted to a logic "1" slate at a step AS10. The color flag FDVCLR of logic "1" stat is effective to change the print color from red to black or make a shift from the developing unit 58*a* to the developing unit 58*b*. If, on the other hand, it is found at the step AS03 that there currently is a request for a single-cycle two-colored mode of copying operation, then at a step AS11 the status code SCDVUN is changed to have a numerical value 8 calling for the execution of the subroutine program AR14 (DVUN8). Subsequently to the step AS10 or the step AS11, a subroutine program SLEEVE1 for the control of the lower developing unit 58*b* storing the black-colored toner particles is executed at a step AS12 as will be described with reference to FIG. 47.

FIGS. 32 to 35 are flowcharts showing the details of red select subroutine programs AR07 to AR10 (DVUN1 to DVUN4) included in the subroutine program AB07 illustrated in FIG. 30.

Figure 32:
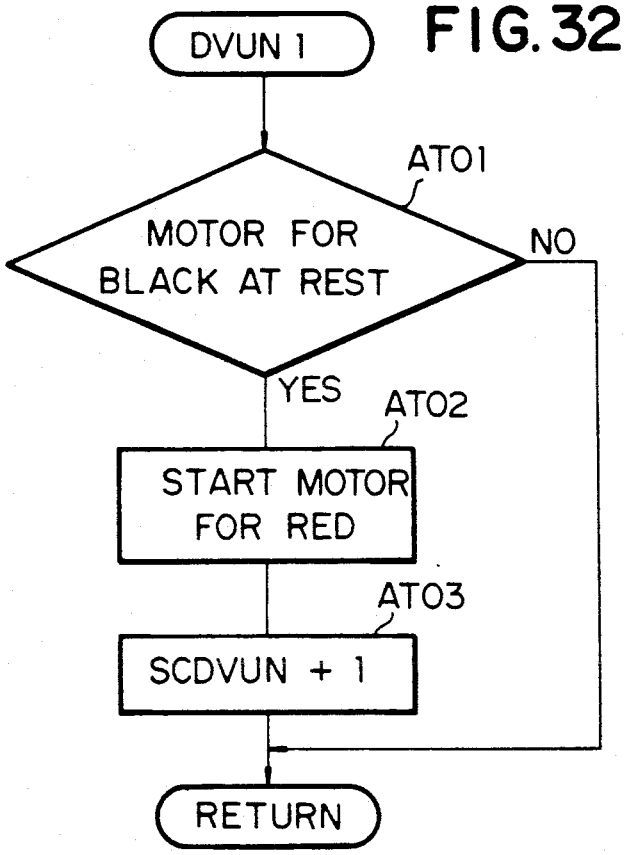
FIGS. 32 to 35 are flowcharts showing the details of red select subroutine programs included in the subroutine program illustrated in FIG. 30.

Referring to FIG. 32, the subroutine program AR07 (DVUN1) includes a step AT01 to check if the motor 60 for the lower developing unit 58*b* storing black-colored toner particles remains de-energized. If it is found that that the motor 60 for the developing unit 58*b* remains de-energized, an instruction signal is issued at a step AT02 to start the motor 60 for the upper developing unit 58*a* storing red-colored toner particles and, thereafter, the status code SCDVUN is incremented by one at a step AT03 to have a numerical value 2 calling for the execution of the subroutine program AR08 (DVUN2).

Figure 33:
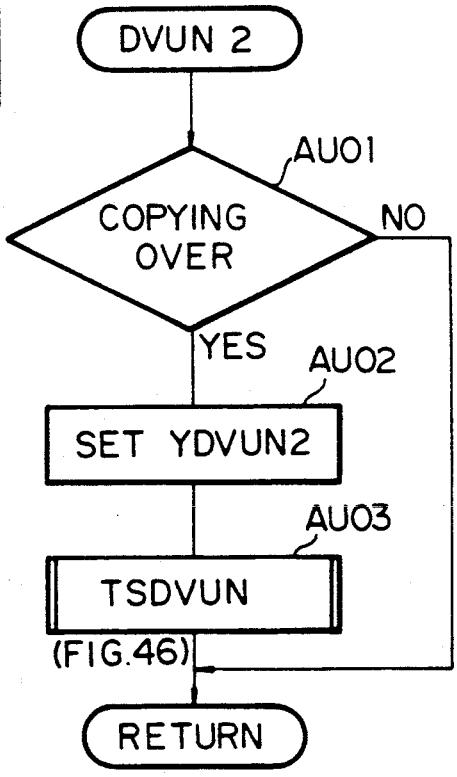

Turning to FIG. 33, the subroutine program AR08 (DVUN2) includes a step AU01 to confirm whether or not the preceding copying operation is terminated. When termination of the preceding copying operation is confirmed at this step AU01, a data YDVUN2 is formulated at a step AU02 and a subroutine program TSDVUN to set data on a timer TMDVUN for the control of the developing stage 58 is thereafter executed at a step AU03. The details of this subroutine program TSDVUN will be described with reference to FIG. 46.

Figure 34:
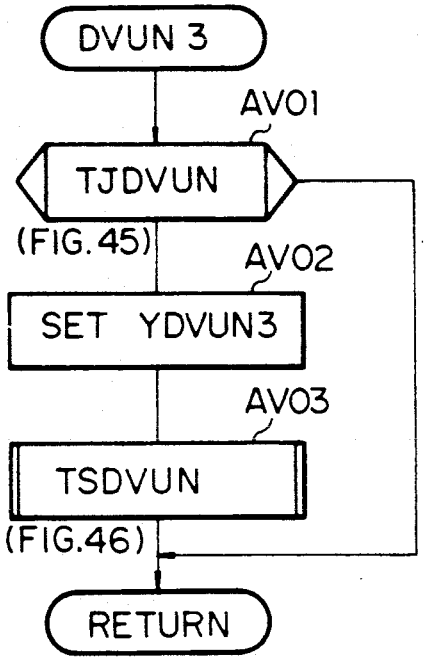

Turning to FIG. 34, the subroutine program AR09 (DVUN3) includes a step AV01 to execute a subroutine program TJDVUN for processing data for the timer TMDVUN for the control of the developing stage 58. The details of the subroutine program TJDVUN will be described with reference to FIG. 45. The step AV01 is followed by a step AV02 at which a data YDVUN3 is generated at a step AV02 and the subroutine program TSDVUN is thereafter executed at a step AV03 as will be described with reference to FIG. 46.

Figure 35:
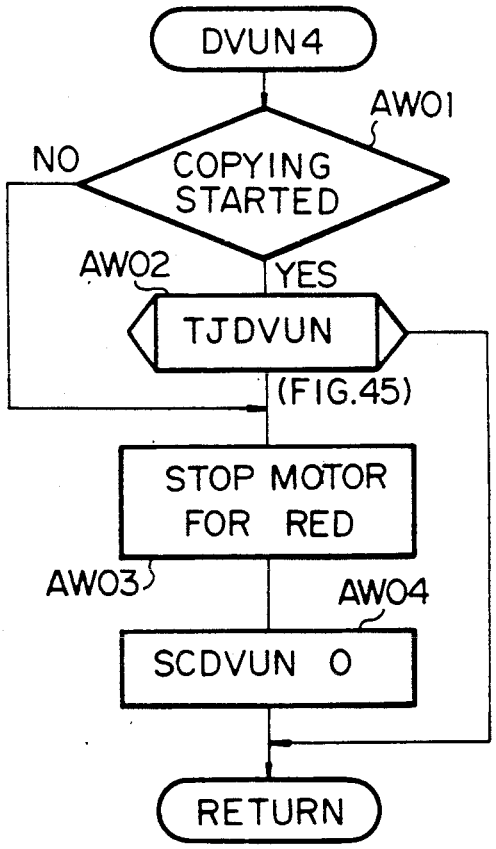

Turning to FIG. 35, the subroutine program AR10 (DVUN4) includes a decision step AW01 to confirm whether or not the copying operation to be performed in the next has been started. If it is found that that such copying operation has not been started, the subroutine program TJDVUN is executed at a step AW02, as will be described with reference to FIG. 45. Upon completion of the execution of the subroutine program TJDVUN or if it is found at the step AW01 that the copying operation to be performed in the next has already been started, an instruction signal is issued at a step AW03 to de-energize the motor 60 for the upper developing unit 58*a* storing red-colored toner particles. Subsequently to this step AW03, the status code SCDVUN is at a step AW04 shifted to have a numerical value 0 calling for the execution of the subroutine program AR06 (DVUN0).

Figure 36:
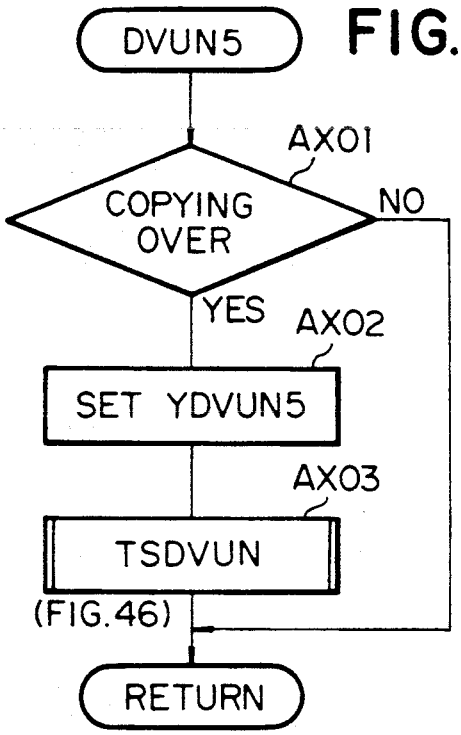
Figure 37:
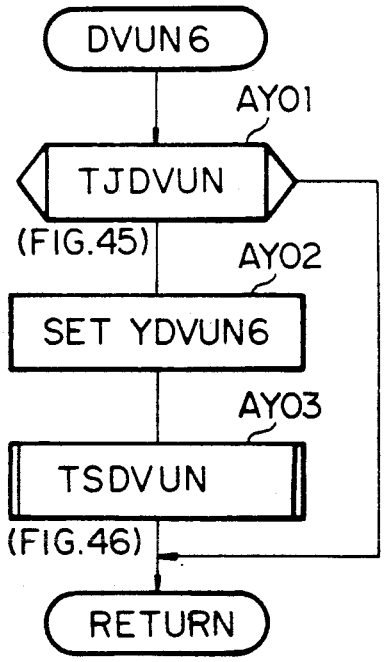

FIGS. 36 to 38 are flowcharts showing the details of black select subroutine programs AR11 to AR13 (DVUN5 to DVUN7) included in the subroutine program AB07 illustrated in FIG. 30.

Referring to FIG. 36, the subroutine program AR11 (DVUN5) includes a step AX01 to confirm whether or not the preceding copying operation is terminated. When termination of the preceding copying operation is confirmed at this step AX01, a data YDVUN5 is formulated at a step AX02 and the subroutine program TSDVUN is thereafter executed at a step AX03. The details of this subroutine program TSDVUN will be described with reference to FIG. 46.

Turning to FIG. 37, the subroutine program AR12 (DVUN6) includes a step AY01 to execute the subroutine program TJDVUN for processing data for the timer TMDVUN for the control of the developing stage 58, as will be described with reference to FIG. 45. The subroutine program AY01 is followed by a step AY02 at which a data YDVUN6 is generated and the subroutine program TSDVUN is thereafter executed at a step AY03 as will be described with reference to FIG. 46.

Turning to FIG. 38, the subroutine program AR13 (DVUN7) includes a decision step AZ01 to confirm whether or not the copying operation to be performed in the next has been started. If it is found that that such copying operation has not been started, the subroutine program TJDVUN is executed at a step AZ02, as will be described with reference to FIG. 45. Upon completion of the execution of the subroutine program TJDVUN or if it is found at the step AZ01 that the copying operation to be performed in the next has already been started, an instruction signal is issued at a step AZ03 to de-energize the solenoid-operated actuator 140 for the lower developing unit 58*b* storing black-colored toner particles to bring an end to the developing operation using the lower developing unit 58*b*. Subsequently to this step AZ03, the subroutine program SLEEVE1 for the control of the lower developing unit 58*b* is executed at a step AS12, as will be described with reference to FIG. 47. Then, the status code SCDVUN is at a step AZ04 shifted to have a numerical value 0 calling for the execution of the subroutine program AR06 (DVUN0). FIGS. 39 to 44 are flowcharts showing the details of single-cycle two-colored mode control subroutine programs AR14 to AR20 (DVUN8 to DVUNE) included in the subroutine program AB07 illustrated in FIG. 30.

Referring to FIG. 39, the subroutine program AR14 (DVUN8) includes a decision step BA01 to check if the motor 60 for the lower developing unit 58*b* storing black-colored toner particles remains de-energized. If it is found that that the motor 60 for the developing unit 58*b* remains de-energized, an instruction signal is issued at a step BA02 to start the motor 60 for the upper developing unit 58*a* storing red-colored toner particles and, thereafter, the status code SCDVUN is incremented by one at a step BA03 to have a numerical value 9 calling for the execution of the subroutine program AR15 (DVUN9). If it is found at the step BA01 that the motor 60 for the lower developing unit 58*b* is in operation, the subroutine program AR14 is repeated until the motor 60 for the developing unit 58*b* is de-energized.

Figure 40:
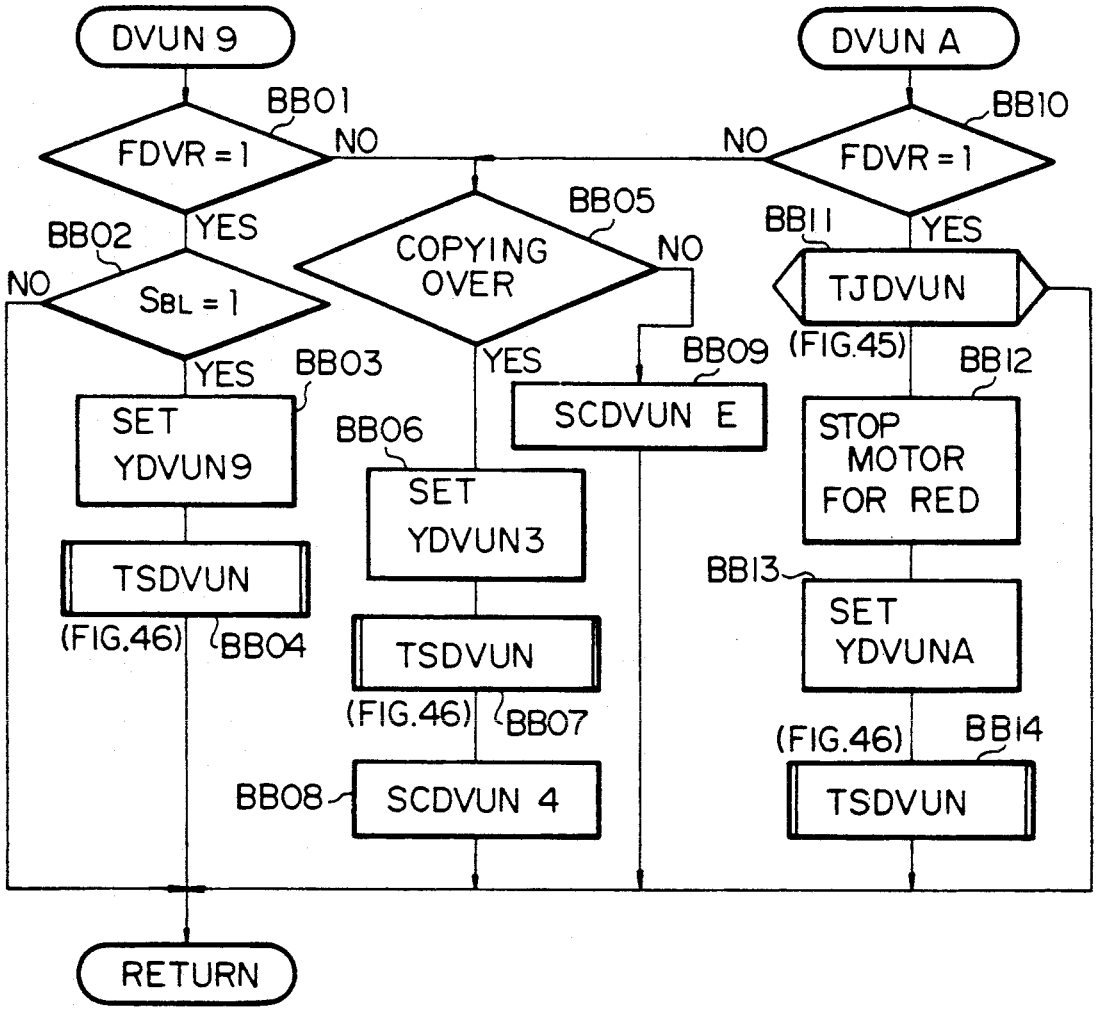

Turning to FIG. 40, the subroutine programs AR15 and AR16 (DVUN9 and DVUNA) includes a decision step BB01 to query whether or not the flag FDVR to dictate the timing to control the single-cycle two-colored mode of copying operation has a logic "1" bit state. If the answer for this step BB01 is given in the affirmative, it is tested at a step BB02 whether or not there is present an output signal SBL of a logic "1" bit from the boundary detector 106 responsive to interception of light by the light interceptor element 104. As noted previously, the signal $S_{BL}$ of a logic "1" bit is representative of the location of the boundary line defined between desired zones of a copying sheet which are to be printed in different colors. If it it found at the step BB02 that there is present such a signal$S_{BL}$, the previously mentioned data YDVUN9 is at a step BB03 formulated and set on the timer TMDVUN for the control of the developing stage 58 and a subroutine program TSDVUN is thereafter executed at a step BB04 as will be described with reference to FIG. 46.

If it is found at the step BB01 that the flag FDVR has a logic "0" bit state, it is confirmed at a step BB05 whether or not the preceding copying operation is terminated. When termination of the preceding copying operation is confirmed at this step BB05, a data YDVUN3 is at a step BB06 formulated and set on the timer TMDVUN for the control of the developing stage 58 and the subroutine program TSDVUN is thereafter executed at a step BB07 as will be described with refrence to FIG. 46. Thereafter, the status code SCDVUN is shifted at a step BB08 to a numerical value 4 calling for the execution of the subroutine program AR10 (DVUN4). If it is found at the step BB05 that the preceding copying operation is terminated, then the status code SCDVUN is shifted at a step BB09 to a numerical value E calling for the execution of the subroutine program AR20 (DVUNE).

On the other hand, the subroutine program AR16 (DVUNA) includes a step BB10 to check if the flag FDVR to dictate the timing to control the single-cycle two-colored mode of copying operation has a logic "1" bit state. If the answer for this step BB10 is given in the affirmative, the subroutine program TJDVUN is executed at a step BB11 for processing data for the timer TMDVUN for the control of the developing stage 58, as will be described with reference to FIG. 45. An instruction signal is then issued at a step BB12 to de-energize the motor 60 for the upper developing unit 58*a* storing the red-colored toner particles. The step BB12 is followed by a step BB13 at which a data YDVUNA is generated and the subroutine program TSDVUN is thereafter executed at a step BB14 as will be described with reference to FIG. 46. If it is found at the step BB10 that the flag FDVR has a logic "0" bit state, the step BB10 is followed by the decision step BB05.

Figure 41:
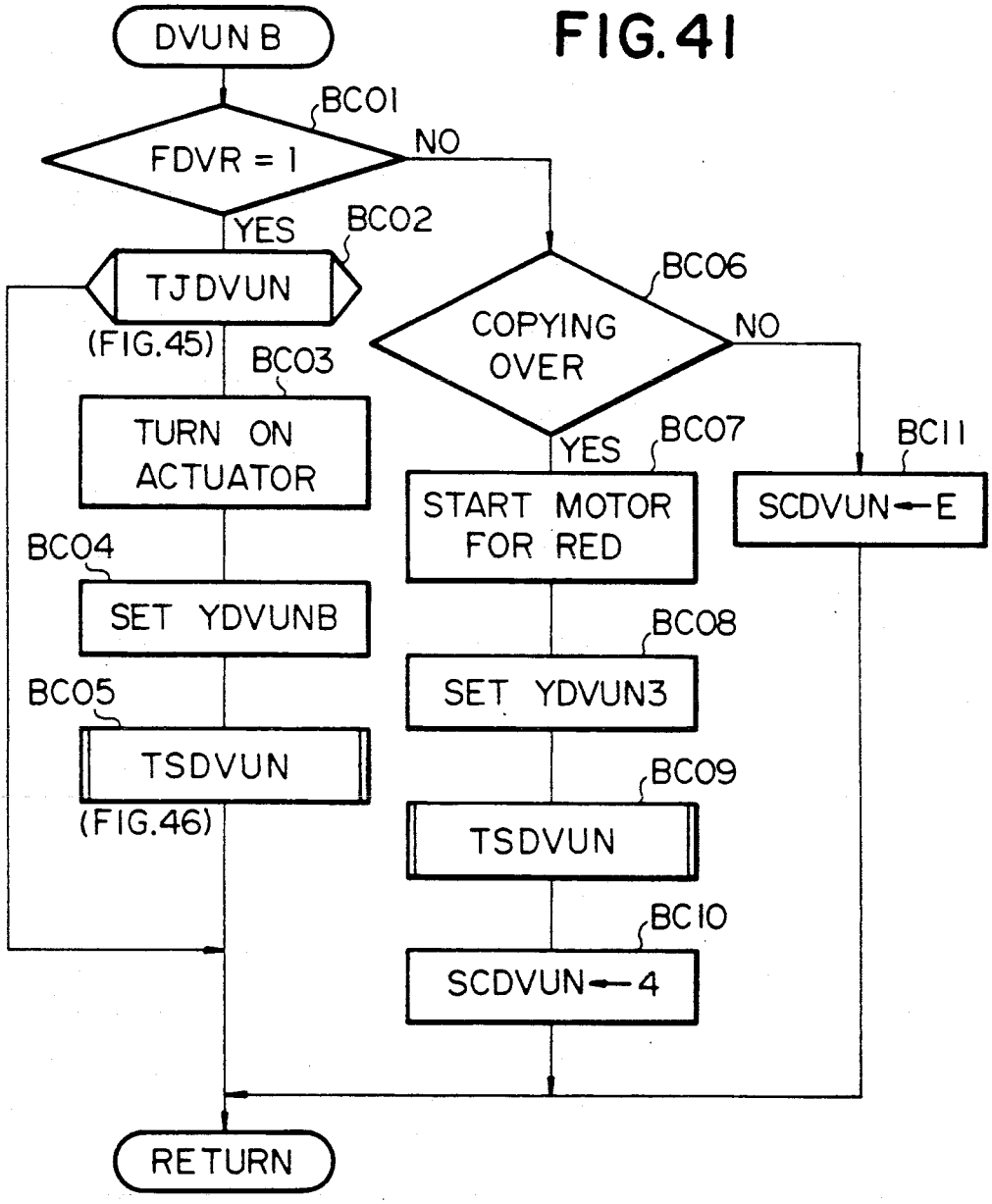

Turning to FIG. 41, the subroutine program AR17 (DVUNB) includes a decision step BC01 to confirm whether or not the flag FDVR to dictate the timing to control the single-cycle two-colored mode of copying operation has a logic "1" bit state. If the answer for this step BC01 is given in the affirmative, the subroutine program TJDVUN is executed at a step BC02 for processing data for the timer TMDVUN for the control of the developing stage 58, as will be described with reference to FIG. 45. An instruction signal is then issued at a step BC03 to energize the solenoid-operated actuator 140 for the lower developing unit 58*b* storing the black-colored toner particles. The step BC03 is followed by a step BC04 at which a data YDVUNB is generated and the subroutine program TSDVUN is thereafter executed at a step BC05 as will be described with refrence to FIG. 46. If it is found at the step BC01 that the flag FDVR has a logic "0" bit state, the step BC01 is followed by a decision step BC06 at which it is confirmed whether or not the preceding copying operation is terminated. When termination of the preceding copying operation is confirmed at this step BC06, an instruction signal is issued at a step BC07 to energize the motor 60 for the upper developing unit 58*a* storing the red-colored toner particles. The step BC07 is followed by a step BC08 at which a data YDVUN3 is formulated and set on the timer TMDVUN for the control of the developing stage 58 and the subroutine program TSDVUN is thereafter executed at a step BC09 as will be described with refrence to FIG. 46. Thereafter, the status code SCDVUN is shifted at a step BC10 to a numerical value 4 calling for the execution of the subroutine program AR10 (DVUN4). If it is found at the step BC06 that the preceding copying operation is terminated, then the status code SCDVUN is shifted at a step BC11 to a numerical value E calling for the execution of the subroutine program AR20 (DVUNE).

Figure 42:
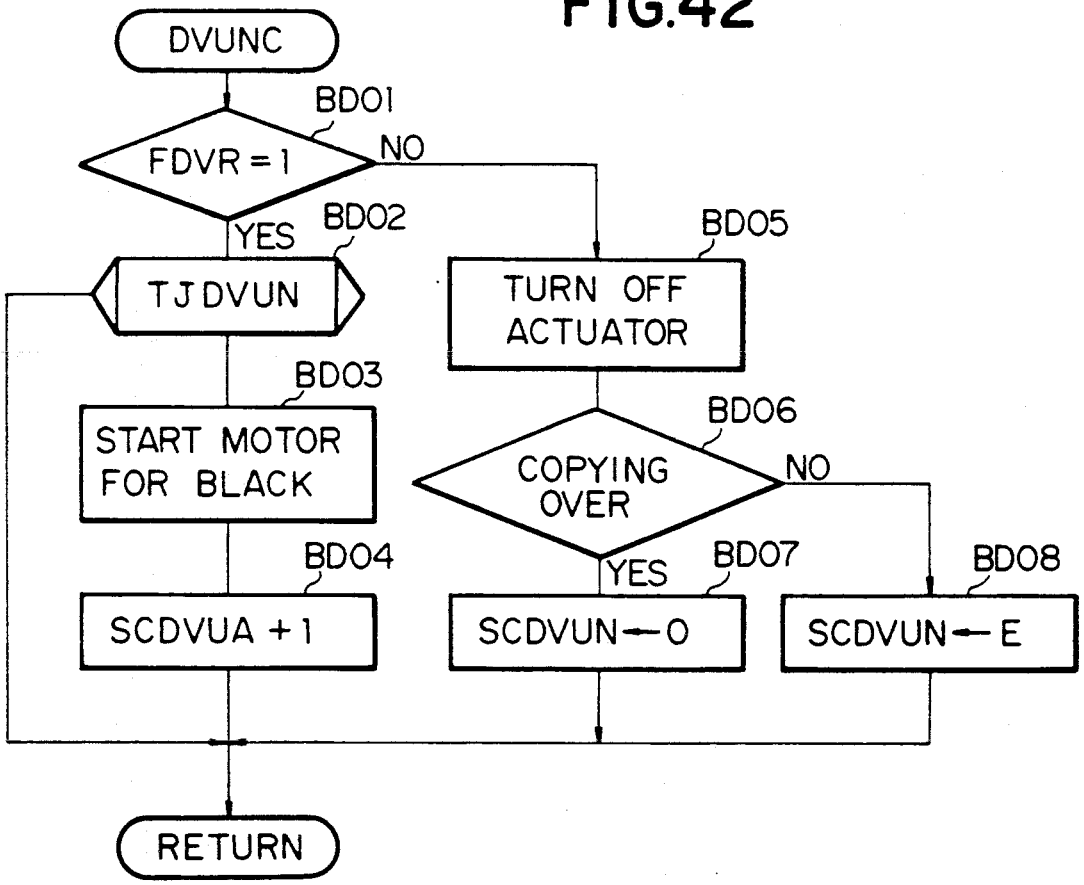

Referring to FIG. 42, the subroutine program AR18 (DVUNC) includes a decision step BD01 to confirm whether or not the flag FDVR to dictate the timing to control the single-cycle two-colored mode of copying operation has a logic "1" bit state. If the answer for this step BD01 is given in the affirmative, the subroutine program TJDVUN is executed at a step BD02 for processing data for the timer TMDVUN for the control of the developing stage 58, as will be described with reference to FIG. 45. An instruction signal is then issued at a step BD03 to energize the motor 60 for the lower developing unit 58*b* storing the black-colored toner particles. The step BD03 is followed by a step BD04 at which the status code SCDVUN is incremented by one at a step BC04 to have a numerical value D (=13) calling for the execution of the subroutine program AR19 (DVUND). If it is found at the step BD01 that the flag FDVR has a logic "0" bit state, the step BD01 is followed by a step BD05 at which an instruction signal is issued to energize the solenoid-operated actuator 140 for the lower developing unit 58*b* storing the black-colored toner particles. The step BD05 is followed by a decision step BD06 at which it is confirmed whether or not the preceding copying operation is terminated. When termination of the preceding copying operation is confirmed at this step BD06, the status code SCDVUN is shifted at a step BD07 to a numerical value 0 calling for the execution of the subroutine program AR06 (DVUN0). If it is found at the step BD06 that the preceding copying operation is terminated, then the status code SCDVUN is shifted at a step BD08 to a numerical value E calling for the execution of the subroutine program AR20 (DVUNE).

Figure 43:
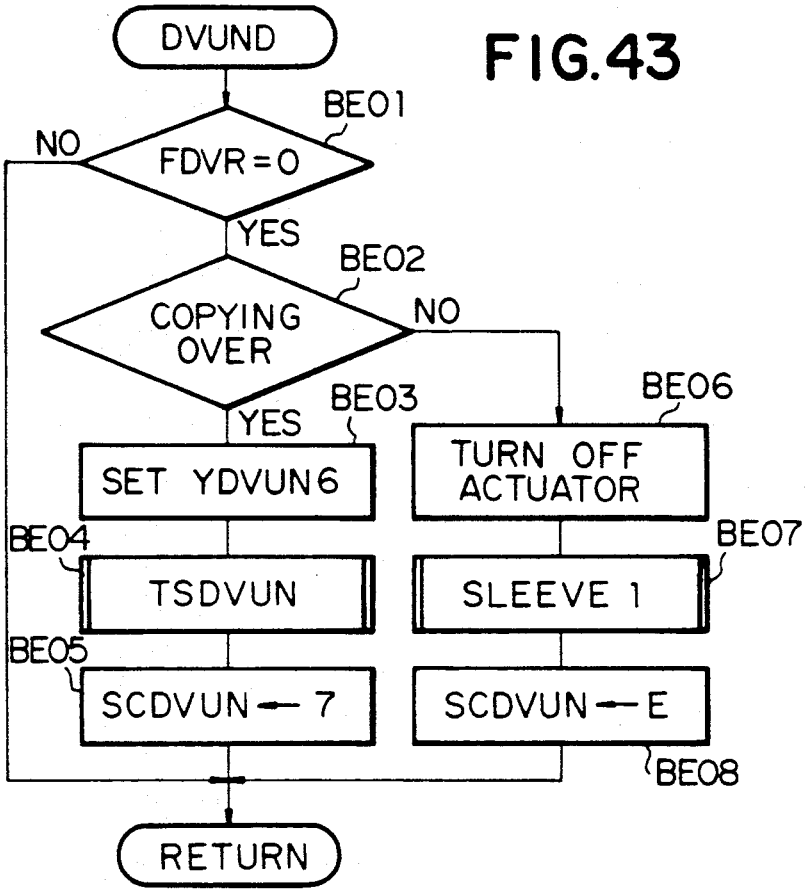

Turning to FIG. 43, the subroutine program AR19 (DVUND) includes a decision step BE01 to query whether or not the flag FDVR to dictate the timing to control the single-cycle two-colored mode of copying operation has a logic "0" bit state. If the answer for this step BE01 is given in the affirmative, it is confirmed at a step BE02 whether or not the preceding copying operation is terminated. When termination of the preceding copying operation is confirmed at this step BE02, a data YDVUN6 is at a step BE03 formulated and set on the timer TMDVUN for the control of the developing stage 58 and the subroutine program TSDVUN is thereafter executed at a step BE04 as will be described with refrence to FIG. 46. Thereafter, the status code SCDVUN is shifted at a step BE05 to a numerical value 7 calling for the execution of the subroutine program AR13 (DVUN7). If it is found at the step BE02 that the preceding copying operation is terminated, an instruction signal is issued at a step BE06 to de-energize the solenoid-operated actuator 140 for the lower developing unit 58*b* storing the black-colored toner particles. The step BE06 is followed by a step BE07 to execute the subroutine program SLEEVE1 for the control of the lower developing unit 58*b*, as will be described with reference to FIG. 47. Then, the status code SCDVUN is shifted at a step BE08 to a numerical value E calling for the execution of the subroutine program AR20 (DVUNE).

Figure 44:
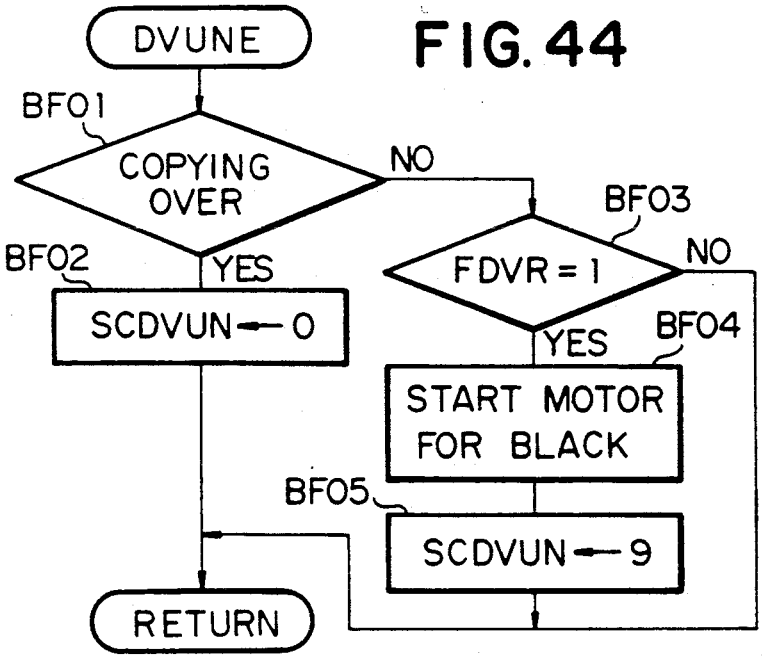

Turning to FIG. 44, the subroutine program AR20 (DVUNE) includes a decision step BF01 at which it is confirmed whether or not the preceding copying operation is terminated. When termination of the preceding copying operation is confirmed at this step BF01, the status code SCDVUN is shifted at a step BF02 to a numerical value 0 calling for the execution of the subroutine program AR06 (DVUN0). If it is found at the step BF01 that the preceding copying operation is terminated, it is queried at a step BF03 whether or not the flag FDVR to dictate the timing to control the single-cycle two-colored mode of copying operation has a logic "1" bit state. If the answer for this step BF03 is given in the affirmative, an instruction signal is issued at a step BF04 to energize the motor 60 for the upper developing unit 58*a* storing the red-colored toner particles. The step BF04 is followed by a step BF05 at which the status code SCDVUN is shifted to a numerical value 9 calling for the execution of the subroutine program AR15 (DVUN9).

Figure 45:
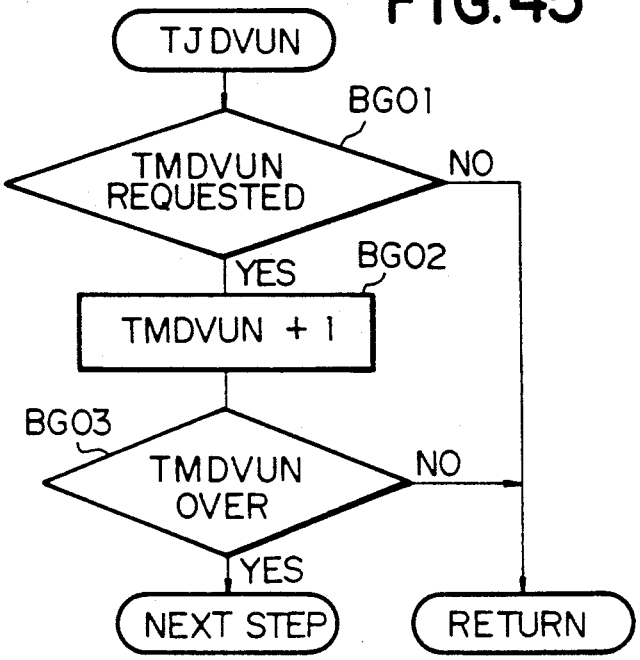
FIG. 45 is a flowchart showing the details of a subroutine program included in each of the subroutine programs illustrated in FIGS. 34, 36, 37, 38, 40, 41 and 42.

FIG. 45 is a flowchart showing the details of the subroutine program TJDVUN included in each of the subroutine programs DVUN3 (FIG. 34), DVUN4 (FIG. 35), DVUN6 (FIG. 37), DVUN7 (FIG. 38), DVUNA (FIG. 40), DVUNB (FIG. 41) and DVUNC (FIG. 42). The subroutine program TJDVUN is used for the processing of data for the timer TMDVUN for the control of the developing stage 58 and includes a decision step BG01 to check if there currently is a request for activation of the timer TMDVUN. If it is found that that there is such a request, an instruction signal is issued at a step BG02 to increment the timer TMDVUN by one. When it is confirmed at a step BG03 that the timer TMDVUN has completed its counting operation, the subroutine program TJDVUN proceeds to the subsequent step and, if not, the subroutine program TJDVUN recycles to the step BG01.

Figure 46:
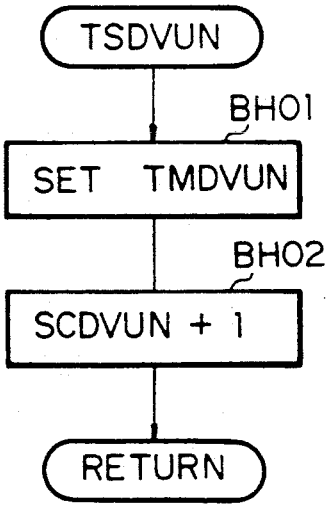
FIG. 46 is a flowchart showing the details of a subroutine program included in each of the subroutine programs illustrated in FIGS. 34, 36, 37, 40, 41 and 43.

FIG. 46 is a flowchart showing the details of the subroutine program TSDVUN included in each of the subroutine programs DVUN2 (FIG. 33), DVUN3

(FIG. 34), DVUN5 (FIG. 36), DVUN6 (FIG. 37), DVUN9 (FIG. 40), DVUNB (FIG. 41) and DVUND (FIG. 43). The subroutine program TSDVUN is used to set data on the timer TMDVUN for the control of the developing stage 58 and includes a step BH01 to set data on the timer TMDVUN and thereafter the status code SCDVUN is incremented by one at a step BH02 to update the control status for the developing stage 58.

Figure 47:
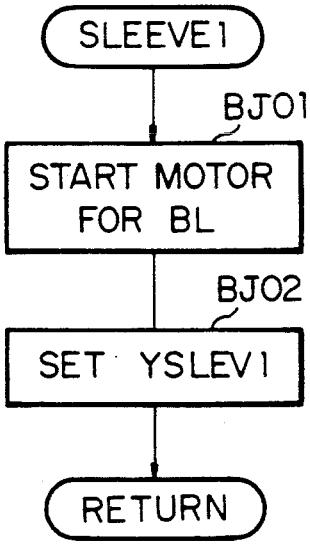
FIG. 47 is a flowchart showing the details of a subroutine program included in each of the subroutine programs illustrated in FIGS. 31, 38, and 43.

FIG. 47 is a flowchart showing the details of the subroutine program SLEEVE1 included in each of the subroutine programs DVUN0 (FIG. 31), DVUN7 (FIG. 38) and DVUND (FIG. 43). The subroutine program SLEEVE1 is used for the control of the lower developing unit 58*b* storing the black-colored toner particles and includes a step BJ01 to issue an instruction signal to start the motor 60 for the developing unit 58*b* storing the black-colored toner particles. The step BJ01 is followed by a step BJ02 at which a data YSLEV1 is set on the timer TMDEV1 is predominant over the time at which the motor 60 for the lower develiping unit 58*b* is to be brought to a stop.

Figure 48:
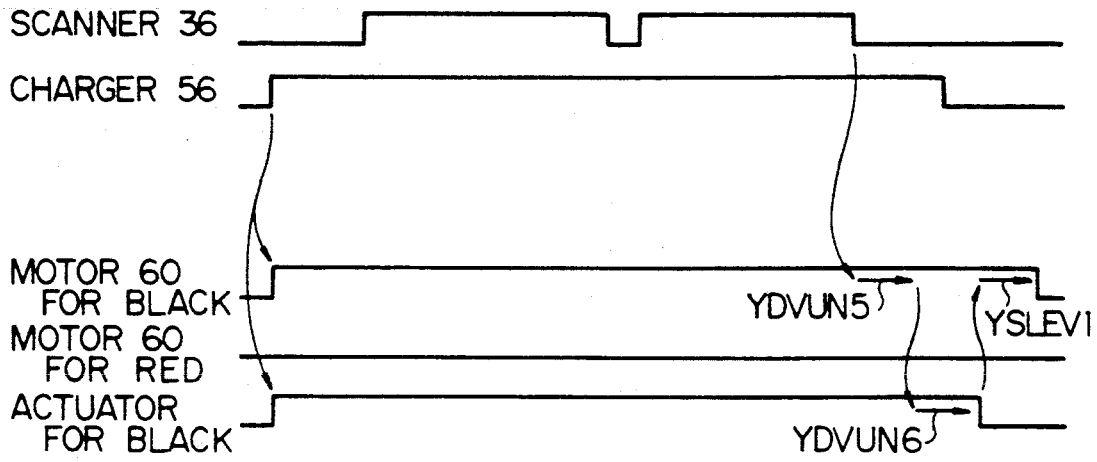
FIGS. 48 and 49 are timecharts showing the timings at which the developing units incorporated in the apparatus embodying the present invention are to be made operative and inoperative in the various subroutine programs illustrated in FIGS. 30 to 47.
Figure 49:
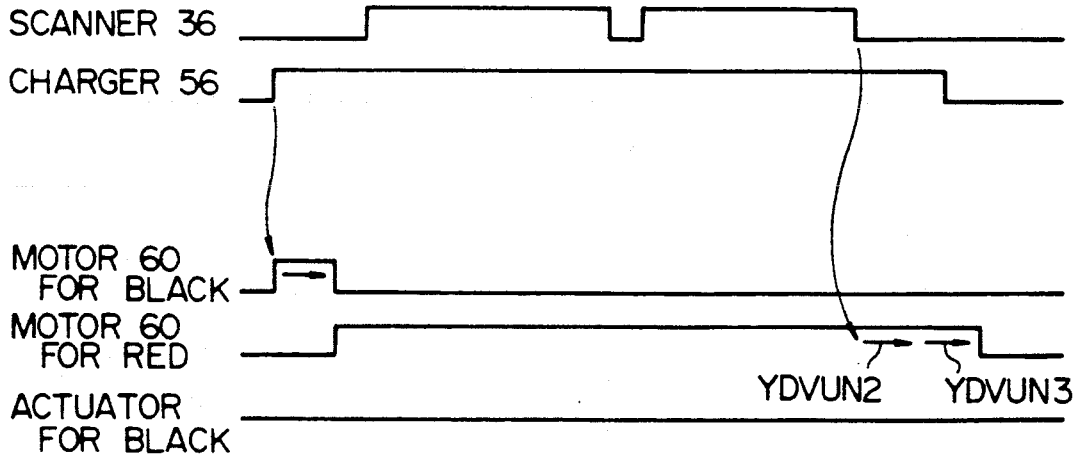

FIGS. 48 and 49 are timecharts showing the timings at which the developing units 58*a* and 58*b* are to be made operative and inoperative in the various subroutine programs hereinbefore described with reference to FIGS. 30 to 47 when copying operation is performed in two consecutive cycles.

It will be seen from FIG. 48 that the motor 60 and solenoid-operated actuator 140 for the lower developing unit 58*b* are energized simultaneously when the main charger 56 is activated. After the scanning operation by the document scanner 36 is terminated for each cycle of operation, the main charger 56 and actuator 140 are de-activated at different timings and thereupon the motor 60 is brought to a stop.

FIG. 49 shows that the motor 60 for the lower developing unit 58*b* is energized simultaneously (with the actuator 140 for the developing unit 58*b* maintained de-energized) when the main charger 56 is activated. Simultaneously when the motor 60 for the developing unit 58*b* is brought to a stop, the motor 60 for the upper developing unit 58*a* is energized. Thus, the two developing units 58*a* and 58*b* could not be operative concurrently and, for this reason, the load imposed by the developing stage 58 is maintained below a certain limit value. It may be noted that such a timing for starting the motor 60 for the upper developing unit 58*a* is sufficiently earlier than the timing at which the latent images produced on the image transfer drum 54 by means of the document scanner 36 approach the developing unit 58*a*. At a prescribed time interval after the scanning operation by the scanner 36 is terminated for each cycle of operation, the motor 60 for the developing unit 58*a* is brought to a stop.

Figure 50:
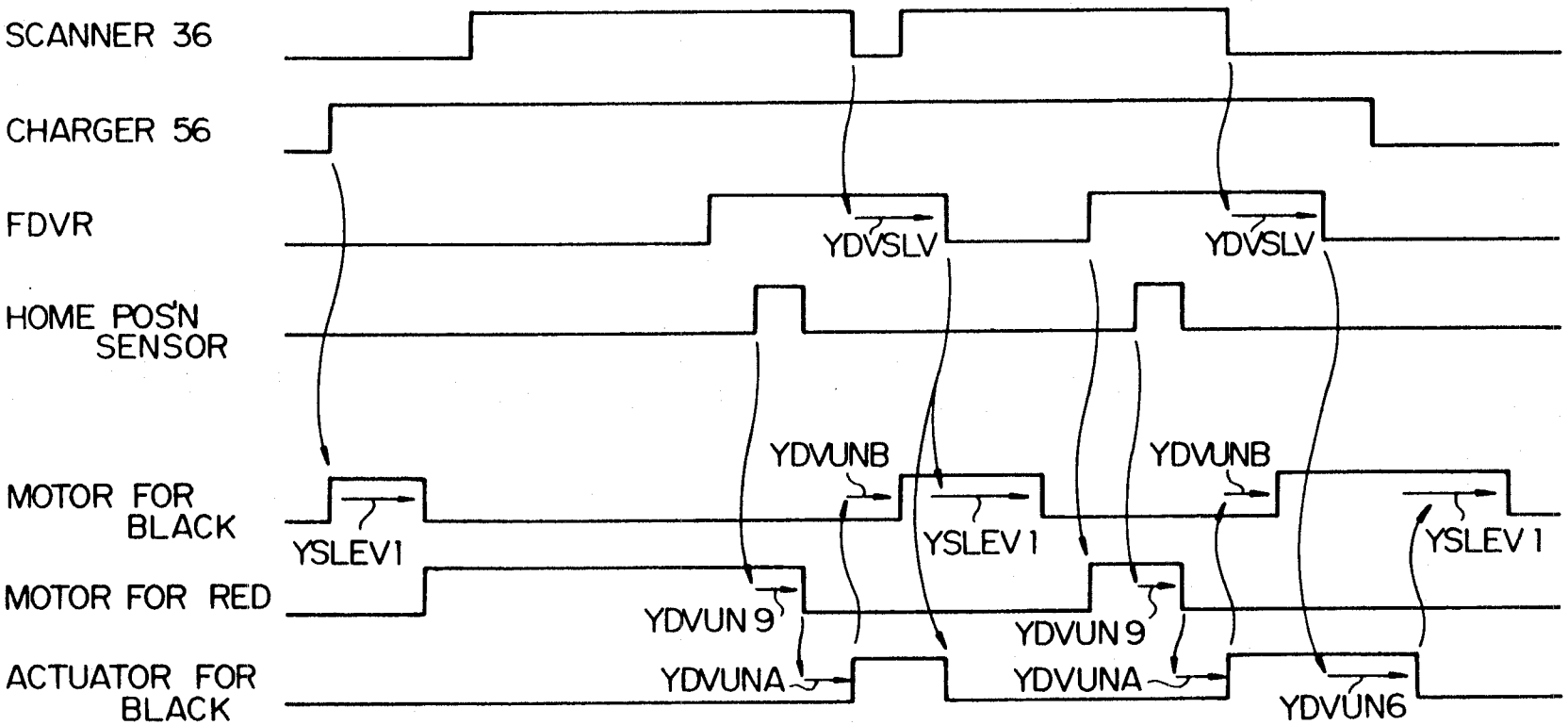
FIG. 50 is a timechart showing the timings at which such developing units are to be made operative and inoperative during a single-cycle two-colored mode of copying operation.

FIG. 50 is a timechart showing the timings at which the developing units 58*a* and 58*b* are to be made operative and inoperative during a single-cycle two-colored mode of copying operation. The timing at which a shift is made from the upper developing unit 58*a* to the lower developing unit 58*b* is made under the control of the signal $S_{BL}$ produced by the boundary detector 106 and thus representative of the location of the boundary line defined between desired zones of a copying sheet to be printed in different colors.

Figure 51:
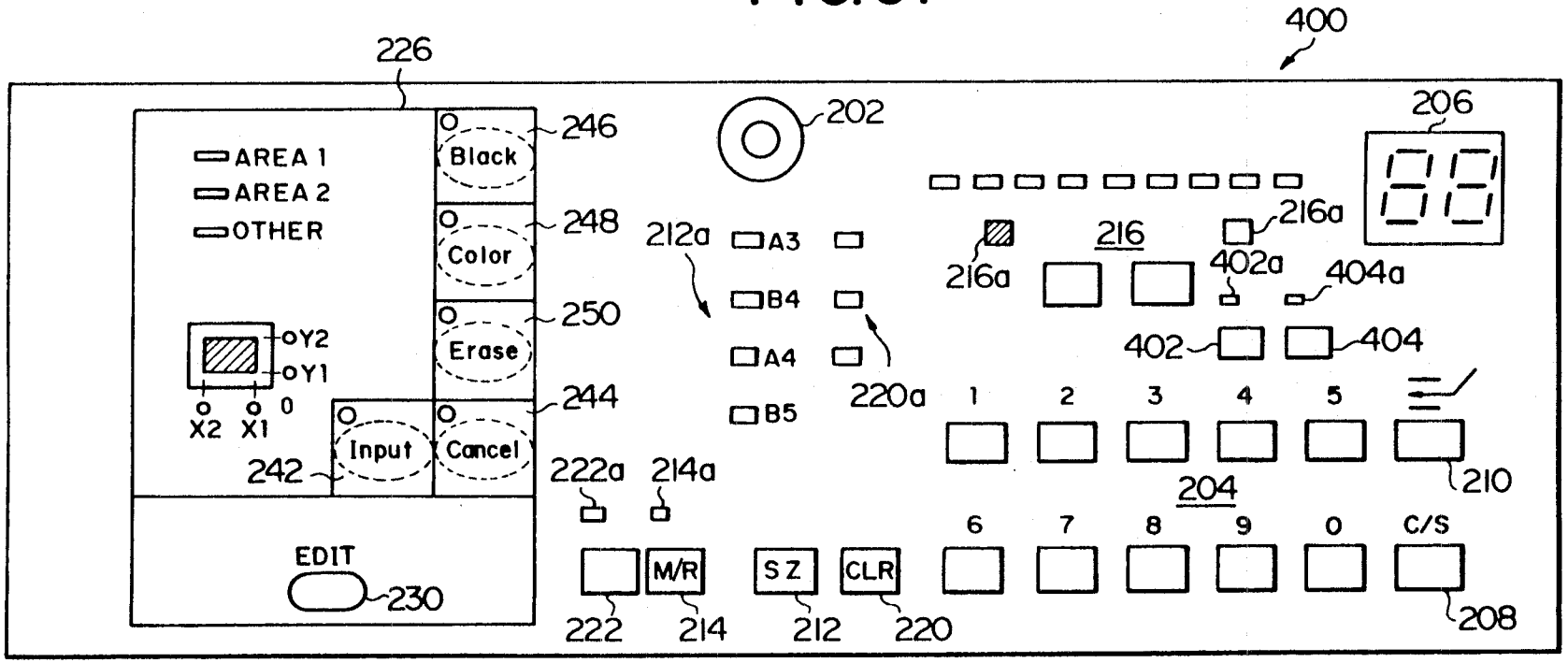
FIG. 51 a plan view schematically showing a control panel for use in a second preferred embodiment of an image duplicating apparatus according to the present invention.

FIG. 51 shows a control panel 400 for use in a second preferred embodiment of an image duplicating apparatus according to the present invention. The control panel 400 herein shown is largely similar to its counterpart described with reference to FIG. 5 and thus comprises all the equivalents of the switches and indicators of the control panel 200 shown in FIG. 5. Such equivalents of the switches and indicators are designated by the same reference numerals as those used in FIG. 5.

The control panel 400 herein shown comprises, in addition to the switches and indicators on the control panel 200, a duplex copy mode select switch 402 and a composite copy mode select switch 304 with respectively associated indicators 402*a* and 404*a* as shown.

As previously noted, the copying apparatus embodying the present invention comprises the duplex/composite copy paper feed system 94 which is usually used for producing printed images on the reverse face of the copy sheet which has printed images already produced on its front face. The duplex/composite copy paper feed system 94 is also operable for a two-cycle two-colored edited mode of copying operation in which images within one specified area of a copying sheet are to be printed in one color and images within another specified area of the sheet are to be printed in another color on the same side of the sheet on which the images within the former area have been printed. Thus, a copy sheet which has been passed through the image-fixing and sheet-discharge system 30 may be either discharged to the paper discharge tray 92 or transferred to the duplex/composite copy paper feed system 94 by means of the two-way guide member 96. In association with the two-way guide member 96 are provided an actuator which when activated drives the two-way guide member 96 to move to a position to direct a copy sheet toward the paper discharge tray 92 and an actuator which when activated drives the two-way guide member 96 to move to a position to transfer a copy sheet to the duplex/composite copy paper feed system 94. Furthermore, the roller pairs forming part of the duplex/composite copy paper feed system 94 include a roller pair having an associated actuator which when activated drive the roller pair to a position operative to direct a copy sheet to a path leading toward the timing rollers 82 past, for example, the second pair of paper feed rollers 78. The duplex/composite copy paper feed system 94 may further comprise a shift assembly operative to pass a copy sheet to the paper feed mechanism 28 with the previously printed side of the sheet directed upwardly for a duplex mode of copying operation or downwardly for a composite or two-cycle two-colored edited mode of copying operation.

Figure 52:
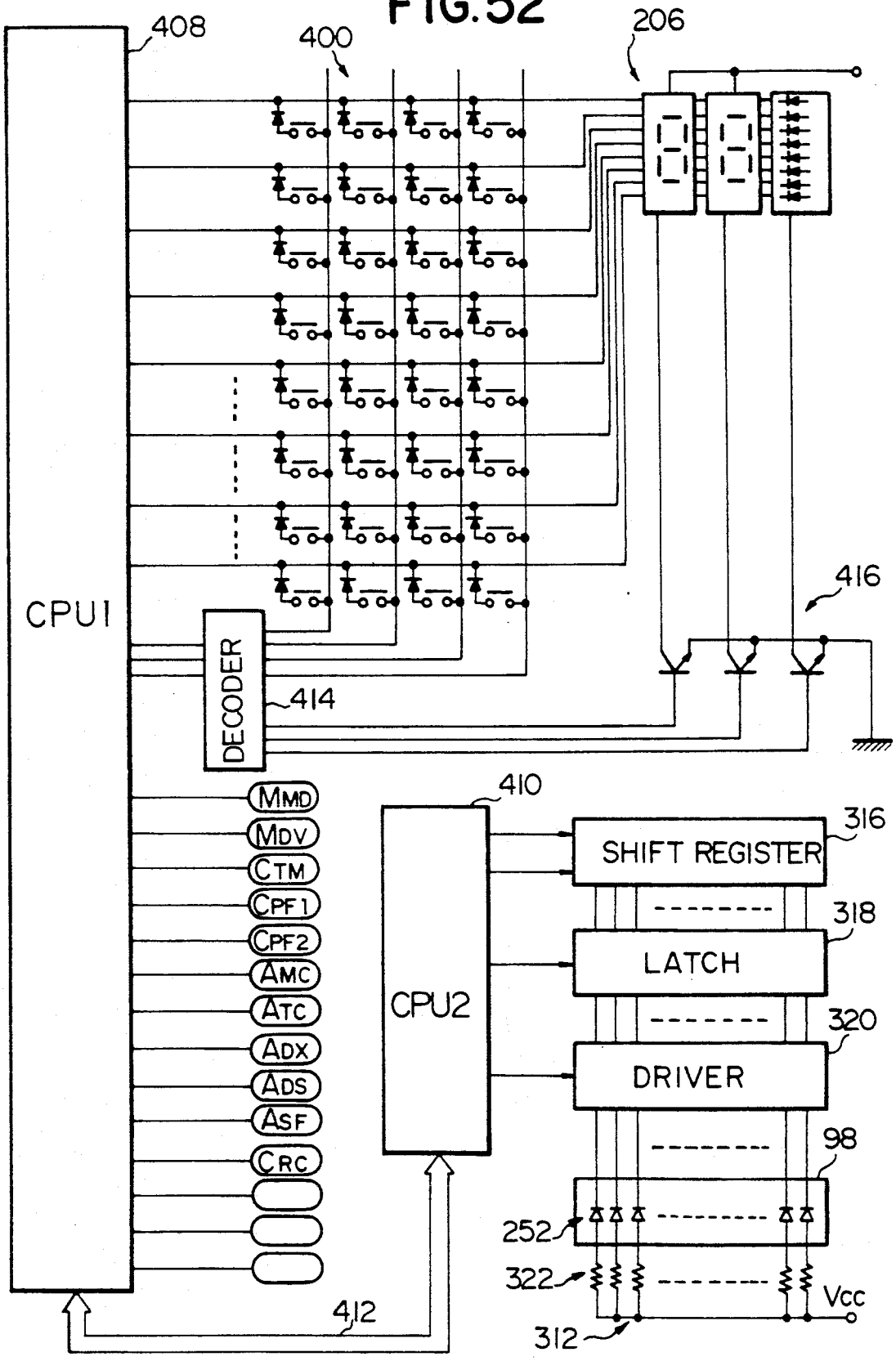
FIG. 52 a diagram schematically showing the general arrangement of a control circuit which may be used to carry out the functions achievable from the control panel illustrated in FIG. 51.

FIG. 52 shows the general arrangement of a control circuit which may be used to carry out the functions achievable from the control panel 400 thus arranged.

The control circuit comprises a first or master CPU 408 and a second or slave CPU 410 which are coupled together through a bidirectional bus 412. The first CPUl 408 is predominant over the various aspects and phases of the copying operation to be carried out by the apparatus except for those the charge eraser unit 98. The CPU 408 is thus operative to control not only the ordinary and edited modes of copying operation to be performed by the image reproducing system 26 and paper feed mechanism 28 but also the duplex and composite modes of copying operation.

The CPU1 408 is thus responsive to various control and data signals which may be supplied from the control panel 400 and dictates the starts and stops of the various drive and actuator units associated with the image reproducing system 26 and paper feed mechanism 28. In FIG. 52, these drive and actuator units are assumed to include a main drive motor ($M_{MD}$) for driving the image transfer drum 54 and the various rollers included in the paper feed mechanism 28, a drive motor ($M_{DV}$) associated with each of the developing units 58*a* and 58*b*, a clutch ($C_{TM}$) for actuating the timing rollers 82, a clutch ($C_{PF1}$) for actuating the first pair of paper feed rollers 76, a clutch ($C_{PF2}$) for actuating the second pair of paper feed rollers 76, an actuator ($A_{MC}$) for the main charger 56, an actuator ($A_{TC}$) for the transfer charger 62, an actuator ($A_{DX}$) to drive the two-way guide member 96 to a position to transfer a copy sheet to the duplex/composite copy paper feed system 94, an actuator ($A_{DS}$) to drive the two-way guide member 96 to a position to discharge a copy sheet from the interior of the apparatus, an actuator ($A_{SF}$) for the shift assembly to pass a copy sheet to the paper feed mechanism 28 with the previously printed side of the sheet directed upwardly or downwardly, and an a clutch ($C_{RC}$) for actuating a pair of paper recirculation rollers included in the duplex/composite copy paper feed system 94. The first CPUl 408 is further connected through a decoder 414 to the various indicators on the control panel 400 including the display window 206 and display screen 206 through switch elements 416 as shown.

On the other hand, the CPU2 410 is predominant over the operation of the light emitter elements 252 of the charge eraser unit 98. The CPU2 41 is thus responsive to the control and data signals supplied from the edited copy mode control section 226 of the control panel 400 to control the selective activation of the light emitter elements 252 of the charge eraser unit 98. For this purpose, the second CPU2 302 is connected to an eraser control circuit which is similar to its counterpart 312 in the control circuit described with reference to FIGS. 8 and 9.

Figure 53:
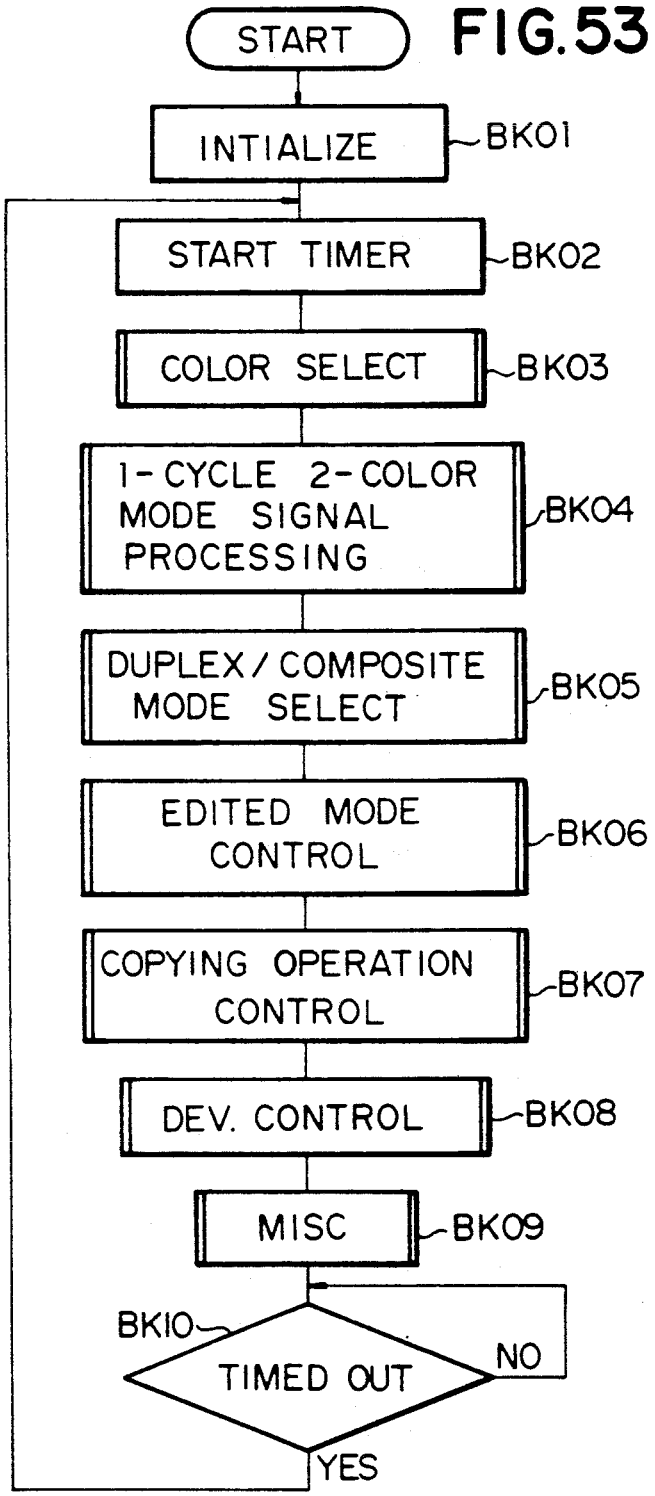
FIG. 53 is a flowchart showing the main routine program to be executed by a master microprocessor included in the control circuit illustrated in FIG. 52.

FIG. 53 shows the main routine program to be executed by the first or master CPUI 408 hereinbefore described with reference to FIG. 52. The routine program starts with the copying apparatus switched in and initializes the master CPUl 408 at a step BK01 so that all the copying conditions and modes of operation to be controlled by means of the CPUl 408 are selected in accordance with prescribed default rules. An internal timer of the system is then initiated at a step BK02 to count the time interval predetermined for a single complete iteration through the routine program.

The master CPUl 408 may then execute a color select subroutine program BK03 by which one or both of the developing units 58*a* and 58*b* respectively storing red-colored and black-colored toner particles may be selected for use depending upon an instruction signal or signals entered at the control panel 400. The details of the color select subroutine program BK03 will be hereinafter described with reference to FIG. 54. The color select subroutine program BK03 may be followed by a single-cycle two-color mode signal processing subroutine program BK04 to process signals entered at the control panel 400 with a single-cycle two-color mode of copying operation selected. The details of the subroutine program BK04 will be hereinafter described with reference to FIG. 55. The master CPUl 408 may thereafter execute a duplex/composite mode select subroutine program BK05 by which either a duplex mode of copying operation or a composite mode of copying operation is selected depending upon an an instruction signal or signals entered at the control panel 400. The details of the duplex/ composite mode select subroutine program BK05 will be hereinafter described with reference to FIG. 56.

The master CPUl 300 may then execute an edited copy mode setup subroutine program BK06 to set up conditions establishing an edited mode of copying operation and thereupon may further execute a copying operation control subroutine program BK07 predominant over the copying operation to be performed by the apparatus in accordance with the various instruction and data signals supplied from the control panel 400. The details of the edited copy mode setup subroutine program BK06 will be hereinafter described with reference to FIG. 57 and the details of the copying operation control subroutine program BK07 described with reference to FIGS. 58A, 58B and 58C. The master CPUl 408 may further execute a develop stage control subroutine program BK08 for controlling the developing operation to be performed by one or both of the developing units 58*a* and 58*b*. The details of the develop stage control subroutine program BK08 will be hereinafter described with reference to FIG. 59. Further executed by the master CPUl 408 is a miscellaneous job subroutine program BK09 including inter-CPU communication for communicating with the slave CPU2 410. Upon lapse of the predetermined time interval as detected at a step BK10 after the internal timer of the system has been initiated at the step BK02, the system reverts to the step BK02 and recycles the subroutine programs BK02 to BK09.

Description will be hereinafter made with reference to FIGS. 54 to 59 in regard to the various subroutine programs thus included in the main routine program to be executed by the master COU1 408.

Figure 54:
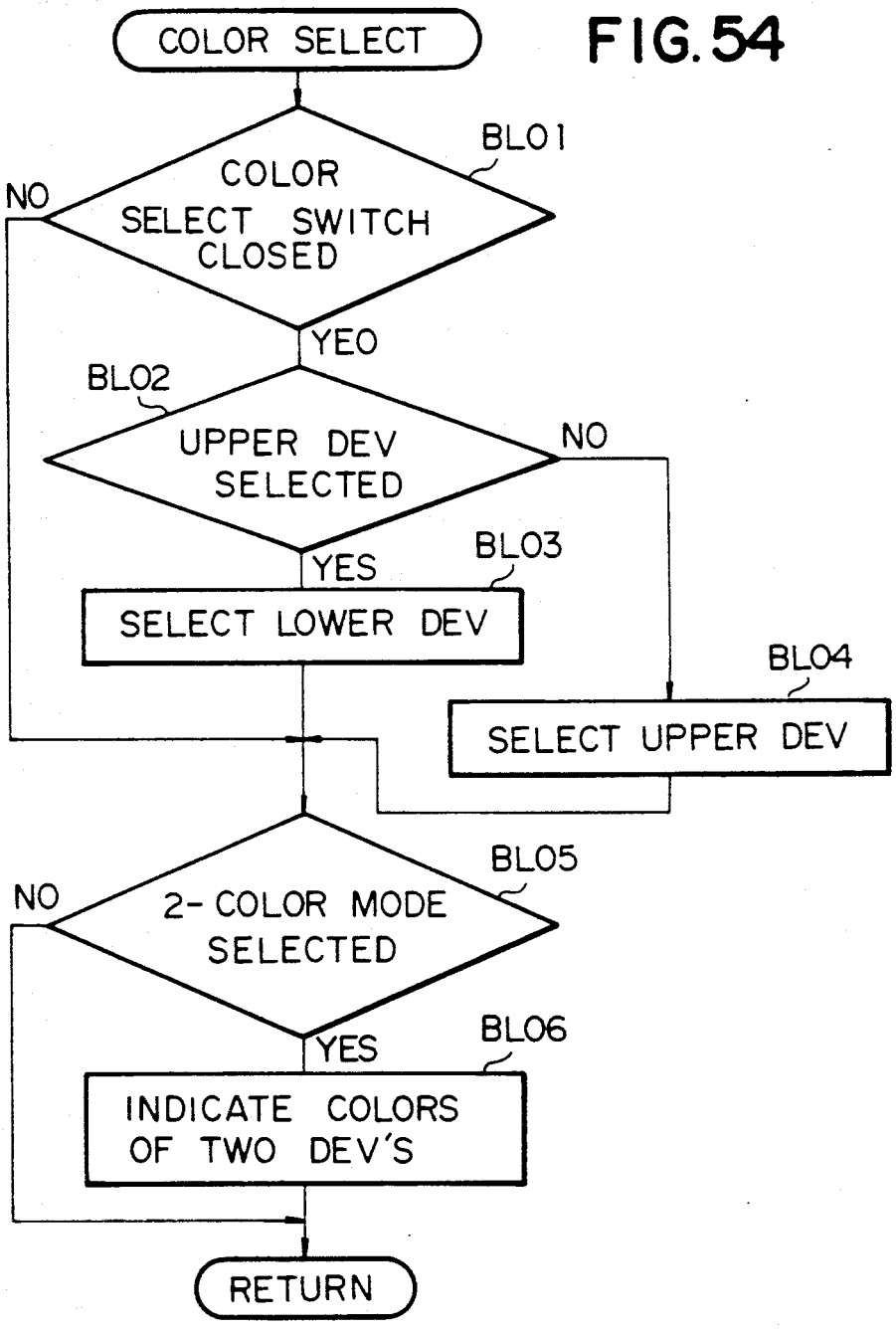
FIG. 54 is a flowchart showing the details of a color select subroutine program included in the main routine program illustrated in FIG. 53.

FIG. 54 is a flowchart showing the details of the color select subroutine program BK03 included in the main routine program illustrated in FIG. 53. The color select subroutine program BK03 starts with a decision step BL01 at which it is queried whether or not there is present a signal produced with the color select switch 220 depressed on the control panel 200. In the presence of such a signal, it is further confirmed at a step BL02 whether or not the upper developing unit 58*a* has been selected until the signal was produced with the switch 220 depressed. If the answer for this step BL02 is given in the affirmative, an instruction signal is issued at a step BL03 so that the lower developing unit 58*b* storing the black-colored toner particles is selected for use and accordingly the indicator 220*a* allocated to the black print color is turned on to illuminate. If, conversely, the answer for the step BL02 is given in the negative, an instruction signal is issued at a step BL04 so that the upper developing unit 58*a* storing the red-colored toner particles is selected for use and accordingly the indicator 220*a* allocated to the red print color is turned on to illuminate. Subsequently to the step BL03 or the step BL04 or in the absence of a signal produced with the color select switch 220 depressed as found at the step BL01, it is queried at a step BL05 whether or not the two indicators 220*a* allocated to the black and red print colors are turned on with the edited copy mode select switch 230 depressed in the edited copy mode control section 226 of the control panel 400. If it is found that such two indicators 220*a* are turned on, both of the upper and lower developing units 58*a* and 58*b* storing the red-colored and black-colored toner particles are selected for use with the two indicators 220*a* turned on.

Figure 55:
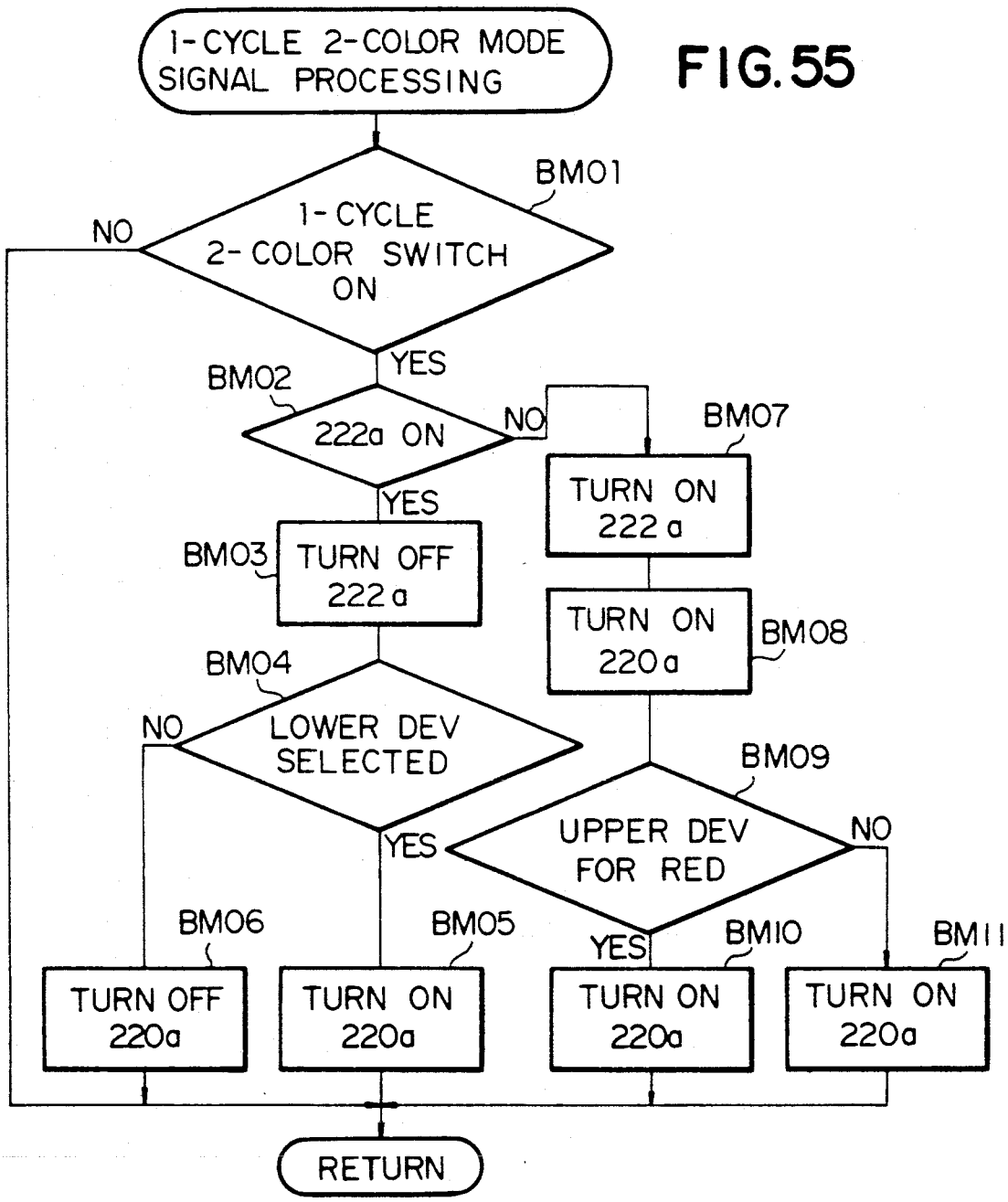
FIG. 55 is a flowchart showing the details of a single-cycle two-color mode signal processing subroutine program included in the main routine program illustrated in FIG. 53.

FIG. 55 is a flowchart showing the details of the single-cycle two-color mode signal processing subroutine program BK04 included in the main routine program illustrated in FIG. 53. The single-cycle two-color mode signal processing subroutine program BK04 starts with a decision step BM01 at which it is queried whether or not there is present a signal produced with the single-cycle two-color mode switch 222 depressed. In the presence of such a signal, it is further confirmed at a step BM02 whether or not the indicator 222*a* associated with the switch 222 is turned on. If it is found that that the indicator 222*a* is turned on, then an instruction signal is issued at a step BM03 to turn off the indicator 222*a* and, thereafter, it is queried at a step BM04 whether or not the lower developing unit 58*b* has been selected until the single-cycle two-color mode switch 222 is depressed. If the answer for this step BM04 is given in the affirmative, an instruction signal is issued at a step BM05 to turn on one of the indicators 220*a* allocated to the black print color and turn off the remaining indicators 220*a* associated with the color select switch 220. If it is found at the step BM04 that the lower developing unit 58*b* has been selected until the single-cycle two-color mode switch 222 is depressed, then an instruction signal is issued at a step BM06 to turn off the indicator 220*a* allocated to the black print color and turn off the indicator 220*a* allocated to the print color of the toner particles stored in the upper developing unit 58*a* which is herein assumed as storing red-colored toner particles.

If it is found at the step BM02 that the indicator 222*a* associated with the single-cycle two-color mode switch 222 is turned off, an instruction signal is issued at a step BM07 to turn on the indicator 222*a* and an instruction signal is issued at a step BM08 to turn on the indicator 220*a* allocated to the black print color. Thereafter, it is queried at a step BM09 whether or not the lower developing unit 58*b* stores red-colored toner particles. The answer for this step BM09 being given in the affirmative, an instruction signal is issued at a step BM10 to turn on the indicator 220*a* allocated to the red print color. If, however, the answer for the step BM09 is given in the negative, then an instruction signal is issued at a step BM11 to turn on another one of the indicators 220*a* associated with the color select switch 220.

Figure 56:
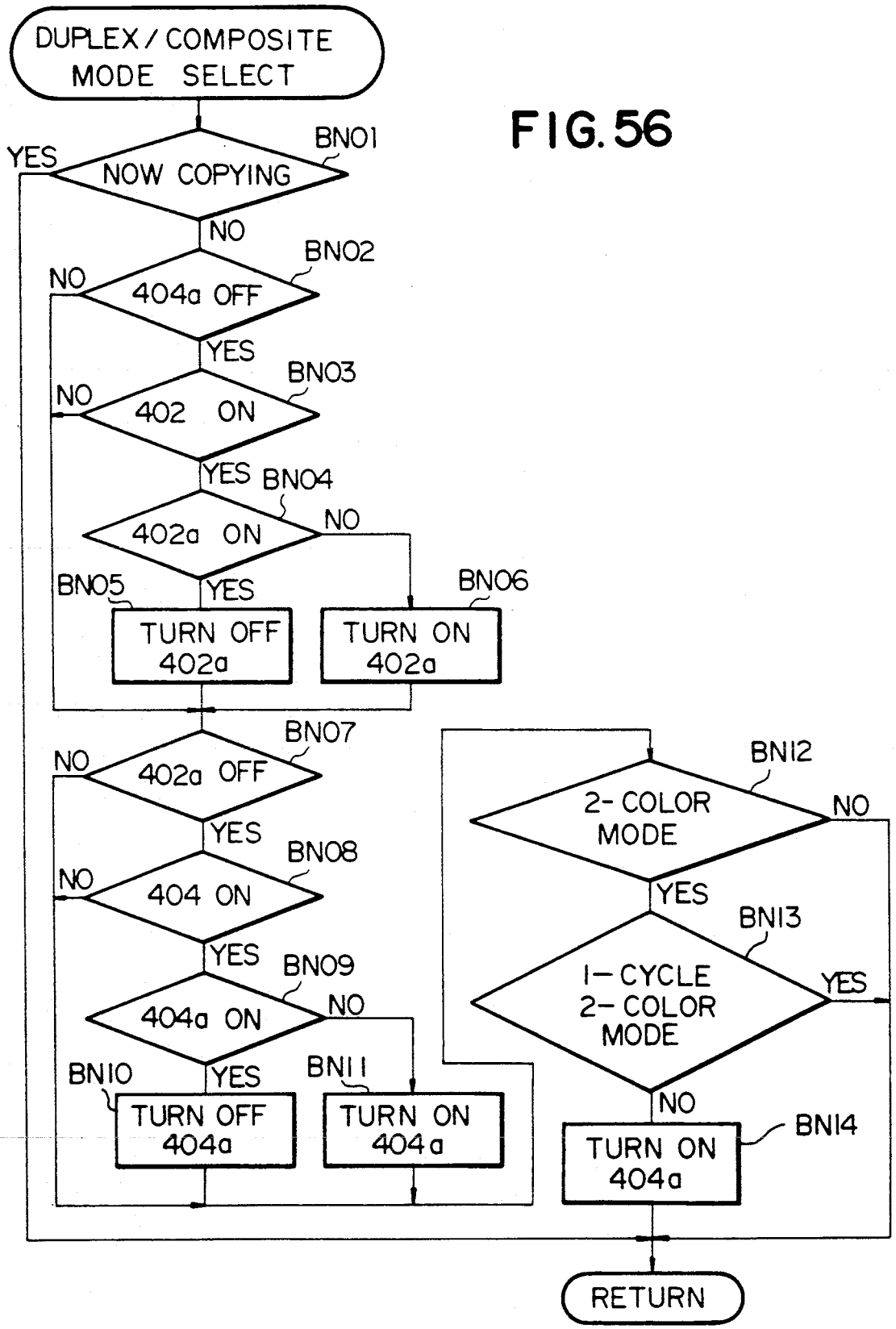
FIG. 56 is a flowchart showing the details of a duplex/ composite mode select subroutine program included in the main routine program illustrated in FIG. 53.

FIG. 56 is a flowchart showing the details of the duplex/ composite mode select subroutine program BK05 included in the main routine program illustrated in FIG. 53. The duplex/composite mode select subroutine program BK05 starts with a decision step BN01 at which it is queried whether or not a copying operation is currently in progress. If the answer for this step BN01 is given in the affirmative, it is further tested at a step BN02 whether or not the indicator 404*a* associated with the composite copy mode select switch 404 is turned off. If the indicator 404*a* is found to be turned off, it is now questioned at a step BN03 whether or not there is present a signal produced with the duplex copy mode select switch 402 depressed. In the presence of such a signal, it is confirmed at a step BN03 whether or not the indicator 402*a* associated with the duplex copy mode select switch 402 is turned on. If the indicator 402*a* is found to be turned on, an instruction signal is issued at a step BN05 to turn off the indicator 402*a* associated with the switch 402. In the absence of the signal produced with the duplex copy mode select switch 402 depressed, an instruction signal is issued at a step BN06 to turn on the indicator 402*a* associated with the switch 402.

Subsequently to the step BN05 or step BN06 or if it is found at the step BN02 that the indicator 404*a* associated with the composite copy mode select switch 404 is turned on, it is queried at a step BN07 whether or not the indicator 402*a* associated with the duplex copy mode select switch 402 is turned off. If the indicator 402*a* is found to be turned on, it is now questioned at a step BN08 whether or not there is present a signal produced with the composite copy mode select switch 404 depressed. In the presence of such a signal, it is confirmed at a step BN09 whether or not the indicator 404*a* associated with the composite copy mode select switch 404 is turned on. If the indicator 404*a* is found to be turned on, an instruction signal is issued at a step BN10 to turn off the indicator 404*a* associated with the switch 404. In the absence of the signal produced with the composite copy mode select switch 404 depressed, an instruction signal is issued at a step BN11 to turn on the indicator 404*a* associated with the switch 404.

Subsequently to the step BN10 or step BN11 or if the answer for the step BN07 or step BN08 is given in the negative, it is queried at a step BN12 whether or not a two-color mode of copying operation is currently selected in the presence of a signal produced with the edited copy mode select switch 230 depressed. If the answer for this step BN12, it is tested at a step BN13 whether or not a single-cycle two-colored mode of copying operation is currently selected in the presence of a signal produced with the single-cycle two-colored mode select switch 222 depressed. If it is found that that the single-cycle two-colored mode of copying operation is selected, then an instruction signal is issued at a step BN14 to turn on the indicator 404*a* associated with the switch 404. If the answer for the step BN12 or step BN13 is given in the negative, the duplex/composite mode select subroutine program BK05 recycles to the step BN01.

Figure 57:
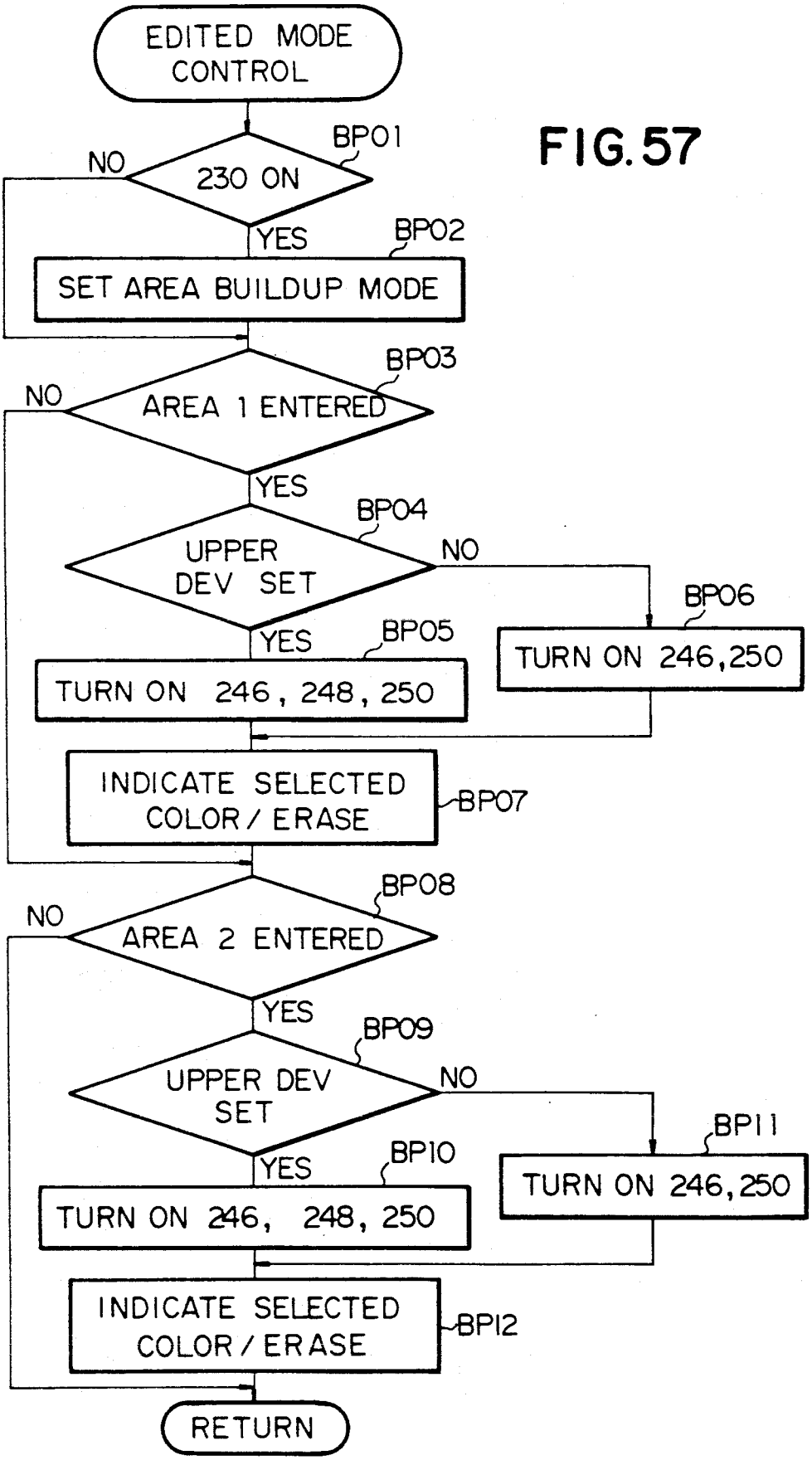
FIG. 57 is a flowchart showing the details of an edited copy mode setup subroutine program included in the main routine program illustrated in FIG. 53

FIG. 57 is a flowchart showing the details of the edited copy mode setup subroutine program BK06 included in the main routine program illustrated in FIG. 53. The edited copy mode setup subroutine program BK06 starts with a decision step BP01 at which it is queried whether or not a single-cycle two-colored mode of copying operation is currently selected in the presence of a signal produced with the single-cycle two-colored mode select switch 222 depressed. In the presence of such a signal, an instruction signal is issued at a step BP02 to turn off all the indicators 220*a* associated with the color select switch 220 and enable entry of signals to build up an area in the area display screen 234. Subsequently to this step BP02 or if it is found at the step BP01 that a single-cycle two-colored mode of copying operation is not currently selected, it is confirmed at a step BP03 whether or not entry of the x-coordinates $X_{al}$ and $X_{bl}$ and y-coordinates $Y_{cl}$ and $Y_{dl}$ for the desired edited copy/erase area 1 is complete. If the answer for this step BP03 is given in the affirmative, it is further queries at a step BP04 whether or not both of the upper and lower developing units 58*a* and 58*b* are installed within the apparatus. If the developing units 58*a* and 58*b* are found to be installed in the apparatus, an instruction signal is issued at a step BP05 by which the indicators 246*a*, 248*a* and 250*a* respectively associated with the black select switch 246, area color switch 248 and area erase switch 250 are turned on to flicker. If it is found at the step BP04 that only the lower developing unit 58*b* is installed within the apparatus, then an instruction signal is issued at a step BP06 by which the indicators 246*a* and 250*a* respectively associated with the black select switch 246 and area erase switch 250 are turned on to flicker. The operator will then depress any one of the switches 246, 248 and 250 so that, subsequently to the step BP05 or step BP06, an instruction signal is issued at a step BP07 by which the indicator associated with the depressed one of the switches 246, 248 and 250 is permitted to illuminate continuously.

Subsequently to the step BP05 or step BP07 or it is found at the step BP03 that the entry of the x- and y-coordinates specifying the desired edited copy/erase area 1 is still incomplete, it is confirmed at a step BP08 whether or not entry of the x-coordinates $X_{a2}$ and $X_{b2}$ and y-coordinates $Y_{c2}$ and $Y_{d2}$ for the desired edited copy/erase area 2 is complete. If the answer for this step BP08 is given in the affirmative, it is further queries at a step BP09 whether or not both of the upper and lower developing units 58*a* and 58*b* are installed within the apparatus. If the developing units 58*a* and 58*b* are found to be installed in the apparatus, an instruction signal is issued at a step BP10 by which the indicators 246*a*, 248*a* and 250*a* respectively associated with the black select switch 246, area color switch 248 and area erase switch 250 are turned on to flicker. If it is found at the step BP10 that only the lower developing unit 58*b* is installed within the apparatus, then an instruction signal is issued at a step BP11 by which the indicators 246*a* and 250*a* respectively associated with the black select switch 246 and area erase switch 250 are turned on to flicker. The operator will then further depress any one of the switches 246, 248 and 250 so that, subsequently to the step BP10 or step BP11, an instruction signal is thus issued at a step BP12 by which the indicator associated with the depressed one of the switches 246, 248 and 250 is permitted to illuminate continuously.

Figure 58A:
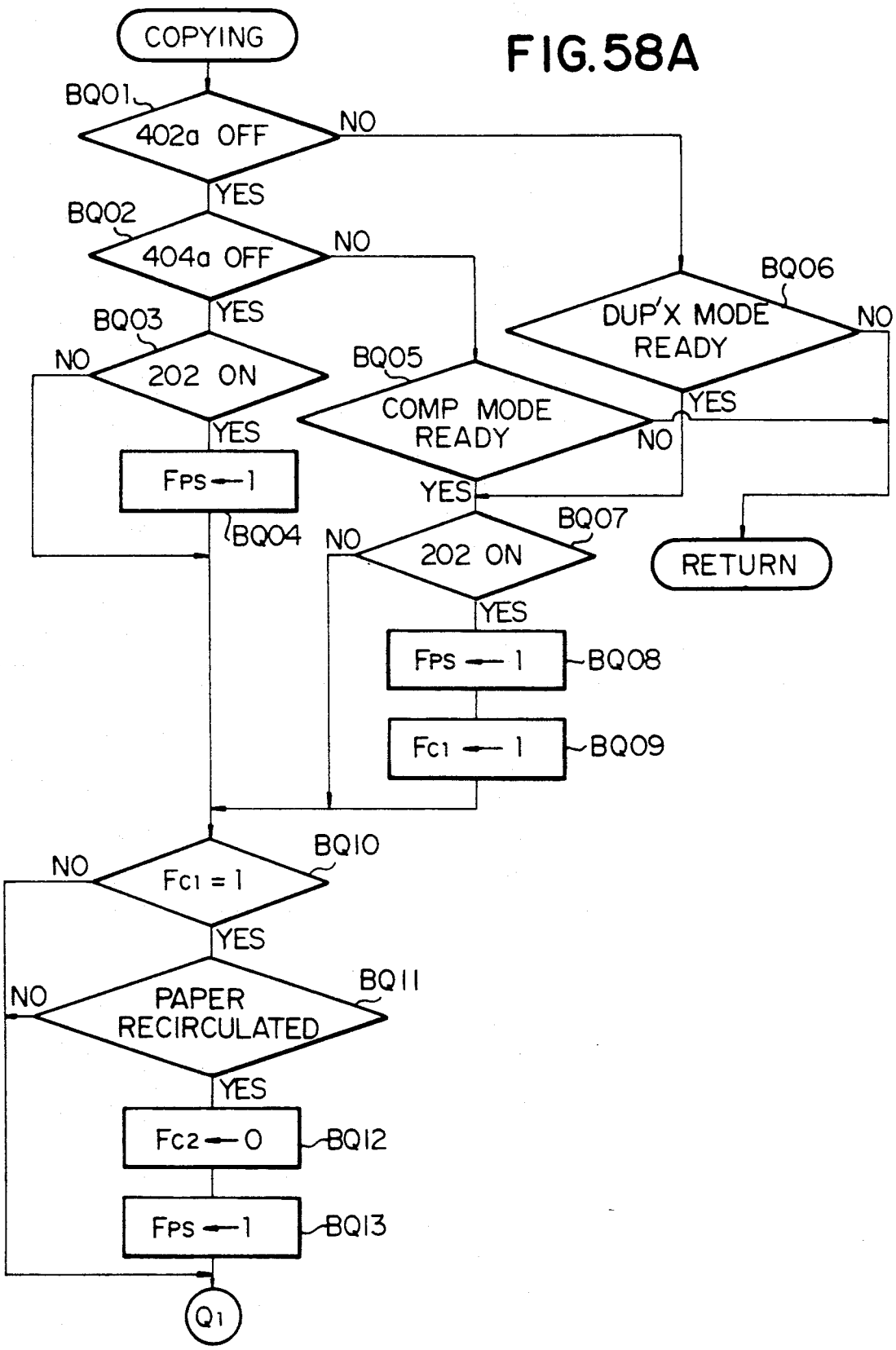
FIGS. 58A, 58B and 58C are flowcharts showing the details of a copying operation control subroutine program included in the main routine program illustrated in FIG. 53.
Figure 58B:
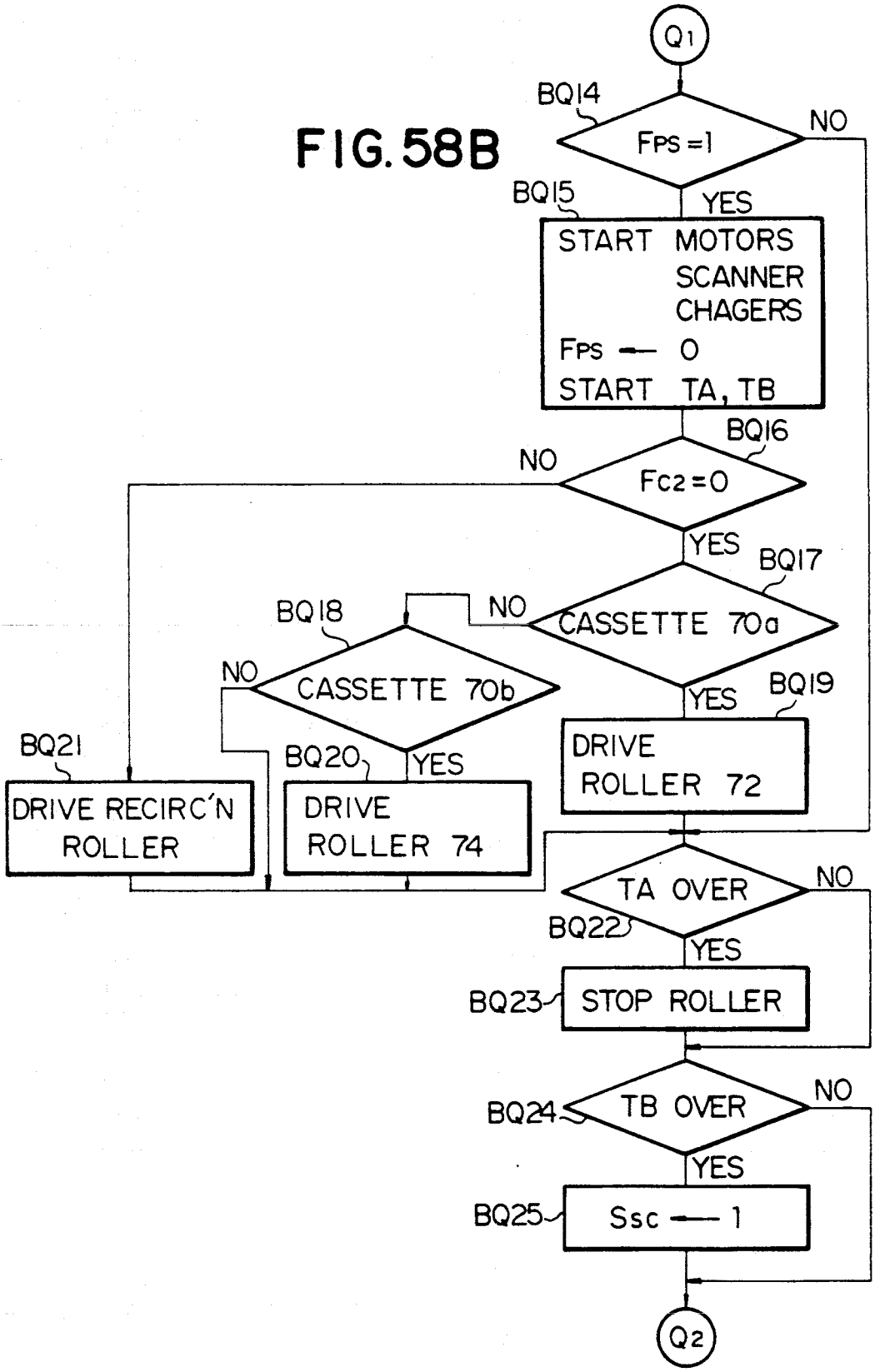
Figure 58C:
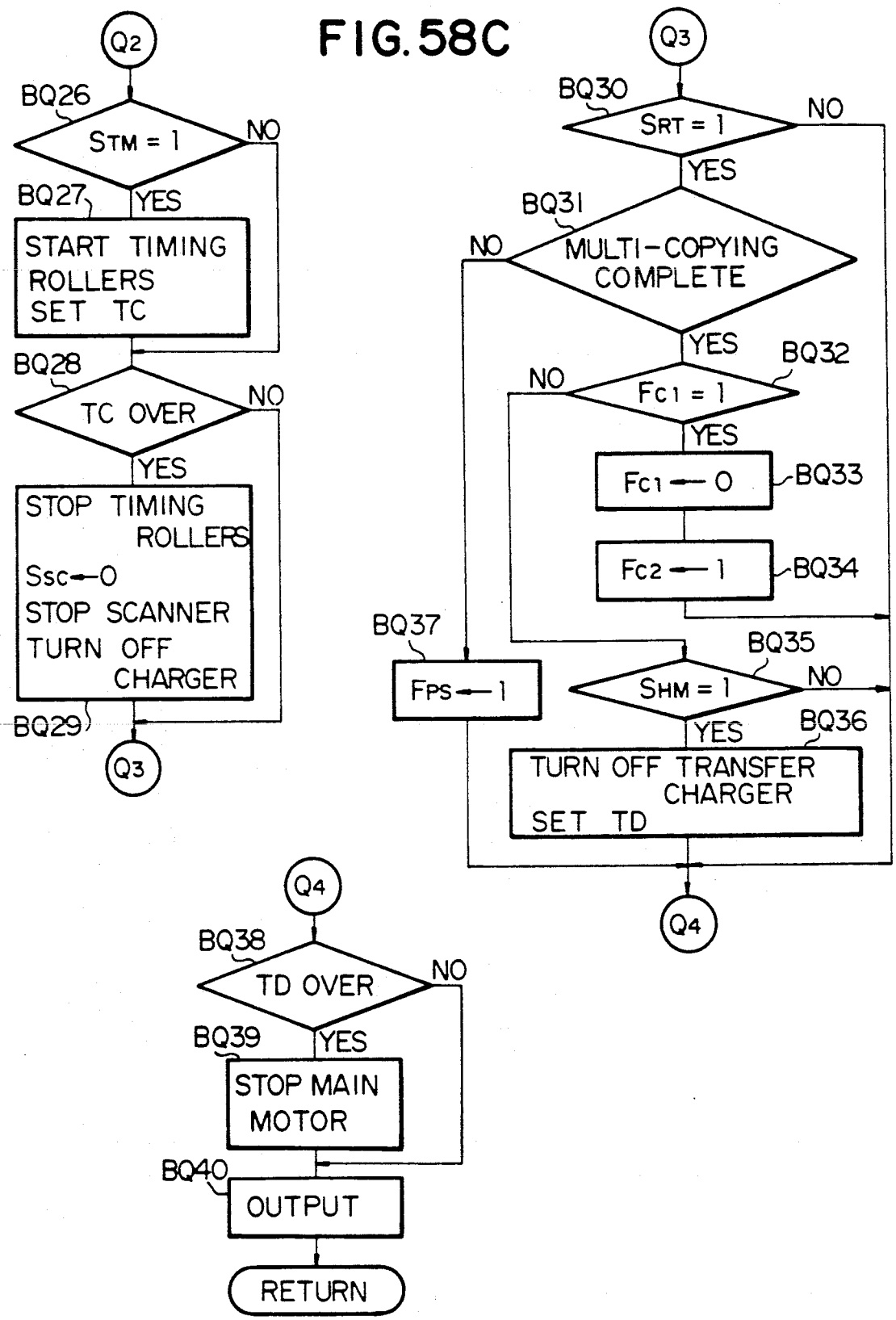

FIGS. 58A, 58B and 58C are flowcharts showing the details of the copying operation control subroutine program BK07 included in the main routine program illustrated in FIG. 53. The copying operation control subroutine program BK07 starts with a decision step BQ01 at which it is tested whether or not the indicator 402*a* associated with the duplex copy mode select switch 402 is turned off. If the indicator 402*a* is found to be turned off, it is now questioned at a step BQ02 whether or not the indicator 404*a* associated with the composite copy mode select switch 404 is turned off. If the indicator 404*a* is found to be turned off, it is confirmed at a step BQ03 whether or not there is present a signal produced with the print start switch 202 depressed. In the presence of such a signal, a print start flag $F_{ps}$ is shifted to a logic "1" bit at a step BQ04. If the indicator 404*a* is found to be turned on at the step BQ02, it is further questioned at a step BQ05 whether or not the composite mode of copying operation is ready to be executed. On the other hand, if it is determined at the step BQ01 that the indicator 402*a* associated with the duplex copy mode select switch 402 is turned on, it is tested at a step BQ06 whether or not the duplex mode of copying operation is ready to be executed. If the answer for the step BQ05 or the step BQ06 is given in the negative, the subroutine program recycles to the initial step BQ01. If the answer for the step BQ05 or BQ06 is given in the affirmative, it is confirmed at a step BQ07 whether or not there is present a signal produced with the print start switch 202 depressed. When it is found that the there is present such a signal, a print start flag $F_{ps}$ is shifted to a logic "1" bit at a step BQ08 and a first copy flag $F_{cl}$ is shifted to a logic "1" bit at a step BQ09.

Subsequently to the step BQ04 or the step BQ09 or if it is found at the step BQ03 that there is no signal produced with the print start switch 202 depressed, it is questioned at a step BQ10 whether or not a second copy flag $F_{c2}$ has a logic "1" bit. If it is found that that the second copy flag $F_{c2}$ has a logic "1" bit, it is confirmed at a step BQ11 whether or not the supply of a copying sheet for use in a duplex or composite mode of copying operation is complete by the duplex/composite copy paper feed system 94. If the answer for this step BQ11 is given in the affirmative, then the second copy flag $F_{c2}$ is shifted to a logic "0" bit at a step BQ12 and the print start flag $F_{ps}$ is shifted to a logic "1" bit at a step BQ13.

Thereupon, it is confirmed at a step BQ14 whether or not the print start flag $F_{ps}$ is of a logic "1" bit. If the answer for this step BQ14 is given in the affirmative, the print start flag $F_{ps}$ is shifted to a logic "0" bit and signals are issued to activate the drivers and actuators for the main drive motor, the motor for each of the developing units 58*a* and 58*b*, and the chargers 56, 62 and 64. At this step BQ15 are also started internal timers TA and TB of the CPUl 408. The timer TA is predominant over the time when each of the clutches for the paper feed rollers 72 and 74 is to be de-energized and the timer TB is predominant over the time at which the document scanning system 24 is to be initiated into motion.

Subsequently to the step BQ15, it is confirmed at a step BQ16 whether or not the second copy flag $F_{c2}$ has a logic "0" bit. If it is found that the second copy flag $F_{c2}$ has a logic "0" bit, it is further queried at a step BQ17 or through steps BQ17 and BQ18 which of the first and second paper supply cassettes 70*a* and 70*b* is currently selected. On the basis of the result of this decision, a signal is issued at a step BQ19 or a step BQ2 to actuate either the clutch for the first paper feed roller 72 or the clutch for the second paper feed roller 74 to feed a copying sheet from the paper supply cassette 70*a* or 70*b*. If it is found at the step BQ16 that the second copy flag $F_{c2}$ has a logic "1" bit, then an instruction signal is issued at a step BQ21 to activate the clutch ($C_{RC}$, FIG. 52) for actuating the paper recirculation roller pair included in the duplex/composite copy paper feed system 94. Subsequently to any of the steps BQ19, BQ20 and BQ21, it is confirmed at a step BQ22 whether or not the time set by the timer TA is reached. When it is determined that such a time has been reached, a signal is issued at a step BQ23 to de-energize the clutch for the paper feed roller 72 or 74 or the clutch ($C_{RC}$) for the paper recirculation roller pair which has been in operation. When it is thereafter confirmed at a step BQ24 that the time set by the timer TB is reached, a document scanning signal $S_{SC}$ of a logic "1" bit is issued at a step BQ25 to enable the document scanning system 24 to start the optical scanning operation.

The subroutine program BK07 then jumps to the steps shown in FIG. 58B and questions at a step whether or not there is a timing signal $S_{TM}$ of a logic "1" bit. The timing signal $S_{TM}$ of logic "1" bit is issued when it is detected that the document scanner 36 has reached a predetermined position after the scanner was initiated into forward movement from its home position. When it is found at the step BQ26 that such a timing signal $S_{TM}$ of logic "1" bit is present, a signal is issued at a step BQ27 to actuate the clutch ($C_{TM}$) for the timing rollers 82 so that the copying sheet which has reached the timing rollers 82 is allowed to advance into contact with the rotating image transfer drum 54. At this step BQ27 is further started an internal timer TC of the CPUl 408. The timer TC of the CPUl 408 is predominant over the time at which the scanning operation by the system 24 is to be terminated and the clutch ($C_{TM}$) for the timing rollers 82 is to be deenergized. The time thus counted by the timer TC is a parameter dictated by the selected size of the copying sheet and the selected magnification ratio of copying. When it is thereafter confirmed at a step BQ28 that such a time is reached, signals are issued at a step BQ29 to de-activate the main charger 56, terminate the operation by the scanning system 24 with the scanning signal $S_{SC}$ shifted to a logic "0" bit, and de-energize the clutch for the timing rollers 82.

Subsequently to the step BQ29, it is confirmed at a step BQ30 whether or not a scanner return signal $S_{RT}$ is of a logic "1" bit. This scanner return signal $S_{RT}$ is generated when the document scanner 36 reaches the predetermined foremost position with respect to the document table 22. On transition of the scanner return signal $S_{RT}$ to logic "1" bit, the document scanner 36 starts to travel back to its home position. If the current copying operation is of the multi-copying mode requiring to produce two or more copy prints for a single document, it is confirmed at a subsequent step BQ31 whether or not the copying cycles have been repeated the required number of times. If it is confirmed that the multi-copying operation is complete, it is further confirmed at a step BQ32 whether or not the first copy flag $F_{c1}$ is of a logic "1" bit. At a point of time the document scanner 36 reaches its home position and accordingly the first copy flag $F_{c1}$ is detected to have a logic "1" bit, the first copy flag $F_{c1}$ is shifted to logic "0" bit at a step BQ33 and the second copy flag $F_{c2}$ is shifted to logic "1" bit at a step BQ34. It is then confirmed at a step BQ35 whether or not there is present a scanner home position signal $S_{HM}$ of a logic "1" bit which is generated when the document scanner 36 has moved back to its home position. If it is found that there is such a scanner home position signal $S_{HM}$, signals are issued at a step BQ36 to stop the motor in the developing stage 58 and de-activate the transfer charger 62. At this step BQ36 is further started an internal timer TD which is predominant over the time when the main drive motor is to be brought to a stop. If it is found at the step BQ31 that the multicopying operation is still incomplete, then the print start flag $F_{ps}$ is shifted to a logic "1" bit at a step BQ37 to complete the required multi-copying operation. When it is confirmed at a step BQ38 subsequent to the step BQ36 or step 37 that the time set by the timer TD is reached, a signal is issued to stop the main drive motor at a step BQ39 and thereafter control signals are transferred from the first CPUl 408 to other CPUs including the second CPU2 410 as at a step BQ40.

Figure 59:
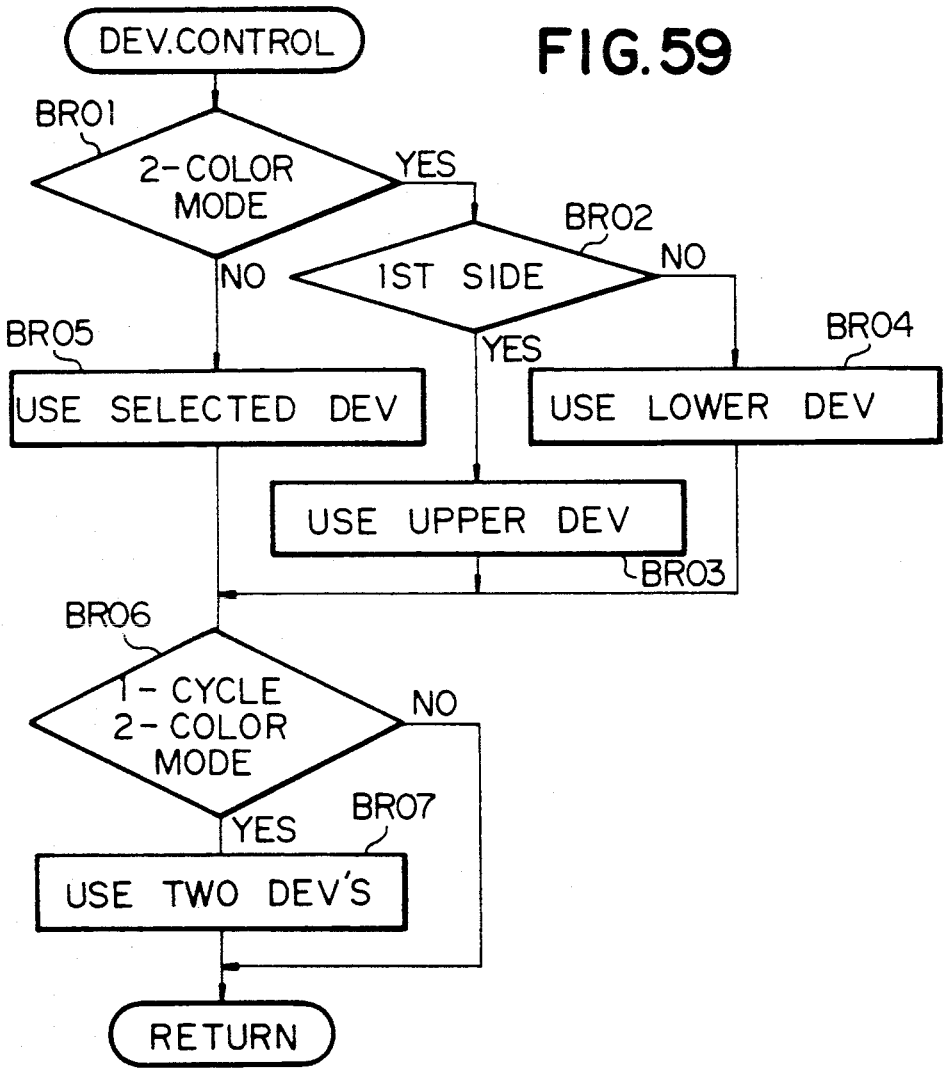
FIG. 59 is a flowchart showing the details of a developing stage control subroutine program included in the main routine program illustrated in FIG. 53.

FIG. 59 is a flowchart showing the details of the developing stage control subroutine program BK08 included in the main routine program illustrated in FIG. 53. The developing stage control subroutine program BK08 starts with a decision step BR01 at which it is queried whether or not a two-colored copy mode of operation is currently selected in the presence of a signal produced with the edited copy mode select switch 230 depressed. In the presence of such a signal, it is confirmed at a step BR02 whether or not the duplicate images are to be printed on a first side of the supplied copying sheet. If the answer for this step BR02 is given in the affirmative, an instruction signal is issued at a step BR03 to select for use the upper developing unit 58*a* storing the red-colored toner particles. If the answer for this step BR02 is given in the negative, viz., the duplicate images are to be printed on a second side of the supplied copying sheet, an instruction signal is issued at a step BR04 to select the lower developing unit 58*b* storing the black-colored toner particles. If it is found at the step BR01 that a two-colored copy mode of operation is not currently selected, then an instruction signal is issued at a step BR05 so that the selected one of the developing units 58*a* and 58*b* is to be put to use. Subsequently to any of the steps BR03, BR04 and BR05, it is queried at a step BR06 whether or not a single-cycle two-colored mode of copying operation is selected with the switch 222 depressed. The instruction signal issued at any of the steps BR03, BR04 and BR05 is disregarded and instead an instruction signal is issued at a step BR07 to use both of the upper and lower developing units 58*a* and 58*b* respectively for the two separate zones defined by the color shift control device 100.

What is claimed is:

1. An image duplicating apparatus comprising a) means for designating a plurality of localized areas of a document sheet bearing visible images, b) first input means for entering conditions relating to the formation of the images within each of the designated areas, the conditions to be entered by the first input means being different from one of the designated areas to another, c) second input means for entering conditions relating to the formation of the images outside said designated areas, and d) image reproducing means capable of duplicating the images on the whole area of the document sheet onto a single face of a copying sheet, the image reproducing means having an anamophoscopic function to duplicate images on a document sheet with one magnification/reduction ratio selected for one orthogonal axes and another magnification/reduction ratio selected for another orthogonal axes, e) wherein the images within each of the designated areas of the document are duplicated onto said single face of the copying sheet in accordance with the conditions entered by said first input means and the images outside said designated areas of the document are duplicated onto said single face of the copying sheet in accordance with the conditions entered by said second input means.

2. An image duplicating apparatus as set forth in claim 1, in which the conditions to be entered by said first input means include a condition enabling said image reproducing means to execute said anamophoscopic function.

3. An image duplicating apparatus as set forth in claim 1, in which the conditions to be entered by said second input means include a condition enabling said image reproducing means to execute said anamophoscopic function.

4. An image duplicating apparatus comprising a) first designating means for designating a localized area of a document sheet bearing visible images, b) second designating means for designating, independently of said first designating means, a localized area of said document sheet bearing visible images, c) first input means for entering conditions relating to the formation of the images within the area designated by said first designating means, d) second input means for entering conditions relating to the formation of the images within the area designated by said second designating means, e) image reproducing means for duplicating the images on said document sheet onto a single face of a copying sheet, the images within the area designated by said first designating means being duplicated onto said single face of the copying sheet in accordance with the conditions entered by said first input means and the images within the area designated by said second designating means being duplicated onto said single face of the copying sheet in accordance with the conditions entered by said second input means, and f) control means which, when the areas respectively designated by said first and second designating means have partly overlapped portions, enables said image reproducing means to duplicate the images within said overlapped portions in accordance with the conditions entered by said first input means.

5. An image duplicating apparatus comprising a) means for designating a localized area of a document sheet bearing visible images, b) first input means for entering conditions relating to the formation of the images within the designated area, the conditions to be entered by the first input means including a condition for selecting an anamophoscopic mode of operation for duplicating images on a document sheet with one magnification/reduction ratio selected for one orthogonal axes and another magnification/reduction ratio selected for another orthogonal axes, c) second input means for entering conditions relating to the formation of the images outside said designated areas, and d) image reproducing means capable of duplicating the images on the whole area of the document sheet onto a single face of a copying sheet, the image reproducing means having an anamorphoscopic function to reproduce images in said anamophoscopic mode of operation, e) wherein the images within the designated area of the document are duplicated onto the single face of the copying sheet in accordance with the conditions entered by said first input means and the images outside said designated area of the document are duplicated onto the single face of the copying sheet in accordance with the conditions entered by said second input means.

6. An image duplicating apparatus comprising a) first designating means for designating a localized area of a document sheet bearing visible images, b) second designating means for designating, independently of said first designating means, a localized area of said document sheet bearing visible images, c) first input means for entering conditions relating to the formation of the images within the area designated by said first designating means, d) second input means for entering conditions relating to the formation of the images within the area designated by said second designating means, e) image reproducing means for duplicating the images on said document sheet onto a single face of a copying sheet, the images within the area designated by said first designating means being duplicated onto said single face of the copying sheet in accordance with the conditions entered by said first input means and the images within the area designated by said second designating means being duplicated onto said single face of the copying sheet in accordance with the conditions entered by said second input means, and f) control means which, when the area designated by said second designating means is totally contained within the coverage of the area designated by said first designating means, enables said image reproducing means to operate such that the images within the area designated by said second designating means are to be duplicated in accordance with the conditions entered by said second input means and that the images within the portion which the area designated by said first designating means has outside said area designated by said second designating means are to be duplicated in accordance with the conditions entered by said first input means.

7. An image duplicating apparatus as set forth in claim 6, in which said image reproducing means comprises a plurality of developing units respectively allocated to different print colors.

8. An image duplicating apparatus as set forth in claim 7, in which the conditions to be entered by said first input means include a condition for selecting one of said plurality of developing units.

9. An image duplicating apparatus as set forth in claim 7, in which the conditions to be entered by said second input means include a condition for selecting one of said plurality of developing units.

10. An image duplicating apparatus as set forth in claim 7, in which said image reproducing means is operative to erase the images within a desired one of said plurality of said designated areas.

11. An image duplicating apparatus as set forth in claim 10, in which the conditions to be entered by said first input means include a condition for erasing the images within the desired one of said plurality of said designated areas.

12. An image duplicating apparatus as set forth in claim 10, in which the conditions to be entered by said second input means include a condition for erasing the images within the desired one of said plurality of said designated areas.

13. An image duplicating apparatus as set forth in claim 6 in which said image reproducing means has an anamophoscopic function to duplicate images on a document sheet with one magnification/reduction ratio selected for one of orthogonal axes and another magnification/reduction ratio selected for the other of orthogonal axes.

14. An image duplicating apparatus as set forth in claim 13, in which the conditions to be entered by said first input means include a condition enabling said image reproducing means to execute said anamophoscopic function.

15. An image duplicating apparatus as set forth in claim 13, in which the conditions to be entered by said second input means include a condition enabling said image reproducing means to execute said anamophoscopic function.

16. An image duplicating apparatus comprising a) first input means for entering data specifying a localized area of a document sheet bearing visible images, b) second input means for entering data relating to the magnification/reduction ratio with which images on a document sheet are to be duplicated, c) arithmetic means responsive to the data entered by said first and second input means for generating data defining an area of a copying sheet within which images are to be duplicated from said document sheet, d) means for correcting the data generated by said arithmetic means when the area defined by the data generated by said arithmetic means is smaller than an area with a prescribed measurement, and d) image reproducing means capable of duplicating the images on said document sheet onto said copying sheet, the images within the area defined by the data generated by said arithmetic means being duplicated with the magnification/reduction ratio determined on the basis of the data entered by said second input means.

17. An image duplicating apparatus comprising a) first input means for entering data specifying a localized area of a document sheet bearing visible images, b) second input means for entering data relating to the magnification/reduction ratio with which images on a document sheet are to be duplicated, c) a photosensitive medium, d) means for applying electrostatic charges on the surface of said photosensitive medium, e) light projecting means for projecting onto the surface of said photosensitive medium a beam of light carrying the images on said document sheet, f) charge eliminating means capable of eliminating the electrostatic charges on a localized area of said surface of the photosensitive medium, g) arithmetic means responsive to the data entered by said first and second input means for generating data specifying said localized area of said surface of the photosensitive medium, h) means for correcting the data generated by said arithmetic means when the area defined by the data generated by said arithmetic means is smaller than an area with a prescribed measurement, i) first control means for controlling said charge eliminating means on the basis of the data generated by said arithmetic means, and j) second control means for controlling said light projecting means on the basis of the data entered by said second input means.

18. An image duplicating apparatus as set forth in claim 17, further comprising third input means for entering conditions relating to the formation of the images within the area specified by said first input means.

19. An image duplicating apparatus as set forth in claim 18, further comprising a plurality of developing units each for applying toner particles onto the surface of said photosensitive medium, said developing units storing toner particles of respectively different colors.

20. An image duplicating apparatus as set forth in claim 19, in which the conditions to be entered by said third input means include a condition for selecting one of said plurality of developing units.

21. An image duplicating apparatus as set forth in claim 17, in which said light projecting means has an anamophoscopic function to illuminate the surface of said photosensitive medium with a beam of light with one magnification/reduction ratio selected for one of orthogonal axes and another magnification/reduction ratio selected for the other of orthogonal axes.

22. An image duplicating apparatus as set forth in claim 21, in which the conditions to be entered by said second input means include a condition enabling said light projecting means to execute said anamophoscopic function.

23. An image duplicating apparatus comprising a) first designating means for entering data specifying a localized area of a document sheet bearing visible images, b) second designating means for entering data specifying the color in which images within the specified area of said document sheet are to be duplicated, c) third designating means for specifying a particular location within said document sheet, d) first mode select means for selecting a first mode of copying operation, e) second mode select means for selecting a second mode of copying operation, and f) image reproducing means capable of duplicating the images on said document sheet onto a copying sheet, g) wherein, when said first mode of copying operation is selected by said first mode select means, the images within the area specified by the data generated by said first designating means are duplicated onto said copying sheet in the color specified by the data entered by said second designating means, when said second mode of copying operation is selected by said second mode select means, the whole area of said document sheet is divided into two adjacent sections on the basis of the location specified by said third designating means the images within one of the two adjacent sections are to be duplicated in one color and the images within the other of the two adjacent sections are to be duplicated in another color, and when both of said first and second modes of copying operation are concurrently selected respectively by said first and second mode select means, the images within the area specified by the data generated by said first designating means are duplicated onto said copying sheet in said second mode of operation.

24. An image duplicating apparatus as set forth in claim 23, in which said image reproducing means comprises A) a photosensitive medium, B) means for applying electrostatic charges on the surface of said photosensitive medium, C) support means for supporting a document sheet thereon, D) optical means for scanning the image-bearing surface of a document sheet on said support means from one end of the document sheet to the other and projecting onto the charged surface of said photosensitive medium a beam of light carrying the images on said document sheet, E) charge eliminating means capable of eliminating the electrostatic charges on a localized area of said surface of the photosensitive medium, and F) a plurality of developing units respectively storing developers of different colors.

25. An image duplicating apparatus as set forth in claim 24, in which said charge eliminating means is operative to eliminate the electrostatic charges on that area of said surface of the photosensitive medium which corresponds to the localized area specified by said first designating means when said first mode of copying operation is selected by said first mode select means or when both of said first and second modes of copying operation are concurrently selected respectively by said first and second mode select means.

26. An image duplicating apparatus comprising a) first input means for designating a plurality of localized areas of a document sheet bearing visible images, b) second input means for entering conditions relating to the formation of the images within each of the designated areas, the conditions to be entered by the second input means being different from one of the designated areas to another, c) first mode select means for selecting an edited mode of copying operation allowing entry by said first and second input means, and d) image reproducing means operable in a first mode for producing visible images on a single face of a copying sheet in a single cycle of operation and a second mode for producing visible images on a single face of a copying sheet in at least two cycles of operation, e) second mode select means for selecting one of said first and second modes of operation of said image reproducing means, and f) means operative to select said second mode without respect to said second mode select means when said edited mode of copying operation is selected by said first mode select means.

27. An image duplicating apparatus as set forth in claim 26, in which the conditions to be entered by said second input means includes a condition specifying the color in which images on a document sheet are to be duplicated.

28. An image duplicating apparatus as set forth in claim 27, in which said image reproducing means comprises a plurality of developing units respectively allocated to different print colors.

29. An image duplicating apparatus as set forth in claim 26, in which the conditions to be entered by said second input means includes a condition specifying the magnification/reduction ratio with which images on a document sheet are to be duplicated.

30. An image duplicating apparatus comprising a) designating means for designating a plurality of localized areas of a document sheet bearing visible images, b) input means for entering conditions relating to the formation of the images within each of the designated areas, the conditions to be entered by said input means being different from one of the designated areas to another, c) image reproducing means operable in a first mode for producing visible images on a single face of a copying sheet in a single cycle of operation and a second mode for producing visible images on a single face of a copying sheet in at least two cycles of operation, d) mode select means for selecting one of said first and second modes of operation of said image reproducing means, and e) means operative to select said second mode without respect to said mode select means when a plurality of areas are designated by said designating means and conditions different from one of the designated areas to another are entered by said input means.

31. An image duplicating apparatus as set forth in claim 30, in which the conditions to be entered by said input means includes a condition specifying the color in which images on a document sheet are to be duplicated.

32. An image duplicating apparatus as set forth in claim 31, in which said image reproducing means comprises a plurality of developing units respectively allocated to different print colors.

33. An image duplicating apparatus as set forth in claim 30, in which the conditions to be entered by said input means includes a condition specifying the magnification/reduction ratio with which images on a document sheet are to be duplicated.

* * * * *